US011085143B2

(12) United States Patent
Wakizaka et al.

(10) Patent No.: US 11,085,143 B2
(45) Date of Patent: Aug. 10, 2021

(54) DRYER

(71) Applicant: SAMSUNG ELECTRONICS CO., LTD., Suwon-si (KR)

(72) Inventors: Eiji Wakizaka, Yokohama (JP); Susumu Kitamura, Yokohama (JP); Naoki Kitayama, Yokohama (JP); Tatsushi Shimada, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 410 days.

(21) Appl. No.: 15/528,394

(22) PCT Filed: Nov. 19, 2015

(86) PCT No.: PCT/KR2015/012487
§ 371 (c)(1),
(2) Date: May 19, 2017

(87) PCT Pub. No.: WO2016/080788
PCT Pub. Date: May 26, 2016

(65) Prior Publication Data

US 2017/0314181 A1 Nov. 2, 2017

(30) Foreign Application Priority Data

Nov. 19, 2014 (JP) ..... JP2014-234272
Nov. 19, 2014 (JP) ..... JP2014-234347
(Continued)

(51) Int. Cl.
*D06F 58/20* (2006.01)
*D06F 58/30* (2020.01)
(Continued)

(52) U.S. Cl.
CPC ..... *D06F 58/206* (2013.01); *D06F 58/30* (2020.02); *D06F 58/02* (2013.01); *D06F 2103/50* (2020.02); *D06F 2105/26* (2020.02)

(58) Field of Classification Search
CPC .. D06F 58/206; D06F 58/28; D06F 2058/287; D06F 58/02; D06F 58/26;
(Continued)

(56) References Cited

U.S. PATENT DOCUMENTS

2005/0246920 A1* 11/2005 Yabuuchi ..... D06F 58/02 34/515
2013/0340278 A1* 12/2013 Pillot ..... D06F 58/206 34/524
2014/0082960 A1* 3/2014 Bison ..... D06F 58/206 34/477

FOREIGN PATENT DOCUMENTS

CN 1924176 3/2007
CN 102560986 7/2012
(Continued)

OTHER PUBLICATIONS

Chinese Office Action dated Nov. 30, 2018 in Chinese Patent Application No. 201580072450.4.
(Continued)

*Primary Examiner* — Jessica Yuen
(74) *Attorney, Agent, or Firm* — Staas & Halsey LLP

(57) ABSTRACT

Disclosed herein is a heat pump type dryer for reducing the manufacturing cost thereof and maintaining an appropriate quantity of radiation by auxiliary heat exchanger. The clothes dryer D includes housing 1; drum portion 2 installed in the housing 1 and configured to accommodate clothes; a circulation ventilation path 3 configured to pass through the drum portion 2; a heat pump apparatus 5 having a compressor 52, a condenser 53, a throttling device 54, and an evaporator 51, connected to form a flow path through which
(Continued)

refrigerant circulates; an auxiliary heat exchanger 55 installed outside the ventilation path, and connected in series to a flow path in the condenser 53 or in parallel to the condenser 53; and a cooling apparatus 6 configured to cool the auxiliary heat exchanger 55.

7 Claims, 45 Drawing Sheets

(30) Foreign Application Priority Data

Nov. 19, 2014 (JP) ..... JP2014-234436
Jun. 19, 2015 (JP) ..... JP2015-124120
Nov. 18, 2015 (KR) ..... 10-2015-0161873

(51) Int. Cl.
*D06F 58/02* (2006.01)
*D06F 103/50* (2020.01)
*D06F 105/26* (2020.01)

(58) Field of Classification Search
CPC ..... D06F 58/20; D06F 58/30; D06F 2103/50; D06F 2105/26
See application file for complete search history.

(56) References Cited

FOREIGN PATENT DOCUMENTS

| | | | |
|---|---|---|---|
| CN | 102605596 | | 7/2012 |
| CN | 103314152 | | 9/2013 |
| CN | 103403247 | | 11/2013 |
| DE | 102005062939 | | 7/2007 |
| DE | 102005062939 | A1 | 7/2007 |
| EP | 2468947 | A1 | 6/2012 |
| EP | 2468948 | A2 | 6/2012 |
| JP | 2004-239549 | | 8/2004 |
| JP | 2006-078015 | A | 3/2006 |
| JP | 2011-250849 | | 12/2011 |
| JP | 2012-130473 | A | 7/2012 |
| JP | 5617602 | | 9/2014 |
| KR | 10-2012-0072091 | | 7/2012 |
| KR | 10-2012-0077098 | | 7/2012 |
| KR | 10-2012-0110495 | | 10/2012 |
| KR | 10-1274288 | | 6/2013 |

OTHER PUBLICATIONS

European Communication dated Jan. 11, 2019 in European Patent Application No. 15861406.5.
European Office Action dated May 4, 2018 in corresponding European Patent Application No. 15 861 406.5, 5 pgs.
Form PCT/ISA/237; Written Opinion; dated Mar. 8, 2016 in corresponding International Patent Application No. PCT/KR2015/012487 (7 pages).
Form PCT/ISA/210; International Search Report dated Mar. 8, 2016 in corresponding International Patent Application No. PCT/KR2015/012487 (3 pages) (2 pages English Translation).
European Search Report dated Oct. 17, 2017 in corresponding European Patent Application No. 15861406.5.
European Communication pursuant to Article 94(3) EPC dated Nov. 7, 2017 in corresponding European Patent Application No. 15861406.5.

* cited by examiner

DRYER

This application is a U.S. national stage application under 35 USC 371 of PCT International Patent Application No. PCT/KR2015/012487, filed on Nov. 19, 2015, which claims the benefit of Japanese Patent Application No. 2014-234272, filed on Nov. 19, 2014, Japanese Patent Application No. 2014-234347, filed on Nov. 192014, Japanese Patent Application No. 2014-234436, filed on Nov. 19, 2014, Japanese Patent Application No. 2015-124120, filed on Jun. 19, 2015, and Korean Patent Application No. 10-2015-0161873, filed Nov. 18, 2015, the contents of which are incorporated herein by reference.

TECHNICAL FIELD

The present invention relates to a dryer of drying clothes and the like.

BACKGROUND ART

Patent Document 1 discloses an example of a heat pump type dryer. The heat pump type dryer has an auxiliary heat exchanger (a second condenser) connected in parallel to a condenser, outside a ventilation path through which air for drying circulates. Also, in a connection portion of the immediately upstream side of the condenser (that is, in a branch portion at which the flow path of the immediately downstream side of a compressor is connected to the flow path of the upstream side of the condenser and the auxiliary heat exchanger), a switching valve that can be controlled by predetermined signals is installed. The switching valve is configured to form a flow path of causing refrigerant discharged from the compressor to flow only to the condenser, a flow path of causing the refrigerant to distributively flow to the condenser and the auxiliary heat exchanger, or a flow path of causing the refrigerant to flow only to the auxiliary heat exchanger. The dryer controls the switching valve, when there is probability that air in the ventilation path will be overheated or that refrigerant will be overheated, to thus cause a predetermined quantity of the refrigerant to flow to the auxiliary heat exchanger. The refrigerant flowing through the auxiliary heat exchanger contacts air outside the ventilation path to thereby radiate heat naturally and be cooled. Since refrigerant of a relatively high temperature and high pressure flows in the flow path extending from the compressor to the condenser before air in the ventilation path is completely heated, the auxiliary heat exchanger is installed to prevent overheating and overpressure of the refrigerant, thereby avoiding occurrence of any problem in operating the compressor.

Patent Document 2 discloses another example of a heat pump type dryer. The heat pump type dryer has an auxiliary heat exchanger (a subsidiary heat exchanger) connecting the immediately downstream side of a condenser (a main heat exchanger) to the upstream side of a throttling device in series, outside a ventilation path. That is, refrigerant passed through the condenser flows into the throttling device via the auxiliary heat exchanger. Refrigerant flowing through the auxiliary heat exchanger disclosed in Patent Document 2 radiates heat forcibly by blowing from a cooling fan installed outside the ventilation path, to thus be cooled. The blowing from the cooling fan cools the auxiliary heat exchanger, and then cools a refrigerant pipe through which refrigerant just discharged from the compressor flows.

Also, a circulation type clothes dryer of circulating air dehumidified and heated through the heat exchanger configured as described above has been known. In the circulation type clothes dryer, a cooling apparatus for cooling and dehumidifying air for drying, a heating apparatus for heating air passed through the cooling apparatus, and a fan for circulating the air for drying in a circulation ventilation path are all installed in the circulation ventilation path.

In the clothes dryer, if the fan is installed in the immediately downstream side of a heat exchanger, it is difficult to ensure sufficient space with respect to the thickness direction of a blow duct installed between the fan and an air inlet of a drum. Accordingly, it is difficult to form an ideal airflow path, and ventilation resistance increases in the air inlet, etc. of the drum to cause pressure loss, thereby deteriorating an airflow quantity of air for drying. Also, since air for drying in the outlet side of the fan is in a high-pressure state, the quantity of airflow deteriorates by noise or pressure loss in the circulation ventilation path. Accordingly, in order to ensure a sufficient quantity of airflow, a method of increasing the RPM of the fan, or a method of increasing the diameter of the fan can be considered, however, these methods cause a problem in view of noise or energy saving.

As a method of improving the flow of air for drying when a fan is installed in the immediately downstream of the heat exchanger, Patent Document 3 discloses an air guide for improving the flow of air for drying discharged from the outlet of a fan (a drying fan in Patent Document 3). Also, in a clothes dryer of Patent Document 4, a technique of installing a deflecting plate in the downstream side of a heater, and deflecting air for drying entering a drum from a circulation duct downward through the deflecting plate is disclosed.

Also, with regard to improvement of the dryer, a technique related to a method and structure for fixing a control board has been known.

For example, Patent Document 5 discloses a dryer including: a housing having a front plate, a rear plate, a top plate, a bottom plate, and a pair of side plates, formed in the shape of a nearly rectangular parallelepiped, and having a drop opening for putting and taking an object to be dried in the front plate; and a cylindrical drum with a bottom, having an opening corresponding to the drop opening, and installed in the housing, wherein a control circuit unit is disposed at the corner of one of the side plates in space between the drum and the top plate.

In Patent Document 6, a circuit case accommodating a control board is fixed at a housing so that the circuit case is disposed at the corner of one of side plates in space between a drum and a top plate, and a cover member is fixed at the circuit case to cover the control board. Also, wiring between the control board and components outside the circuit case is performed after the cover member is removed.

DISCLOSURE

Technical Problem

However, the dryers configured as described above have problems in various aspects. Accordingly, it is necessary to improve the problems to improve the performance and reliability of the dryers.

As one of the problems, the dryer disclosed in Patent Document 1 has a problem that manufacturing cost increases due to the switching valve and control system thereof.

On the other hand, the dryer disclosed in Patent Document 2 radiates heat through control of the cooling fan, rather than radiating heat through the control of the switching valve, unlike the dryer disclosed in Patent Document 1. Usually, cooling means such as a cooling fan, which is provided separately from the heat pump apparatus and disposed outside the ventilation path, is less expensive than a switching valve. Therefore, by applying a cooling fan instead of a switching valve, manufacturing cost can be reduced.

However, the inventors of the present disclosure found that, when cooling means such as a cooling fan is applied, there are the following problems which are different from the case of applying a switching valve.

That is, in the case of applying the switching valve, it is necessary to connect the auxiliary heat exchanger in parallel to the condenser in order to branch the flow path extending from the compressor. On the other hand, in the case of applying the cooling fan, since the flow path does not need to be branched, the auxiliary heat exchanger is connected in series to the condenser.

However, in the latter case, if the auxiliary heat exchanger is installed in the immediately downstream side of the condenser as in the dryer described in Patent Document 2, the quantity of radiation may be insufficient. That is, in the structure described in Patent Document 2, since heat cannot be radiated directly from relatively high-temperature and high-pressure refrigerant flowing through the flow path extending from the compressor to the inside of the condenser, the overheating and overpressure of the refrigerant are caused when the dryer operates, and more seriously, there is probability that the operation of the compressor will be hindered.

On the other hand, for example, when the auxiliary heat exchanger is provided in the immediately upstream side of the condenser, the problem that the quantity of radiation may be insufficient can be solved because refrigerant of a relatively high temperature and high pressure can be directly cooled, but heat is radiated from the refrigerant before the refrigerant passes through the condenser. Therefore, the quantity of radiation may become excessive according to the flow rate of the cooling fan, so that the amount of heat required for heating air may be dissipated.

In order to solve the problem, a method of making the blowing performance of the cooling fan variable depending on the operating condition of the dryer can be considered. However, such a countermeasure is undesirable in view of manufacturing cost.

Also, the above-described problem concerning the cooling fan is common to heat pump type dryers in which separate cooling means is disposed outside a ventilation path.

In view of the problems of Patent Documents 1 and 2, there is a demand for reducing the manufacturing cost of the heat pump type dryer and maintaining an appropriate quantity of radiation by the auxiliary heat exchanger.

Also, the air guide and the deflecting plate disclosed in Patent Documents 3 and 4 are techniques for improving the flow of air for drying between the fan and the heater, or the flow of air passing through the air inlet of the drum, but they can improve a part of the flow of air for drying introduced into the drum from the fan through the blow duct. Further, since the air guide and the deflecting plate are independent components, component cost and manufacturing cost increase.

In view of the problems related to Patent Documents 3 and 4, there is a demand for suppressing the RPM of the fan while reducing drying time by reducing pressure loss in the air path between the fan and the air inlet of the drum in the dryer, that is, a demand for shortening drying time, reducing noise, and saving energy with low cost.

Also, Patent Document 5 discloses the approximate position of the control circuit unit, but does not describe a method of fixing the control circuit unit and a structure for installing the control circuit unit.

Patent Document 6 discloses a method of fixing the circuit case accommodating the control board at the housing after removing the cover member. However, in this case, since the circuit case is directly fixed at the housing, an external force applied to the housing during transportation is directly transferred to the control board through the circuit case, which may cause breakage of the control board. In addition, since the circuit case is not supported from below, there is probability that the circuit case and the control board inside the circuit case will be damaged by a force applied to the circuit case during wiring or transportation. In addition, the circuit case may escape from the housing due to the force applied to the circuit case during wiring or transportation, and may contact the rotating drum, which may cause breakage of the circuit case and the control board therein.

In view of the problems related to Patent Documents 5 and 6, there is a demand for preventing the circuit case and the control board therein from being damaged, and facilitating assembling from above and maintenance work from above.

The first object of the present disclosure is to improve the performance of a dryer by maintaining an appropriate quantity of radiation by an auxiliary heat exchanger.

The second object of the present disclosure is to improve the performance of a dryer by shortening drying time, reducing noise, and saving energy with low cost.

The third object of the present invention is to improve the reliability of a dryer by preventing a circuit case and a control board therein from being damaged, and facilitating assembling from above and maintenance work.

Technical Solution

In order to accomplish the first object, the inventors of the present disclosure have found a connection structure capable of maintaining an appropriate quantity of radiation by an auxiliary heat exchanger, in a typical heat pump type dryer in which the auxiliary heat exchanger is connected in series to a condenser.

According to a first embodiment of the present disclosure, there is provided a dryer including: a housing; an accommodating portion installed in the housing and configured to accommodate an object to be dried; a circulation ventilation path passing through the accommodating portion; and a heat pump apparatus having a compressor, a condenser, a throttling device, and an evaporator, which are connected to form a flow path through which refrigerant circulates.

The dryer may further include an auxiliary heat exchanger installed outside the ventilation path and connected in series to a flow path in the condenser or in parallel to the condenser, and a cooling apparatus configured to cool the auxiliary heat exchanger.

The term "cooling apparatus" referred to herein may include an apparatus for direct cooling by means of air blowing and water flow, and an apparatus for indirect cooling by means of exchange of air in the housing.

The term "flow path in the condenser" means at least a part of a flow path extending from the upstream end connected to the discharge side of the compressor through the refrigerant pipe to the downstream end connected to the inflow side of the throttling device.

According to the present disclosure, the auxiliary heat exchanger may be connected in series to the flow path in the condenser, or connected in parallel to the condenser, and be cooled by the cooling apparatus installed outside the ventilation path.

In other words, in the case where the auxiliary heat exchanger is connected in series to the flow path in the condenser, refrigerant flowing into the condenser may be supplied to the auxiliary heat exchanger provided outside the ventilation path before passing through the flow path in the condenser and flowing to the throttling device. As a result, heat can be radiated from refrigerant that is exchanging heat with air in the ventilation path in the condenser.

In other words, by radiating heat from the refrigerant that has heated air in the ventilation path, as compared with the configuration in which the auxiliary heat exchanger is connected to the immediately downstream side of the condenser, it is possible to increase an amount of heat that can be radiated from refrigerant flowing through the auxiliary heat exchanger, by an amount of remaining heat that is used to complete heating. Therefore, it is possible to prevent a situation in which refrigerant is overheated and over-pressed due to an insufficient quantity of radiation, when the cooling apparatus operates.

On the other hand, as compared with the configuration in which the auxiliary heat exchanger is connected to the immediately upstream side of the condenser, it is possible to decrease the amount of heat that can be radiated from refrigerant, by the amount of heat used for heating. Therefore, it is possible to prevent a situation in which heat is dissipated more than necessary to hinder heating of air, when the cooling apparatus operates.

The condenser may be configured with a plurality of heat exchangers. For example, the condenser may be configured with a first condenser, and a second condenser formed as a heat exchanger that is separate from the first condenser. In this case, the auxiliary heat exchanger is connected in series between the first condenser and the second condenser. That is, refrigerant passed through the first condenser may pass through the auxiliary heat exchanger provided outside the ventilation path, and then flow into the second condenser.

In the case where the auxiliary heat exchanger is connected in parallel to the condenser, refrigerant passed through the compressor may branch off from the immediately upstream side of the condenser, and one of the branched refrigerant may pass through the condenser, while the other one of the branched refrigerant may pass through the auxiliary heat exchanger. As a result, heat can be dissipated from the other one of the branched refrigerant.

That is, at least one part of refrigerant discharged from the compressor may pass through the auxiliary heat exchanger without flowing through the condenser. Therefore, compared with the configuration in which the auxiliary heat exchanger is connected to the immediately downstream side of the condenser, the amount of heat that can be radiated from refrigerant flowing through the auxiliary heat exchanger can increase by the quantity of refrigerant passing through the auxiliary heat exchanger. Therefore, it is possible to prevent a situation in which refrigerant is overheated and over-pressed due to an insufficient quantity of radiation, when the cooling apparatus operates.

On the other hand, in comparison with the configuration in which the auxiliary heat exchanger is connected to the immediately upstream side of the condenser, the other part of refrigerant discharged from the compressor may pass through the condenser without flowing through the auxiliary heat exchanger. Accordingly, the amount of heat that can be radiated from the refrigerant can decrease by the quantity of the refrigerant not passed through the auxiliary heat exchanger. Therefore, it is possible to prevent a situation in which heat is dissipated more than necessary to hinder heating of air, when the cooling apparatus operates.

In this way, both of the above-described configurations can increase a quantity of radiation rather than the configuration in which a quantity of radiation may be insufficient (the configuration in which the auxiliary heat exchanger is disposed in the immediately downstream side of the condenser), and can decrease a quantity of radiation as compared with the configuration in which a quantity of radiation may become excessive (the configuration in which the heat exchanger is provided in the immediately upstream side of the condenser). Therefore, the dryers according to the above-described two configurations can prevent situations that a quantity of radiation by the auxiliary heat exchanger becomes insufficient or excessive, and as a result, can maintain an appropriate quantity of radiation so as to ensure an amount of heat required for heating air flowing in the ventilation path, while preventing overheating and overpressure of refrigerant.

Furthermore, both of the above-described two configurations do not require a member corresponding to the switching valve of the typical configuration described in Patent Document 1. As a result, manufacturing cost can be reduced since the member and control system thereof are not needed. In addition, since there is no need to make the cooling performance of the cooling apparatus variable, it is possible to further educe manufacturing cost.

The typical configuration described in Patent Document 1 controls a quantity of radiation by natural heat radiation through the auxiliary heat exchanger, by branching the flow path extending from the compressor into two connected to the condenser and the auxiliary heat exchanger, and then adjusting a quantity of refrigerant flowing into the auxiliary heat exchanger using the switching valve provided in the branch portion. However, since both of the above-described two configurations can maintain an appropriate quantity of radiation when the cooling apparatus operates to cool the auxiliary heat exchanger although the switching valve is not provided or the cooling performance of the cooling apparatus does not vary, they can be configured to be simpler and cheaper than the typical configuration, although the cooling performance of the cooling apparatus is variable or a member similar to the switching valve is installed.

Furthermore, both of the above-described two configurations can reduce a path length through which refrigerant flows in one cycle rather than in the typical configuration in which the auxiliary heat exchanger is connected in series to the condenser, thereby reducing load applied to the compressor, and configuring the heat pump apparatus with low cost.

The effect produced by the two configurations is particularly effective in maintaining an appropriate quantity of radiation when the cooling apparatus operates to cool the auxiliary heat exchanger. Also, the two configurations have an advantage in maintaining an appropriate quantity of radiation even when heat is naturally radiated from refrigerant flowing in the auxiliary heat exchanger without operating the cooling apparatus.

A second embodiment of the present disclosure is characterized in that, in the first embodiment, the cooling apparatus includes a cooling fan for causing outside air of the housing to blow toward the auxiliary heat exchanger.

According to the present disclosure, the cooling fan may blow toward the auxiliary heat exchanger to directly cool the auxiliary heat exchanger, specifically, refrigerant flowing in the auxiliary heat exchanger. Through the configuration, a dryer suitable for obtaining the above effect can be implemented.

A third embodiment of the present invention is characterized that, in the first embodiment or the second embodiment, the cooling apparatus includes an exhaust fan located in the housing and configured to exhaust outside air of the ventilation path to the outside of the housing.

According to the present disclosure, the exhaust fan accelerates heat radiation by the auxiliary heat exchanger by discharging air around the auxiliary heat exchanger to the outside of the housing. As a result, the auxiliary heat exchanger, specifically, refrigerant flowing in the auxiliary heat exchanger can be cooled indirectly. Through the configuration, a dryer suitable for obtaining the above effect can be implemented.

In addition, the cooling apparatus may include either the cooling fan or the exhaust fan, or both of them.

A fourth embodiment of the present disclosure is characterized that, in any one of the first to third embodiments of the present disclosure, the compressor is configured to change compression capacity so as to increase or decrease the temperature of refrigerant discharged from the compressor.

According to the present disclosure, when the dryer operates, for example, an operation mode of setting compression capacity to a relatively low level and an operation mode of setting compression capacity to a relatively high level can be used independently. In this case, when the former operation mode is used, the temperature of refrigerant discharged from the compressor may become lower than when the latter operation mode is used, so that the frequency of operation of the cooling apparatus can be reduced correspondingly, and the amount of consumption power required for completing drying process can also be reduced. On the other hand, by setting compression capacity to a relatively high level when an object needs to be quickly dried, drying process can be completed in short time.

A fifth embodiment of the present disclosure is characterized that, in any one of the first to fourth embodiments, a refrigerant temperature sensor capable of detecting the temperature of refrigerant discharged from the compressor is installed in the refrigerant pipe connecting the compressor to the condenser, and the cooling apparatus cools the auxiliary heat exchanger based on the result of detection by the refrigerant temperature sensor.

In a part of the refrigerant flow path extending from the compressor to the inside of the condenser, refrigerant whose temperature and pressure are just raised by the compressor may flow. Therefore, in the part of the refrigerant flow path, refrigerant of a relatively higher temperature and higher pressure may flow than in the other part.

According to the present disclosure, since the auxiliary heat exchanger is cooled on the basis of the temperature of refrigerant flowing through the part, the auxiliary heat exchanger can be cooled at a more appropriate timing in preventing the overheating and overpressure of refrigerant.

Further, since the cooling apparatus operates in accordance with the temperature of refrigerant, the cooling apparatus may stop, for example, when it is determined that refrigerant is at a relatively low temperature and low pressure, and the auxiliary heat exchanger does not need to be cooled, like immediately after drying process starts, thereby reducing the amount of power consumption.

A sixth embodiment of the present disclosure is characterized in that, in any one of the first to fifth embodiments, the auxiliary heat exchanger is connected in series to the flow path in the condenser, and the condenser includes a first flow path whose upstream end is connected to the discharge side of the compressor, and a second flow path whose downstream end is connected to the throttling device, wherein the downstream end of the first flow path is connected to the upstream end of the radiating flow path in the auxiliary heat exchanger, and the upstream end of the second flow path is connected to the downstream end of the radiating flow path.

According to the present disclosure, the flow path formed in the condenser may be divided into the first flow path and the second flow path, and refrigerant flowing into the condenser may flow through the first flow path, the radiating flow path formed in the auxiliary heat exchanger, and the second flow path, sequentially. In this case, the quantity of radiation from the auxiliary heat exchanger can be adjusted by changing a ratio of a flow path length of the first flow path with respect to that of the second flow path.

For example, it is possible to shorten the first flow path and lengthen the second flow path. Thereby, the amount of heat consumed by refrigerant passing through the first flow path can be reduced so as to increase the amount of heat that can be radiated from refrigerant flowing through the radiating flow path.

As described above, since the quantity of radiation from the auxiliary heat exchanger can be increased or decreased without changing the overall configuration of the condenser, it is possible to efficiently maintain an appropriate quantity of radiation. In addition, it is advantageous to achieve commonization of parts, which leads to suppression of manufacturing cost.

A seventh embodiment of the present disclosure is characterized that, in the sixth embodiment, the condenser is configured as a fin-end-tube type heat exchanger having a plurality of straight pipe sections, and a plurality of connecting pipe sections connecting one ends of the straight pipe sections to each other such that the straight pipe sections can communicate with each other.

According to the present disclosure, since the first flow path and the second flow path can be formed in the condenser by changing the shape of a predetermined connecting pipe, or by replacing the connecting pipe with two separate pipes, without changing the shape of each straight pipe portion, it is possible to efficiently change a ratio of a flow path length of the first flow path with respect to that of the second flow path, to achieve commonization of parts, and to reduce manufacturing cost.

An eighth embodiment of the present disclosure is characterized that, in the sixth embodiment or the seventh embodiment, a bypass path for supplying refrigerant discharged from the downstream end of the first flow path to the upstream end of the second flow path by bypassing the radiating flow path, and a flow path selecting device for diverting refrigerant discharged from the downstream end of the first flow path in order for the refrigerant to flow to the radiating flow path or the bypass path are installed.

According to the present disclosure, when radiation by the auxiliary heat exchanger is unnecessary, the flow path selecting device may operate to cause refrigerant entered the condenser to bypass the radiating flow path in the auxiliary heat exchanger, thereby preventing unnecessary radiation by the auxiliary heat exchanger. Thereby, it is possible to effectively ensure the amount of heat required for heating air, and also it is possible to reduce the amount of consumption power required for operating the heat pump apparatus, further, the cooling apparatus, by the amount of heat secured by preventing unnecessary radiation.

A ninth embodiment of the present disclosure is characterized that, in any one of the first to fifth embodiments, the auxiliary heat exchanger includes a flow diverting device connected in parallel to the condenser, and configured to cause the total quantity of refrigerant discharged from the compressor to flow to the condenser, or to cause a predetermined quantity of refrigerant discharged from the compressor to flow to the radiating flow path and the remaining quantity of the refrigerant to flow to the condenser.

According to the present disclosure, when radiation by the auxiliary heat exchanger is unnecessary, the flow diverting device may operate to cause the total quantity of refrigerant discharged from the compressor to flow to the condenser, thereby preventing unnecessary radiation by the auxiliary heat exchanger. Thereby, it is possible to effectively ensure the amount of heat required for heating air, and also it is possible to reduce the amount of consumption power required for operating the heat pump apparatus, further, the cooling mean, by the amount of heat secured by preventing unnecessary radiation.

A tenth embodiment of the present disclosure is characterized that, in the fifth embodiment, a quantity distributing device configured to adjust a quantity flowing to the condenser and a quantity flowing to the auxiliary heat exchanger among refrigerant discharged from the compressor when the auxiliary heat exchanger is connected in parallel to the condenser, and to adjust a bypass quantity bypassing the auxiliary heat exchanger and a quantity flowing to the auxiliary heat exchanger among refrigerant discharged from the compressor when the auxiliary heat exchanger is connected in series to the flow path in the condenser, and a control apparatus configured to control the cooling apparatus and the quantity distributing device based on the result of detection by the refrigerant temperature sensor are provided.

According to the present disclosure, a quantity of radiation by the auxiliary heat exchanger can be controlled by cooling the auxiliary heat exchanger through the cooling apparatus and adjusting a quantity of refrigerant flowing through the auxiliary heat exchanger. As the quantity of refrigerant flowing through the auxiliary heat exchanger increases, radiation by the auxiliary heat exchanger can be facilitated, and as the quantity of refrigerant flowing through the auxiliary heat exchanger decreases, radiation by the auxiliary heat exchanger can be suppressed. Accordingly, it is possible to effectively maintain an appropriate quantity of radiation by the auxiliary heat exchanger.

An eleventh embodiment of the present disclosure is characterized that, in the tenth embodiment, the control apparatus controls the quantity distributing device so that the total quantity of refrigerant discharged from the compressor flows to the condenser or bypasses the auxiliary heat exchanger, when the heat pump apparatus starts.

Generally, when the heat pump apparatus starts, it is necessary to heat air flowing through the ventilation path as quickly as possible.

According to the eleventh embodiment, air flowing through the ventilation path can be heated quickly by the amount of heat secured by preventing radiation by the auxiliary heat exchanger.

A twelfth embodiment of the present disclosure is characterized that, in the tenth embodiment or the eleventh embodiment, the control apparatus determines whether the temperature of refrigerant exceeds a first temperature set to a higher temperature than a predetermined target temperature, based on the result of detection by the refrigerant temperature sensor, and when the control apparatus determines that the temperature of refrigerant exceeds the first temperature, the control apparatus controls the quantity distributing device to decrease the quantity flowing to the condenser or the bypass quantity by a predetermined quantity and to increase a quantity flowing to the auxiliary heat exchanger by the predetermined quantity.

According to the present disclosure, when the temperature of refrigerant exceeds the first temperature, the quantity flowing to the auxiliary heat exchanger among refrigerant discharged from the compressor may increase, which may facilitate radiation by the auxiliary heat exchanger, while preventing the overheating and overpressure of the refrigerant.

A thirteenth embodiment of the present disclosure is characterized that, in the tenth embodiment or the eleventh embodiment, the control apparatus determines whether the temperature of the refrigerant exceeds the first temperature set to the higher temperature than the predetermined target temperature, based on the result of detection by the refrigerant temperature sensor, and when the control apparatus determines that the temperature of refrigerant exceeds the first temperature, the control apparatus controls the quantity distributing device to decrease the quantity flowing to the condenser or the bypass quantity by the predetermined quantity and to increase the quantity flowing to the auxiliary heat exchanger by the predetermined quantity, while controlling the cooling apparatus to cool the auxiliary heat exchanger.

According to the current embodiment, when the temperature of the refrigerant exceeds the first temperature, the control apparatus may perform both control operation of facilitating radiation by the auxiliary heat exchanger, and control operation of cooling the auxiliary heat exchanger, thereby more reliably preventing the overheating and overpressure of the refrigerant.

A fourteenth embodiment of the present disclosure is characterized that, in the twelfth embodiment or the thirteenth embodiment, the control apparatus determines whether the temperature of the refrigerant exceeds a second temperature to a higher temperature than the first temperature, based on the result of detection by the refrigerant temperature sensor, and when the control apparatus determines that the temperature of the refrigerant exceeds the second temperature, the control apparatus controls the quantity distributing device to decrease the quantity flowing to the condenser or the bypass quantity by the predetermined quantity and to increase the quantity flowing to the auxiliary heat exchanger by the predetermined quantity.

According to the current embodiment, by further increasing the quantity of refrigerant flowing to the auxiliary heat exchanger based on the detection result about the higher temperature of the refrigerant, it is possible to more reliably prevent the overheating and overpressure of the refrigerant.

A fifteenth embodiment of the present disclosure is characterized that, in any one of the twelfth to fourteenth embodiments, the control apparatus determines whether the temperature of the refrigerant is lower than a third temperature set to a lower temperature than the target temperature, based on the result of detection by the refrigerant temperature sensor, and when the control apparatus determines that the temperature of the refrigerant is lower than the third temperature, the control apparatus controls the quantity distributing device to decrease the quantity flowing to the auxiliary heat exchanger by the predetermined quantity and to increase the quantity flowing to the condenser or the bypass quantity by the predetermined quantity.

According to the current embodiment, by decreasing the quantity of refrigerant flowing to the auxiliary heat exchanger based on the detection result about a drop in temperature of the refrigerant, it is possible to prevent the overheating and overpressure of the refrigerant.

In this way, the dryer according to any one of the first to fifteenth embodiments can maintain an appropriate quantity of radiation without making the quantity of radiation by the auxiliary heat exchanger excessive or insufficient, while reducing manufacturing cost, by connecting the auxiliary heat exchanger that is cooled by the cooling apparatus installed outside the ventilation path, in series to the flow path in the condenser and in parallel to the condenser. Accordingly, the performance of the dryer can be improved.

Also, in order to accomplish the second object, the inventors of the present disclosure have installed an air guide integrated into the blow duct in a shape corresponding to the edge of the downstream side of the ventilation path, in regard of the blow duct sealed with and connected to the air inlet of the drum, wherein the air guide has a guide portion inclined toward the upstream direction, that is, toward a direction in which the air guide is spaced away from the ventilation path, so that air for drying introduced to the blow duct from the fan flows into the air inlet along the guide portion.

That is, a sixteenth embodiment of the present disclosure provides a circulation type dryer including: an air inlet into which air for drying is introduced; a drum to accommodate clothes; a ventilation path sealed with and connected to the air inlet of the drum at the downstream end; a blow duct through which air for drying passes; a fan sealed with and connected to the upstream end of the blow duct, and configured to discharge air for drying into the blow duct; and a heat exchanger installed in the immediately upstream side of the fan, and configured to perform heat exchange to dry or heat air for drying discharged from the drum, wherein the blow duct has an air guide integrated into the blow duct in a shape corresponding to the edge of the downstream side of the ventilation path, the air guide has a guide portion inclined toward the upstream direction, that is, toward a direction in which the air guide is spaced away from the ventilation path, and air for drying brown from the fan flows into the air inlet along the guide portion.

In the dryer according to the present disclosure, the blow duct may have the air guide integrated into the blow duct in a shape corresponding to the edge of the downstream side of the ventilation path, wherein air for drying brown to the blow duct from the fan flows into the air inlet along the guide portion. Through the configuration, since air for drying brown to the blow duct from the fan flows along the guide portion to enter the air inlet, it is possible to suppress the generation of swirling flow in the blow duct, and to make air for drying efficiently blow into the drum. That is, it is possible to reduce pressure loss in the blowing path from the fan to the air inlet of the drum. Accordingly, as compared to the case in which no air guide is installed, the dryer can reduce the RPM of the fan required to ensure the same quantity of circulation flow. Also, the dryer can reduce noise and save energy for the same drying performance, compared to the case in which no air guide is installed. Also, since the air guide is integrated into the blow duct (for example, the air guide is integrated into the blow duct by resin molding, etc.), the dryer can reduce manufacturing cost, compared to a dryer having a typical air guide.

A seventeenth embodiment of the present disclosure is characterized that, in the sixteenth embodiment, the fan includes a fan casing having an outlet sealed with and connected to the upstream end of the blow duct, the air guide continuously extends from the guide portion to the outlet of the fan casing, and an induction portion for inducing air for drying introduced into the blow duct from the fan to move toward the air inlet is provided.

According to the current embodiment, air for drying blown into the blow duct from the fan may be induced by the induction portion of the air guide to move toward the air inlet, and then induced into the air inlet along the guide portion of the air guide. Accordingly, it is possible to more effectively induce air for drying blown into the blow duct into the air inlet.

An eighteenth embodiment of the present disclosure is characterized that, in the seventeenth embodiment, the end of the induction portion of the air guide toward the fan casing and the end of the outlet of the fan casing are at the same height toward the ventilation path.

According to the current embodiment, the end of the induction portion of the air guide toward the fan casing and the end of the outlet of the fan casing may be at the same height toward the ventilation path, and the air guide may be connected to the fan casing at the same height. Accordingly, at the connection portion, air can flow smoothly, thereby suppressing the generation of noise. Also, leakage of air from the connection portion can be effectively prevented.

A nineteenth embodiment of the present disclosure is characterized that, in the seventeenth embodiment and the eighteenth embodiment, space is formed between the outer wall of the blow duct and the air guide.

According to the current embodiment, space (air layer) may be formed between the outer wall (the outer circumferential surface) of the blow duct and the air guide, thereby preventing noise generated in the blow duct from leaking out of the outer wall of the blow duct. Also, since air for drying does not directly contact the outer wall of the blow duct, heat from the air for drying may not contact outside air through the outer wall so as to obtain the adiabatic effect. Accordingly, as compared to the case in which no air guide is installed, the dryer can reduce noise, and save energy.

A twentieth embodiment of the present disclosure is characterized that, in any one of the seventeenth to nineteenth embodiments, the blow duct has a seal portion for sealing the blow duct, and the seal portion is installed in the outer side than the air guide.

According to the current embodiment, since the seal portion of the blow duct is installed in the outer side than the air guide, the seal portion of the blow duct may not interfere with the flow of air for drying induced into the air inlet of the drum from the fan through the blow duct. Also, through the configuration, since pressure from air for drying is not directly applied to the seal portion, the sealing capability of the seal portion can be improved.

A twenty-first embodiment of the present disclosure is characterized that, in any one of the sixteenth to twentieth embodiments, the guide portion of the air guide is a curved surface in the shape of a circular arc that is concave toward a direction in which the air guide is spaced away from the ventilation path.

According to the current embodiment, by forming the guide portion of the air guide as a curved surface in the shape of a circular arc, air for drying blown to the blow duct from the fan can be more effectively induced to the air inlet of the drum.

As such, in the dryer according to any one of the sixteenth to twenty-first embodiments, by installing the air guide having the guide portion integrated into the blow duct in the shape corresponding to the edge of the downstream side of the ventilation path, it is possible to reduce pressure loss in the blow path from the fan to the air inlet of the drum, thereby suppressing the RPM of the fan, resulting in short drying time, a reduction of noise, and energy saving with low cost. As a result, the performance of the dryer can be improved.

Also, in order to accomplish the third object, the inventors of the present disclosure have used a method of supporting the circuit case from below through a support member fixed at the housing.

More specifically, a twenty-second embodiment of the present disclosure provides a dryer including: a housing having a front plate, a rear plate, a top plate, a bottom plate, and a pair of side plates, formed in the shape of a nearly rectangular parallelepiped, and having a drop opening for putting and taking an object to be dried in the front plate; a cylindrical drum with a bottom, rotatably supported in the housing, and having an opening corresponding to the drop opening; a heating apparatus configured to heat air; a blow apparatus disposed below the drum, and configured to cause air heated by the heating apparatus to blow via the drum; and a control circuit unit configured to control the blow apparatus.

Also, in the twenty-second embodiment, the control circuit unit may include: a support member having an inclined plate portion of a nearly plate shape, located at the corner of one side plate in space between the drum and the top plate, and fixed at the housing in the state in which the inclined plate portion is inclined downward toward the side plate; a circuit case installed over one surface of the inclined plate portion of the support member, the other surface of the inclined plate portion facing the drum; and a control board accommodated in the circuit case.

Accordingly, since the circuit case is supported from below by the support member, the circuit case and the control board therein can be prevented from being damaged, although a force is applied to the circuit case in a direction that is opposite to the support member during assembling such as wiring from above, maintenance work, or transportation. Accordingly, it is possible to facilitate assembling, maintenance work, or transportation. Also, since the support member is interposed between the circuit case and the drum, the circuit case and the control board therein can be prevented from being damaged due to contact to the rotating drum.

Also, since the support member is disposed at the corner of the side plate, the support member can be disposed at the lower position than in the case in which the support member is disposed at the narrow center area between both side plates in space between the drum and the top plate. Accordingly, it is possible to increase the dimension of the control board installed over one surface of the inclined plate portion, the other surface of the inclined plate portion facing the drum, thereby increasing degrees of freedom for the dimension and layout of the control board.

Also, since the inclined plate portion of the support member is inclined downward toward the side plate, the inclined plate portion can be disposed at the lower position around the side plate, than in the case in which the inclined plate portion of the support member is disposed horizontally. Accordingly, it is possible to increase the dimension of the control board installed over one surface of the inclined plate portion, the other surface of the inclined plate portion facing the drum, around the side plate, thereby increasing degrees of freedom for the dimension and layout of the control board.

Also, a twenty-third embodiment of the present disclosure is characterized that, in the twenty-second embodiment, the housing further includes a reinforcing plate installed ahead of the drum in the housing such that the plate surface is positioned in a front-rear direction, and a reinforcing member to bridge the reinforcing plate and the nearly center, end portion of the rear plate of the housing, wherein the support member is fixed at the reinforcing member and one side plate of the housing.

Accordingly, since the support member is supported by the side plate of the housing and the reinforcing member at both sides, the support member can be more reliably prevented from dropping due to vibration, etc., compared to the case in which the support member is supported only at one side. Also, since the support member is supported with high strength at locations where it is fixed at the side plate and the reinforcing member, the support member can be more reliably prevented from being deformed due to vibration, etc. occurring upon transportation or operation, and can support a heavier weight of components, to thereby increase degrees of freedom of control components installed in the housing, compared to the case in which the support member is fixed only at the side plate.

Also, a twenty-fourth embodiment of the present disclosure is characterized that, in the twenty-third embodiment, the support member is fixed at the rear plate of the housing.

Accordingly, since the support member is supported in three directions by the side plate, the rear plate, and the reinforcing member of the housing, the support member can be more reliably prevented from dropping due to vibration, etc. Also, since the support member is supported with high strength at locations where it is fixed at the side plate, the rear plate, and the reinforcing member, the support member can be more reliably prevented from being deformed due to vibration, etc. occurring upon transportation or operation, and can support a heavier weight of components, to thereby increase degrees of freedom of control components installed in the housing.

Also, a twenty-fifth embodiment of the present disclosure is characterized that, in any one of the twenty-second to twenty-fourth embodiments, the circuit case has a case body formed in the shape of a shallow dish by a plate-shaped low wall portion and a circumferential wall portion protruding from the edges of the low wall portion, and is installed on the inclined plate portion of the support member, wherein the opened side of the case body is positioned in a direction that is opposite to the inclined plate portion, and the control circuit unit further includes a cover member to cover the control board in the direction that is opposite to the inclined plate portion.

Accordingly, even when water enters the housing through a gap between the side plate and the top plate, the cover member may block the water from entering the control board, thereby preventing corrosion of the control board or shorts of the circuit. Also, the cover member may block lint from an object to be dried, such as clothes or sheets, from being attached on the control board, thereby preventing a failure of the control board due to lint attached on the control board.

Also, a twenty-sixth embodiment of the present disclosure is characterized that, in the twenty-fifth embodiment, the cover member is fixed at at least one of the support member and the circuit case.

Accordingly, since the cover member is fixed at at least one of the support member and the circuit case, the cover member can be prevented from being separated due to vibration, etc.

If the cover member is fixed only with the support member, no fixing portion for the cover member may need to be installed in the circuit case, which increases space for the control board in the circuit case.

If the cover member is fixed at the circuit case, work of installing the circuit case and the support member can be performed in the state in which the cover member is fixed at the circuit case, that is, in the state in which the control board is protected by the cover member, thereby preventing breakage of the control board due to contacts or collision with tools, etc. or a failure of the control board due to foreign materials such as screws, during the installation work.

If the cover member is fixed at both the circuit case and the support member, the cover member can be more reliably prevented from being separated due to vibration, etc., compared to the case in which the cover member is fixed at any one of the circuit case and the support member.

Also, a twenty-seventh embodiment of the present disclosure is characterized that, in the twenty-fifth embodiment or the twenty-sixth embodiment, an opening is formed in the cover member.

Accordingly, since heat from the control board can be radiated through the opening of the cover member, the temperature of the control board can be prevented from rising excessively.

Also, a twenty-eighth embodiment of the present disclosure is characterized that, in the twenty-seventh embodiment, protrusions protrude inward from the upper end portion of the side plate, concave grooves that are concave in a direction that is opposite to the protruding direction of the circumferential wall portion are formed in the circumferential wall portion of the circuit case in such a way to be inclined downward toward the side wall, the cover member has a front side wall portion and a rear side wall portion to cover the control board from the front side and from the rear side, and plate-shape coupling pieces protruding downward from the lower ends of the front side wall portion and the rear side wall portion and coupled with the concave groove of the circuit case, the end of the cover member toward the side wall portion is located in space below the protrusions of the side wall, and the opening of the cover member opens to the side wall so as to allow the control board to pass through the opening when the cover member slides along the concave grooves to enter the space below the protrusions in the state in which the coupling pieces are coupled with the concave grooves of the circuit case.

Accordingly, by guiding the cover member to be spaced from the side wall in the state in which the coupling pieces of the cover member are coupled with the concave grooves of the circuit case, to thus take the cover member out of the space below the protrusions, the cover member can be removed from the circuit case. Meanwhile, when the cover member is installed, by installing the circuit case accommodating the circuit board on the support member, coupling the coupling pieces of the cover member with the concave grooves of the circuit case, and then making the cover member slide toward the side wall, the cover member can be inserted into the space below the protrusions.

In this way, since the cover member is disposed in the space below the protrusions of the side plate, it is possible to increase the size of the control board covered by the cover member, resulting in high degrees of freedom of the dimension and layout of the control board.

Also, a twenty-ninth embodiment of the present disclosure is characterized that, in the twenty-eighth embodiment, in the end edge of one side plate side of the front side wall portion and the rear side wall portion of the cover member, a coupling concave portion that is concave toward the other side plate side is formed, and a coupling portion protrudes in the front-rear direction from the circumferential wall portion of the circuit case such that the coupling portion is coupled with the coupling concave portion to limit movement of the cover member toward a direction that is opposite to the support member and toward the side plate.

Accordingly, the coupling portion of the circuit case can limit movement of the cover member toward the direction that is opposite to the support member and toward the side wall, without having to perform work of coupling the cover member with the circuit case in the space below the protrusions, which facilitates work of fixing the cover member at the circuit case. Also, a coupling member such as a screw may be not needed, thereby reducing the number of components.

Also, a thirtieth embodiment of the present disclosure is characterized that, in any one of the twenty-fifth to twenty-ninth embodiments, a control component connected to the control board through a wire is further accommodated in the circuit case, and the control component is covered by the cover member in a direction that is opposite to the inclined plate portion.

Accordingly, it is unnecessary to take the wire connecting the control component to the control board out of the circuit case, which facilitates wiring. Accordingly, even when water enters the housing through a gap between the side plate and the top plate, the cover member may block the water from entering the control components, thereby preventing a failure of the control components due to water or lint.

As such, in the dryer according to any one of the twenty-second to thirtieth embodiments, since the circuit case is installed at the support member fixed on the housing, it is possible to prevent the circuit case and the control board therein from being broken, and since the circuit case is supported by the support member from below, assembling such as wiring from above and maintenance work can be easily performed. Accordingly, the reliability of the dryer can be improved. Also, it is possible to increase the dimension of the control board, thereby increasing degrees of freedom for the dimension and layout of the control board. Accordingly, the productivity of the dryer can be improved.

Advantageous Effects

As described above, the dryer can improve performance and reliability in view of maintaining an appropriate quantity of radiation by the auxiliary heat exchanger, shortening drying time, reducing noise, saving energy with low cost, and preventing the circuit case and the control substrate therein from being broken.

BEST MODE

Figure 1A:
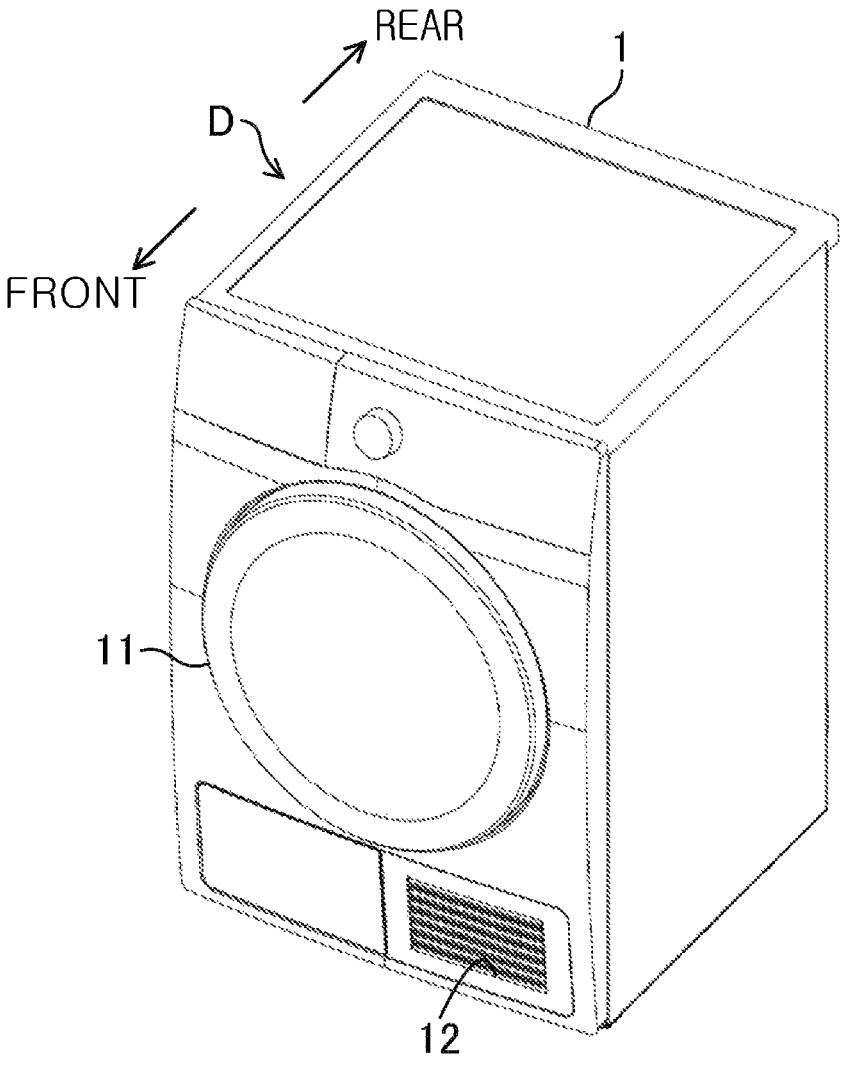
FIG. 1A is a perspective view of a heat pump type dryer according to aspect A of embodiment 1, as seen from front and right.

Hereinafter, embodiments 1 to 3 of the present disclosure will be described in detail with reference to the accompanying drawings. However, the embodiments are only exemplary, not intended for limiting the present disclosure, applications thereof, and purposes of use thereof.

For convenience of description, the individual embodiments are assigned independent reference numerals. Accordingly, different reference numerals may be assigned to the same concept in different embodiments, or the same reference numeral may be assigned to different concepts.

Embodiment 1

First, embodiment 1 will be described with reference to the drawings. The embodiment 1 relates to a configuration described in claims 1 to 20, and is shown in FIGS. 1 to 9B and FIGS. 38 and 39.

[Aspect A of Embodiment 1]

Hereinafter, a dryer according to aspect A of embodiment 1 will be described.

A dryer (heat pump type dryer) according to the current embodiment may be a clothes dryer D shown in FIG. 1A. The clothes dryer D may include a housing 1 having the outer appearance of a nearly rectangular parallelepiped shape and extending vertically. In the nearly center portion of the front side of the housing 1, a clothes drop opening (not shown) may be formed in the shape of a nearly circle as seen from front. The clothes drop opening may be opened or closed by a cover 11 that rotates. When the cover 11 opens, clothes as an object to be dried may enter accommodation space 21 formed in the housing 1 through the clothes drop opening.

First, the whole configuration of the clothes dryer D according to the aspect A of the embodiment 1 will be described.

Also, in the lower and right area of the front plate of the housing 1, an air inlet 12 may open to exchange inside air of the housing 1 with outside air. Meanwhile, in the upper and left area of the rear plate of the housing 1 (the upper and left area of the housing 1 as seen from rear), an exhaust outlet 13 may open to exchange inside air of the housing 1 with outside air, independently from the air inlet 12.

Figure 1B:
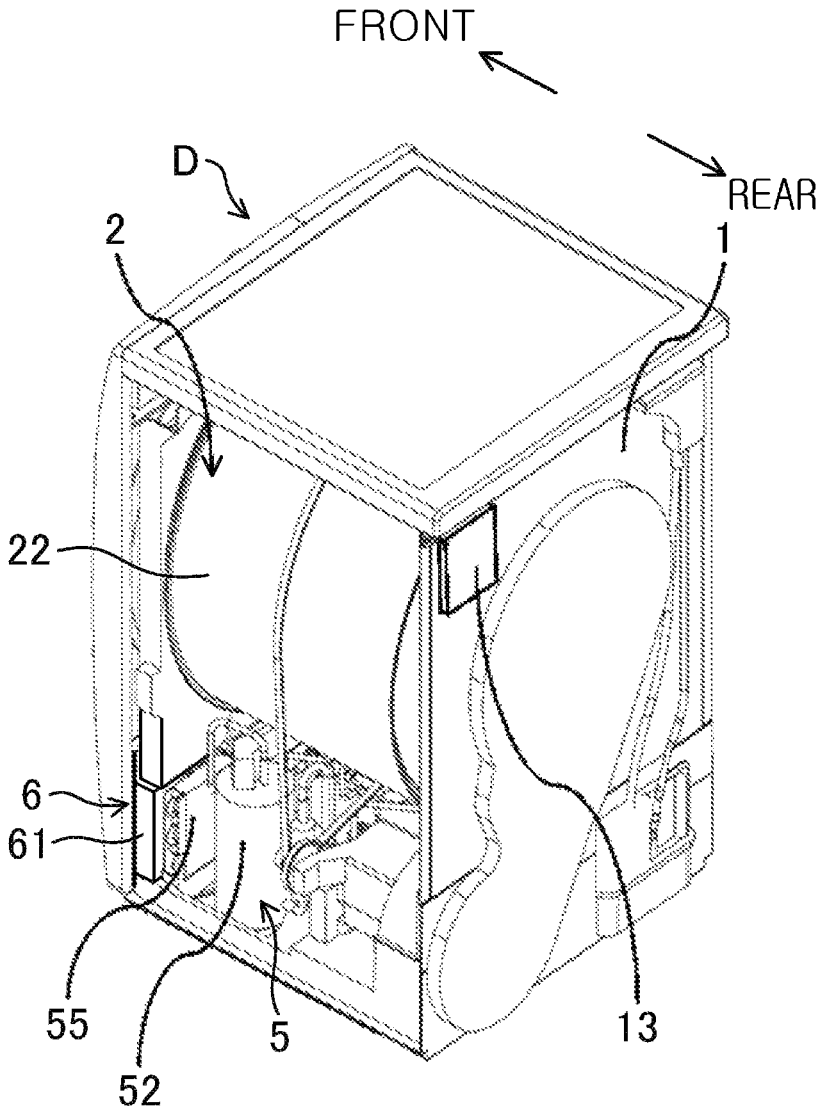
FIG. 1B is a perspective view of the heat pump type dryer shown in FIG. 1A, as seen from rear and right, when the right side of the housing opens.

FIG. 1B shows a state in which the right plate of the housing 1 opens. As shown in FIG. 1B, a drum 2 forming the accommodation space 21 may be disposed in the upper space of the housing 1. The drum 2 may have a drum accommodating portion 22 and a drum body (not shown), and constitute an accommodation portion according to the aspect A of the embodiment 1. Also, in the lower space of the housing 1, a cooling fan 61, an auxiliary heat exchanger 55, and a compressor 52 may be arranged in this order from the front plate.

More specifically, the drum accommodating portion 22 may be formed in the shape of a nearly cylinder extending in the front-rear direction, and connected to the clothes drop opening. The drum body may be formed in the shape of a cylinder with a bottom, and may be integrated into the drum accommodating portion 22 in the state in which the opening of the drum body is aligned toward the clothes drop opening. The drum accommodating portion 22 and the drum body may form the accommodation space 21 inside the drum portion 2.

Figure 3:
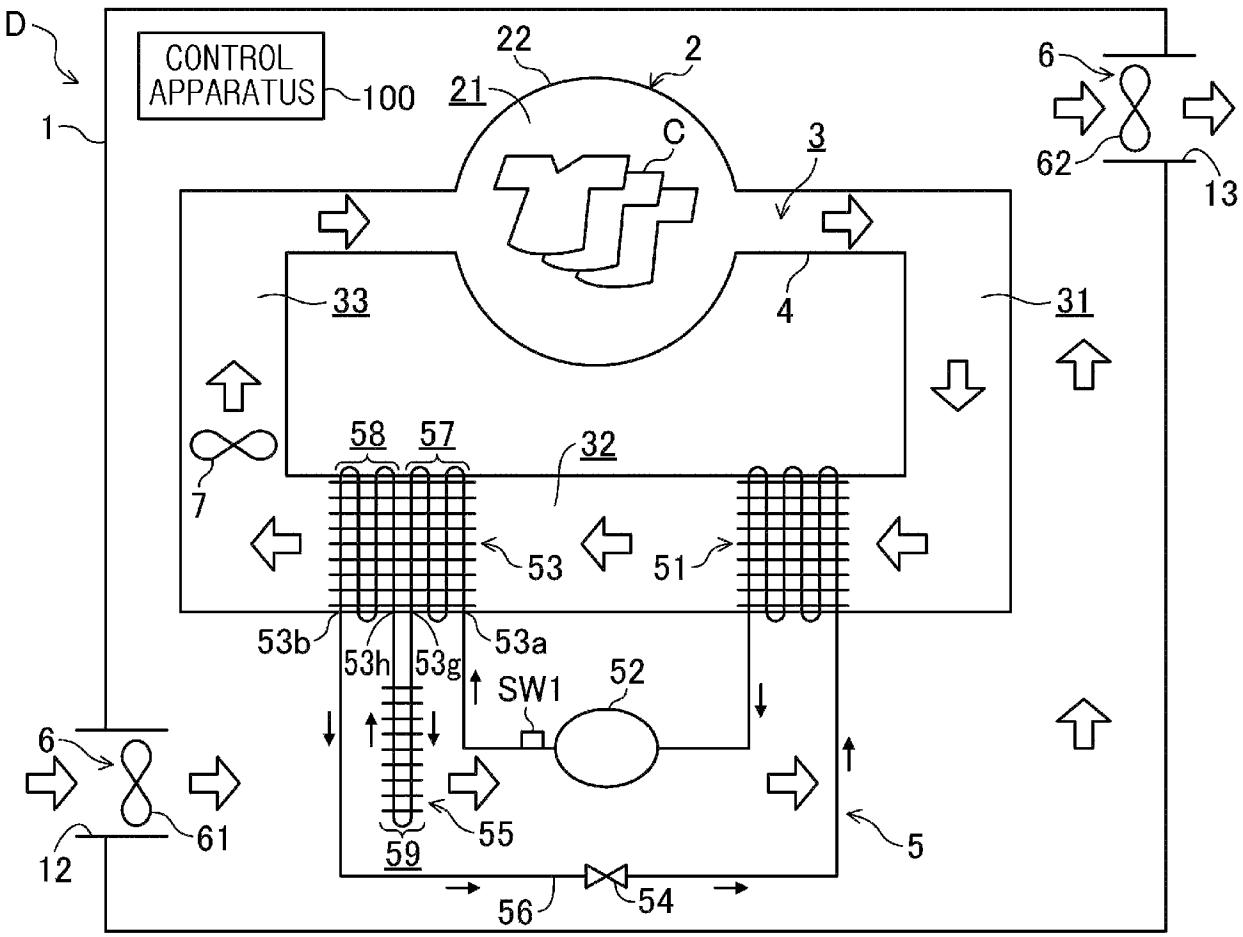
FIG. 3 is a schematic view showing a ventilation path and a heat pump apparatus in the heat pump type dryer according to the aspect A.

As shown in FIG. 3, a ventilation pipe 4 may be disposed inside the housing 1. Both ends of the ventilation pipe 4 may connect space in the ventilation pipe 4 to the accommodation space 21. Accordingly, a ventilation path 3 formed by the ventilation pipe 4 may be implemented as a circulating flow path passing through the accommodation space 21.

The ventilation path 3 may include a homeward ventilation path 31 having one end connected to the accommodation space 21 and extending vertically in the space in the housing 1, an outward ventilation path 33 having one end connected to the accommodation space 21 and extending vertically in the space in the housing 1, separately from the homeward ventilation path 31, and a ventilation path 32 for heating and drying, connecting the other end of the homeward ventilation path 31 to the other end of the outward ventilation path 33 and extending horizontally in the lower space of the housing 1.

As shown in FIG. 3, in the ventilation path 3, a circulating fan 7 may be disposed to circulate inside air of the ventilation path 3. The circulating fan 7 may be disposed around a connection portion of the outward ventilation path 33 and the ventilation path 32 for heating and drying. The circulating fan 7 may inhale air of the ventilation path 32 for heating and drying, and discharge the inhaled air to the outward ventilation path 33. Accordingly, if the circulating fan 7 operates, air discharged from the ventilation path 32 for heating and drying may pass through the outward ventilation path 33, the accommodation space 21, and the homeward ventilation path 32, sequentially, and then return to the ventilation path 32 for heating and drying (see white arrows in the ventilation path 3 of FIG. 3).

As shown in FIG. 3, in the ventilation path 32 for heating and drying, an evaporator 51 for exchanging heat with air passing through the ventilation path 32, and a condenser 53 for exchanging heat with air passed through the evaporator 51 may be disposed in such a way to be spaced apart from each other from the upstream side (upstream with respect to the direction of air flow in the ventilation path 3) of the ventilation path 32 for heating and drying to the downstream side (downstream with respect to the direction of air flow in the ventilation path 3).

Figure 2:
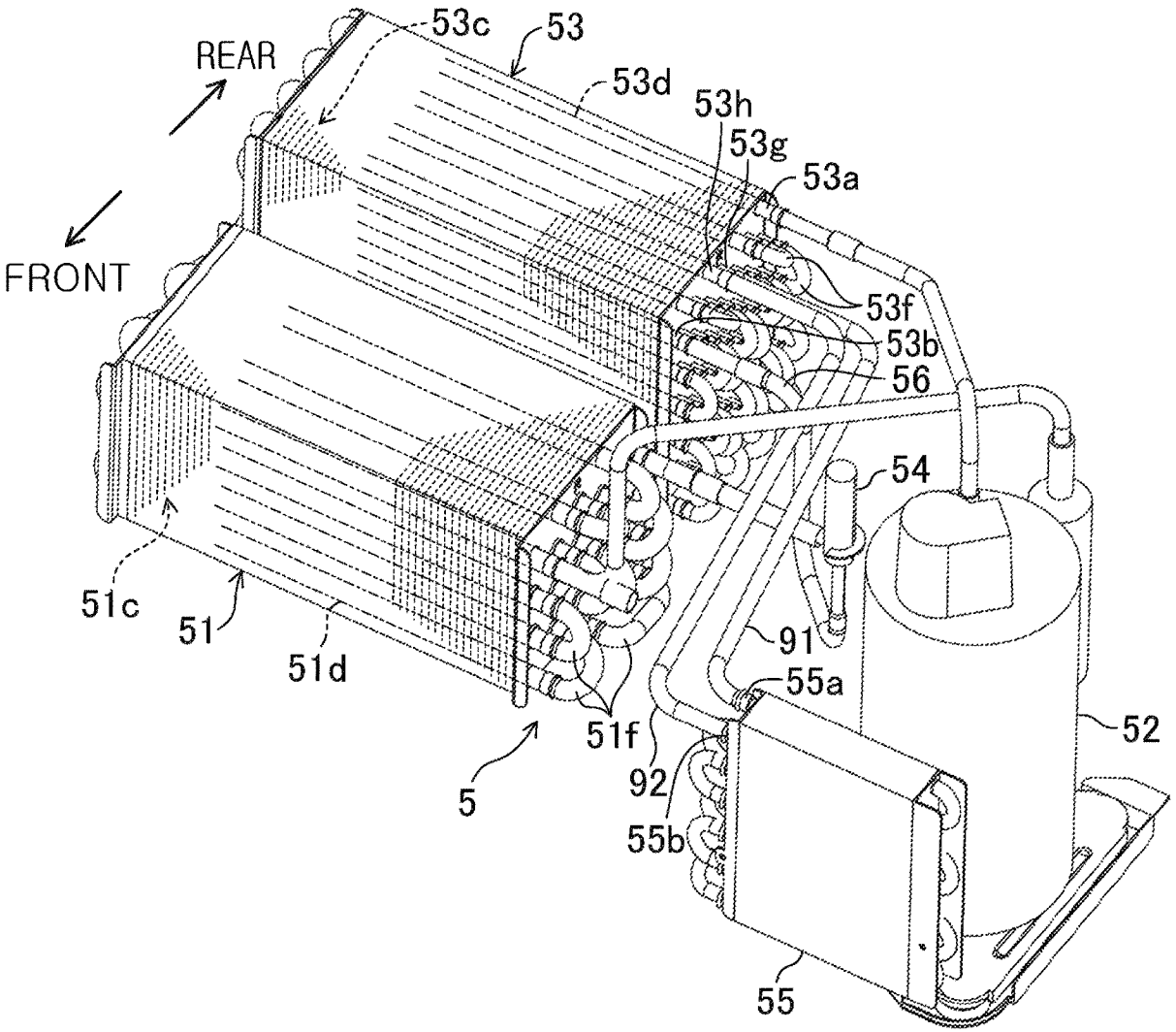
FIG. 2 is a perspective view of a heat pump apparatus that is applied to the heat pump type dryer according to the aspect A, as seen from front and right.

As shown in FIGS. 2 and 3, the compressor 52, the evaporator 51, a throttling device 54, and the condenser 53 may be connected sequentially by a refrigerant pipe 56 to form a flow path through which refrigerant circulates, thereby constituting a heat pump apparatus 5 according to the current embodiment.

Also, in FIG. 2, the front and rear directions means the front and rear directions after the heat pump apparatus 5 is installed in the housing 1, and may be the same as the front and rear directions with respect to the clothes dryer D and the housing 1.

More specifically, the compressor 52 may be disposed outside the ventilation path 3, and disposed behind the air inlet 12 in the lower space of the housing 1. The compressor 52 may adiabatically compress gas refrigerant inhaled through an inlet (not shown) of the upstream side to raise the temperature and pressure of the gas refrigerant, and then discharge the gas refrigerant from an outlet (not shown) of the downstream side. The compressor 52 according to the current embodiment may include an inverter circuit capable of controlling the driving frequency, and can increase or decrease (change) compression capacity based on an input signal from a control apparatus 100 as control means of the current embodiment. For example, by decreasing the compression capacity of the compressor 52, the compressor 52 can discharge refrigerant of a relatively low temperature and low pressure, compared to the case in which the compression capacity of the compressor 52 is not decreased.

Also, the throttling device 54 may be disposed outside the ventilation path 3, like the compressor 52, and installed in the lower space of the housing 1. The throttling device 54 may adiabatically expand liquid refrigerant entered from an inlet (not shown) of the upstream side to lower the temperature and pressure of the refrigerant, and then discharge the resultant refrigerant from an outlet (not shown) of the downstream side.

The evaporator 51 may be configured as a fin-end-tube type heat exchanger. That is, the evaporator 51 may have a plurality of fins 51*a* as heat sinks represented by broken lines in FIG. 2, a plurality of tubes (straight pipe sections) 51*d* formed in the shape of straight pipes and represented by two point chain lines in FIG. 2, and a plurality of connecting pipe sections 52*f*, and the evaporator 51 may have an outer appearance in the shape of a nearly rectangular parallelepiped box. The individual tubes 51*d* may extend nearly in parallel to each other, in a left-right direction, to penetrate the individual pins 51*c*. Each connecting pipe section 51*f* may be formed as a nearly U-shaped, curved pipe, and connect one ends of two tubes 51 to each other. By the connections of the connecting pipe sections 51*f*, the inside space of the tubes 51*d* can communicate with each other so as to form a flow path extending back and forth along the longitudinal direction of the evaporator 51 in the evaporator 51.

As shown in FIG. 3, both ends of the flow path formed in the evaporator 51 may be connected to the outlet of the throttling device 54 and the inlet of the compressor 52, through the flow path formed in the refrigerant pipe 56. Accordingly, refrigerant discharged from the throttling device 54 may pass through the flow path in the evaporator 51, and then be inhaled into the compressor 52.

The condenser 53 may be configured as a fin-end-tube type heat exchanger, like the evaporator 51, and include a plurality of fins 53*c*, a plurality of tubes 53*d* formed in the shape of straight pipes, and a plurality of connecting pipe sections 53*f* connecting one ends of the individual tubes 53*d* to each other so that inside space of the tubes 51*d* can communicate with each other, and the condenser 53 may have an outer appearance in the shape of a nearly rectangular parallelepiped box. However, unlike the evaporator 51, the condenser 53 may form two independent flow paths of a first flow path 57 and a second flow path 58 therein, instead of a single flow path.

More specifically, two tubes 53*d* connected to a predetermined one of the plurality of connecting pipe sections 53*f* may be respectively connected to an outward extended pipe section 91 and a homeward extended pipe section 92 respectively formed in the shape of straight pipes, instead of the corresponding connecting pipe section 53*f*. By the connections, in the condenser 53, the first flow path 57 extending from one end (upstream end) 53*a* of the tube 53*d* connected to the outlet of the compressor 52 through the refrigerant pipe 56 to one end (first intermediate end) 53*g* of the tube 53*d* connected to the outward extended pipe section 91, and the second flow path 58, separately from the first flow path 57, extending from one end (a second intermediate end) 53*h* of the tube 53*d* connected to the homeward extended pipe section 92 to one end (downstream end) 53*b* of the tube 53*d* connected to the inlet opening (inlet side) of the throttling device 54 through the refrigerant pipe 56 may be formed, as shown in FIGS. 2 and 3.

As shown in FIGS. 2 and 3, the first intermediate end 53*g* of the first flow path 57 may be connected to the upstream side of the auxiliary heat exchanger 55 installed outside the ventilation path 3, through the outward extended pipe section 91, while the second intermediate end 53*h* of the second flow path 58 may be connected to the downstream end of the auxiliary heat exchanger 55 through the homeward extended pipe section 92, separately from the first intermediate end 53*g* of the first flow path 57.

More specifically, the auxiliary heat exchanger 55 may be formed in the shape of a thin rectangular parallelepiped box extending along the front plate of the housing 1, and in the lower space of the housing 1, the auxiliary heat exchanger 55 may be disposed behind the air inlet 12 and in front of the compressor 52. The auxiliary heat exchanger 55 may be configured as a fin-end-tube type heat exchanger, like the evaporator 51 and the condenser 53, and in the auxiliary heat exchanger 55, a single radiating flow path 59 may be formed, as shown in FIG. 3. The upstream end 55*a* and the downstream end 55*b* of the radiating flow path 59 may be connected to the first intermediate end 53*g* and the second intermediate end 53*h*, through the outward extended pipe section 91 and the homeward extended pipe section 92, as shown in FIG. 2. Accordingly, the auxiliary heat exchanger 55 may be connected in series to the flow path in the condenser 53. That is, refrigerant discharged from the compressor 52 and entered the condenser 53 may pass through the first flow path 57 in the condenser 53, the flow path in the outward extended pipe section 91, the radiating flow path 59 in the auxiliary heat exchanger 55, the flow path in the homeward extended pipe section 92, and the second flow path 58 in the condenser 53, sequentially, and then be discharged from the condenser 53 to flow into the throttling device 54.

Accordingly, when the heat pump apparatus 5 operates, as shown in FIG. 3, gas refrigerant discharged after the temperature and pressure of the gas refrigerant are raised by the compressor 52 may pass through the condenser 53 to be condensed. The refrigerant entered the condenser 53 may pass through the first flow path 57 to be discharged outside the ventilation path 3, and then pass through the radiating flow path 59 in the auxiliary heat exchanger 55. The refrigerant passed through the radiating flow path 59 may again return to the ventilation path 3, and pass through the second flow path 58 in the condenser 53 to thereby be discharged outside the condenser 53. Successively, the temperature and pressure of the refrigerant changed to a liquid state by passing through the condenser 53 may be lowered by the throttling device 54, and then pass through the evaporator 51 to be evaporated. Then, the refrigerant changed to a gas state by passing through the evaporator 51 may return to the compressor 52 (see black arrows of FIG. 3).

The refrigerant circulating in this way may cool air with evaporation heat generated when passing through the evaporator 51 to thus remove moisture, and simultaneously heat air with condensation heat generated when passing through the condenser 53. Also, the refrigerant entered the condenser 53 may radiate heat by exchanging heat with air outside the ventilation path 3 when passing through the auxiliary heat exchanger 55, and be cooled.

Also, as shown in FIG. 3, in the refrigerant pipe 56 connecting the compressor 52 with the condenser 53, a refrigerant temperature sensor SW1 for detecting the temperature of refrigerant passing through the immediately downstream side of the compressor 52 may be installed in the immediately downstream side of the compressor 52.

Also, a drain hole (not shown) to penetrate the lower portion of the evaporator 51 and to connect the ventilation path 32 for heating and drying to space outside the ventilation pipe 4 may be formed in the lower portion of the ventilation pipe 4, and by the drain hole, condensed water generated when the evaporator 51 removes moisture from air flowing through the ventilation path 32 for heating and drying may be discharged to the outside of the ventilation path 3.

Also, in the lower area of the ventilation pipe 4, an accommodating dish portion (not shown) opening upward may be disposed. The accommodating dish portion may accommodate condensed water discharged through the drain hole.

A cooling apparatus 6 according to the current embodiment may include the cooling fan 61 and an exhaust fan 62, and be configured to cool the auxiliary heat exchanger 55. The cooling apparatus 6 may cool the auxiliary heat exchanger 55 to thereby radiate heat from refrigerant flowing through the radiating flow path 59 in the auxiliary heat exchanger 55.

The cooling fan 61 may be disposed between the air inlet 12 and the auxiliary heat exchanger 55, in the lower space of the housing 1, as shown in FIG. 3. The cooling fan 61 may be configured to cause outside air introduced through the air inlet 12 to blow backward, and be on/off controlled based on an input signal from the control apparatus 100 (see FIG. 7). As described above, since the cooling fan 61, the auxiliary heat exchanger 55, and the compressor 52 are arranged in this order from front (see FIG. 1B), blowing by the cooling fan 61 may directly cool the auxiliary heat exchanger 55 and the compressor 52 sequentially.

Also, the exhaust fan 62 may be disposed immediately in front of the exhaust outlet 13, in the upper space of the housing 1, as shown in FIG. 3. The exhaust fan 62 may be configured to discharge outside air of the ventilation path 3 to the outside of the housing 1, and may be on/off controlled based on an input signal from the control apparatus 100, like the cooling fan 61 (see FIG. 7). As described above, since refrigerant flowing through the auxiliary heat exchanger 55 is configured to radiate heat from outside air of the ventilation path 3 in the housing 1, the heat pump apparatus 5 may operate to raise the temperature of air around the auxiliary heat exchanger 55 by an amount of the radiated heat. Also, in accordance with operation of the compressor 52, the temperature of air around the compressor 52 may also be raised. Accordingly, while the heat pump apparatus 5 continues to operate, the temperature of air around the auxiliary heat exchanger 55 and the compressor 52 may become relatively higher than that of other air outside the ventilation path 3. The exhaust fan 62 may operate so that air of a relatively high temperature around the auxiliary heat exchanger 55 and the compressor 52 is discharged, thereby facilitating heat radiation from the auxiliary heat exchanger 55 and the compressor 52. That is, exhaust by the exhaust fan 62 may cool the auxiliary heat exchanger 55 and the compressor 52 indirectly.

The clothes dryer D configured as described above may be controlled by the control apparatus 100. The control apparatus 100 may be configured with a microcomputer, and perform control operation of performing processing such as drying of clothes C entered the accommodating space 21, through a plurality of predetermined operations.

Figure 7:
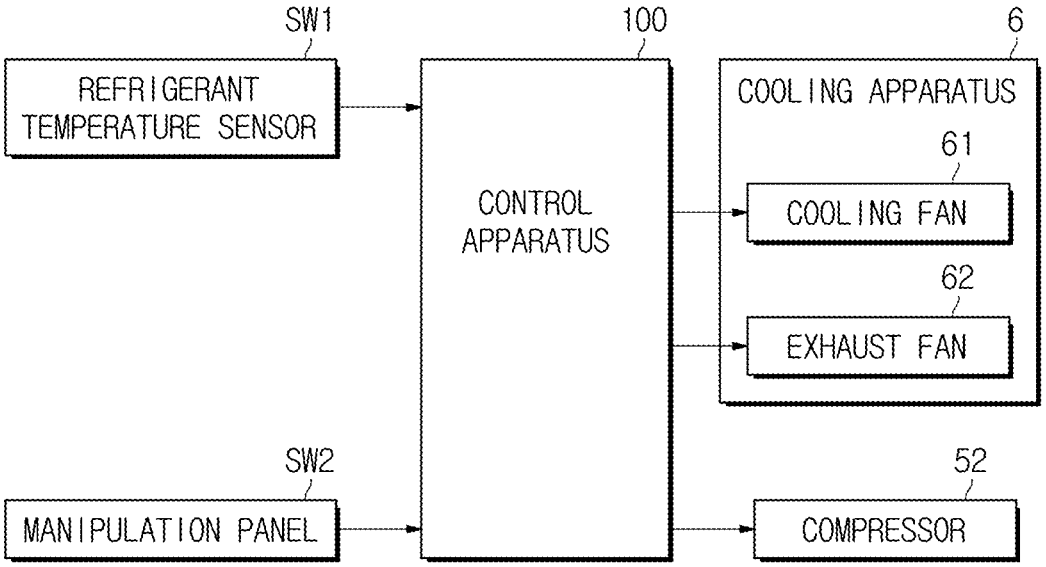
FIG. 7 is a block diagram showing the configuration of a control apparatus in the heat pump type dryer according to the aspect A.

As shown in FIG. 7, various signals may be input to the control apparatus 100. The signals may include detection signals from the refrigerant temperature sensor SW1 and input signals according to a user's manipulation.

The control apparatus 100 may perform various operations based on the detection signal from the refrigerant temperature sensor SW1 to thus detect the temperature of refrigerant just after the compressor 52 raises the temperature and pressure of the refrigerant. Then, the control apparatus 100 may operate the cooling apparatus 6 based on the detected temperature of the refrigerant to cool the auxiliary heat exchanger 55.

Also, the control apparatus 100 may set a control method of the compressor 52 to any one of two methods, based on a user's manipulation (see FIG. 7). More specifically, the control apparatus 100 may switch between an energy saving driving method of setting the compression capacity of the compressor 52 to a relatively low level, and a speed driving method of setting the compression capacity of the compressor 52 to a relatively low level, based on the result of an input by a user manipulating the manipulation panel SW2.

If the energy saving driving method is set, the compression capability of the compressor 52 may be set to a lower level than in the speed driving method. Accordingly, the temperature and pressure of refrigerant discharged from the compressor 52 may become lowered by the lowered amount of compression capacity, thereby reducing consumption power required to completely dry clothes.

Meanwhile, if the speed driving method is set, the compression capability of the compressor 52 may be set to a higher level than in the energy saving driving method. Accordingly, the temperature and pressure of refrigerant discharged from the compressor 52 may become raised by the raised amount of compression capacity, thereby reducing consumption power required to completely dry clothes.

Now, details about operations of the heat pump apparatus 5 and the cooling apparatus 5, and a quantity of radiation from refrigerant flowing through the heat exchanger 55, when the clothes dryer D configured as described above operates, will be described.

If the clothes dryer D according to the current embodiment starts operating, the circulating fan 7 and the heat pump apparatus 5 may operate.

If the circulating fan 7 operates, the immediately upstream side of the circulating fan 7 in the ventilation path 3 may become negative pressure, and the immediately downstream side of the circulating fan 7 may become positive pressure. According to the difference in pressure, air in the accommodating space 21 may circulate in the ventilation path 3.

Also, when the heat pump apparatus 5 operates, refrigerant of a relatively low temperature may flow through the flow path in the evaporator 51, and refrigerant of a relatively high temperature may flow through the flow path in the condenser 53, based on a control method set for the compressor 52.

Accordingly, air in the accommodation space 21 may be cooled and dehumidified by the evaporator 51 when passing through the ventilation path 32 for heating and drying, and then heated by the condenser 53.

Also, while the heat pump apparatus 5 operates, refrigerant entered the condenser 53 may pass through the first flow path 57 in the condenser 53, as described above, to thereby heat air passing through the ventilation path 32 for heating and drying. Then, the refrigerant passed through the first flow path 57 may pass through the auxiliary heat exchanger 55 outside the ventilation path 3 to thereby radiate heat from air outside the ventilation path 3. Then, the refrigerant passed through the auxiliary heat exchanger 55 may again return to the ventilation pipe 3 to pass through the second flow path 58 in the condenser 53, thereby again heating air in the ventilation path 32 for heating and drying.

By repeatedly performing the above-described process, air circulating in the ventilation path 3 and entered the accommodation space 21 may be maintained at a relatively high temperature and low humidity. Clothes C in the accommodation space 21 may repeatedly contact the air so that moisture contained in the clothes C is evaporated, thereby drying the clothes C. The moisture evaporated from the clothes C may be condensed by the evaporator 51 to be dehumidified.

The moisture evaporated by the evaporator 51 may stand as condensed water on the surface of the evaporator 51. The condensed water may be discharged to the outside of the ventilation path 3 through the drain hole to be accommodated on the accommodating dish portion.

While the heat pump apparatus 5 continues to operate, the temperature of the compressor 52 or the temperature of air in the housing 1 may rise continuously. In accordance with the rise in temperature, the temperature and pressure of refrigerant flowing through the condenser 53 and the evaporator 51 may also rise. If the refrigerant is overheated or over-pressed in this way, a problem in operation of the compressor 52 may be caused.

Accordingly, if the control apparatus 100 according to the current embodiment determines that the temperature of refrigerant just discharged from the compressor 52 is higher than a predetermined temperature (a cooling start temperature), based on the result of detection by the refrigerant temperature sensor SW1, the control apparatus 100 may operate the cooling apparatus 6 (that is, the cooling fan 61 and the exhaust fan 62) to cool the auxiliary heat exchanger 55 so that the refrigerant is not overheated and over-pressed. By cooling the auxiliary heat exchanger 55, heat radiation of refrigerant flowing through the radiation flow path 59 in the auxiliary heat exchanger 55 may be facilitated to prevent overheating and over-pressure of the refrigerant. The cooling apparatus 6 may cool the auxiliary heat exchanger 55 until the temperature of the refrigerant is lower than or equal to a predetermined temperature (a cooling stop temperature). Also, according to the current embodiment, the cooling start temperature may be set to a temperate that does not interfere with operation of the compressor 52 and that is lower than or equal to a refrigerant temperature that can compress the refrigerant. Also, the cooling stop temperature may be set to a temperature that is lower than or equal to the cooling start temperature.

Hereinafter, in regard of the quantity of radiation by the auxiliary heat exchanger according to the aspect A of the embodiment 1, the embodiment 1 will be compared to a typical configuration (also, referred to as a first typical configuration) in which an auxiliary heat exchanger is connected in series to the immediately upstream side of a condenser. In the first typical configuration, since heat is radiated from refrigerant that does not yet enter the condenser, heat is dissipated more than necessary, depending on the configuration or operation state of the cooling apparatus 6, which hinders heating of air flowing in a ventilation path. Meanwhile, in the configuration according to the aspect A of the embodiment 1, since the cooling apparatus 6 radiates heat from refrigerant passed through the first flow path 57 in the condenser 53, an amount of heat that can be radiated from refrigerant passing through the radiating flow path 59 may be reduced by an amount of heat that is consumed due to heat exchange when the refrigerant passes through the first flow path 57, compared to the first typical configuration. In other words, an amount of heat consumed by refrigerant passing through the first flow path 57, that is, an amount of heat used to heat air flowing through the ventilation path 3 can be maintained constant, regardless of the configuration or operation state of the cooling apparatus 6. Accordingly, since air flowing through the ventilation path 3 can be sufficiently heated compared to the first typical configuration, although the cooling apparatus 6 operates, a situation of hindering heating of air can be prevented.

Next, in regard of the quantity of radiation from the auxiliary heat exchanger 55 according to the current embodiment, the current embodiment will be compared to a typical configuration (also, referred to as a second typical configuration) in which an auxiliary heat exchanger is connected in series to the immediately upstream side of a condenser. Since the second typical configuration radiates heat from refrigerant passed through the condenser, the second typical configuration cannot radiate heat directly from refrigerant of a relatively high temperature and high pressure flowing through an area from the discharge side of a compressor to the downstream side of the condenser. Accordingly, a quantity of radiation from the refrigerant becomes insufficient although the cooling apparatus 6 operates, so that the refrigerant is overheated and over-pressed, which may hinder operation of the compressor. Meanwhile, in the aspect A of the embodiment 1, since the cooling apparatus 6 radiates heat from the refrigerant that does not yet pass the second flow path 58 in the condenser 53, an amount of heat that can be radiated from refrigerant passing through the radiation flow path 59 may be increased by an amount of heat that is consumed due to heat exchange when the refrigerant passes through the second flow path 58, compared to the second typical configuration. Accordingly, since the cooling apparatus 6 operates to radiate heat relatively sufficiently compared to the second typical configuration, the refrigerant can be prevented from being overheated or over-pressed, which prevents a situation of hindering the operation of the compressor 52.

As described above, the clothes dryer D according to the aspect A of the embodiment 1 can increase a quantity of radiation compared to the configuration (the second typical configuration) in which a quantity of radiation may become insufficient, and can decrease a quantity of radiation compared to the configuration (the first typical configuration) in which a quantity of radiation may become excessive. Accordingly, since the clothes dryer D according to the aspect A of the embodiment 1 can prevent situations in which a quantity of radiation by the auxiliary heat exchanger 55 becomes insufficient or excessive, the clothes dryer D can maintain an appropriate quantity of radiation, thereby preventing the overheating and over-pressure of refrigerant without affecting heating of air flowing through the ventilation path 32 for heating and drying.

Accordingly, the clothes dryer D can improve performance compared to the typical configurations, in view of maintaining an appropriate quantity of radiation by the auxiliary heat exchanger 55.

Also, the clothes dryer D according to the aspect A of the embodiment 1 may require no member corresponding to a switching valve at the connection portion between the condenser 53 and the auxiliary heat exchanger 55. Accordingly, manufacturing cost can be reduced since another member and control system thereof are not needed.

Also, since both the cooling fan 61 and the exhaust fan 62 are on/off controlled, control system for them can be simplified, thereby reducing manufacturing cost.

Also, by connecting the auxiliary heat exchanger 55 in series to the flow path in the condenser 53, the length of a flow path required for refrigerant circulating in the heat pump apparatus 5 to flow through the compressor 52, the condenser 53, the throttling device 54, and the evaporator 51 in one cycle can become shorter, than in the configuration in which the auxiliary heat exchanger 55 is connected in series to the immediately upstream side or the immediately downstream side of the condenser 53. Accordingly, a load that is applied to the compressor 52 can be reduced by the shorter flow path. Thereby, consumption power required to operate the clothes dryer D can be reduced. Also, it is advantageous to configure the heat pump apparatus 5 with low cost.

Also, the effects obtained by the aspect A of the embodiment 1 may be particularly effective in maintaining an appropriate quantity of radiation when the cooling apparatus 6 operates to cool the auxiliary heat exchanger 55, however, this configuration is advantageous in maintaining an appropriate quantity of radiation even when heat is naturally radiated by refrigerant flowing in the auxiliary heat exchanger 55 without operating the cooling apparatus 6.

Also, since both the cooling fan 61 of directly cooling the auxiliary heat exchanger 55, and the exhaust fan 62 of facilitating radiation by the auxiliary heat exchanger 55 function as a cooling apparatus, it is advantageous to increase a quantity of radiation by the auxiliary heat exchanger 55.

In the first typical configuration, by increasing a quantity of radiation by the auxiliary heat exchanger 55, a situation of hindering heating of air may occur. However, the clothes dryer D according to the current embodiment can prevent such a situation, as described above. Accordingly, by relatively sufficiently increasing a quantity of radiation by the auxiliary heat exchanger 55, a situation in which refrigerant is overheated or over-pressed can be more stably prevented.

By applying the cooling fan 61 to make outside air contact the auxiliary heat exchanger 55, cooling performance can be improved.

Since the exhaust fan 62 is installed in the rear plate of the housing 1, there is no probability that the exhaust fan 62 interferes with the clothes drop opening and the cover 11, unlike the cooling fan 61, and accordingly, it is possible to relatively easily change the disposition of the exhaust fan 62.

Accordingly, it is possible to relatively easily adjust cooling performance without increasing or decreasing the driving voltage of the exhaust fan 62. For example, by changing the locations of the exhaust outlet 13 and the exhaust fan 62 from the upper area of the rear plate of the housing 1 to the lower area, it is possible to make the exhaust outlet 13 and the exhaust fan 62 contact the compressor 52 and the auxiliary heat exchanger 55. Thereby, it is advantage to exhaust air around the compressor 52 and the auxiliary heat exchanger 55, and furthermore, it is possible to increase the cooling performance of the compressor 52 and the auxiliary heat exchanger 55. As such, by disposing the exhaust outlet 13 and the exhaust fan 62 in the rear plate of the housing 1 to adjust cooling performance through a change in disposition, it is advantageous to achieve commonization of parts, which leads to suppression of manufacturing cost.

Also, since the compression capacity of the compressor 52 can increase or decrease, it is possible to independently use the energy saving driving method of setting compression capacity to a relatively low level and the speed driving method of setting compression capacity to a relatively high level, as described above. If the energy saving driving method is set, refrigerant discharged from the compressor 52 may become lower in temperature and pressure than when the speed driving method is set, so that the frequency of operation of the cooling apparatus 6 can be reduced correspondingly, and furthermore, the amount of consumption power required for completely drying clothes can be also reduced. On the other hand, when clothes C need to be quickly dried, the speed driving method may be set to shorten time required for completely drying the clothes C.

Also, in the refrigerant pipe 56 connecting the compressor 52 to the condenser 53, the refrigerant temperature sensor SW1 for detecting the temperature of refrigerant flowing through the refrigerant pipe 56 may be installed in the immediately downstream side of the compressor 52 to detect the temperature of refrigerant raised in temperature and pressure by the compressor 52. Since refrigerant of a relatively higher temperature and higher pressure flows through the refrigerant pipe 56 than in the other area, it is possible to operate the cooling apparatus 6 at a more appropriate timing in preventing the overheating and over-pressure of refrigerant.

Since the cooling fan 61 and the exhaust fan 62 operate when it is determined that the temperature of refrigerant just discharged from the compressor 52 exceeds a predetermined cooling start temperature, based on the result of detection by the refrigerant temperature sensor SW1, the cooling apparatus 6 may stop when it is determined that refrigerant is at a relatively low temperature and low pressure so that the auxiliary heat exchanger 55 does not need to be cooled, for example, like immediately after drying operation starts. Thereby, consumption power can be reduced by an amount of power required to drive the cooling fan 61 and the exhaust fan 62.

Also, since a flow path formed in the condenser 53 is divided into two of the first flow path 57 and the second flow path 58, it is possible to adjust a quantity of radiation by the auxiliary heat exchanger 55 by changing a ratio of flow path lengths between the first flow path 57 and the second flow path 58.

For example, if the first flow path 57 is shortened, the second flow path 58 may be lengthened correspondingly. In this case, an amount of heat consumed by heat exchange of refrigerant passing through the first flow path 57 can be reduced so as to increase an amount of heat that can be radiated by refrigerant flowing through the radiating flow path.

Also, instead of the connecting pipe sections 53*f*, the two tubes 53*d* connected to the outward extended pipe section 91 and the homeward extended pipe section 92 may change from a state shown in FIG. 2. Thereby, it is possible to change a ratio of flow path lengths between the first flow path 57 and the second flow path 58. That is, by substituting the connecting pipe sections 53*f* with the outward extended pipe section 91 and the homeward extended pipe section 92 without changing the whole configuration of the condenser 53, furthermore, the shapes of the tubes 53*d*, the first flow path 57 and the second flow path 58 may be formed in the condenser 53. Accordingly, the first flow path 57 and the second flow path 58 can be easily formed in the condenser 53. Also, it is possible to change a ratio of flow path lengths between the first flow path 57 and the second flow path 58, to achieve commonization of parts, and to reduce manufacturing cost.

(Modified Example of Aspect A of Embodiment 1)

Hereinafter, a modified example of the aspect A of the embodiment 1 will be described.

Figure 4A:
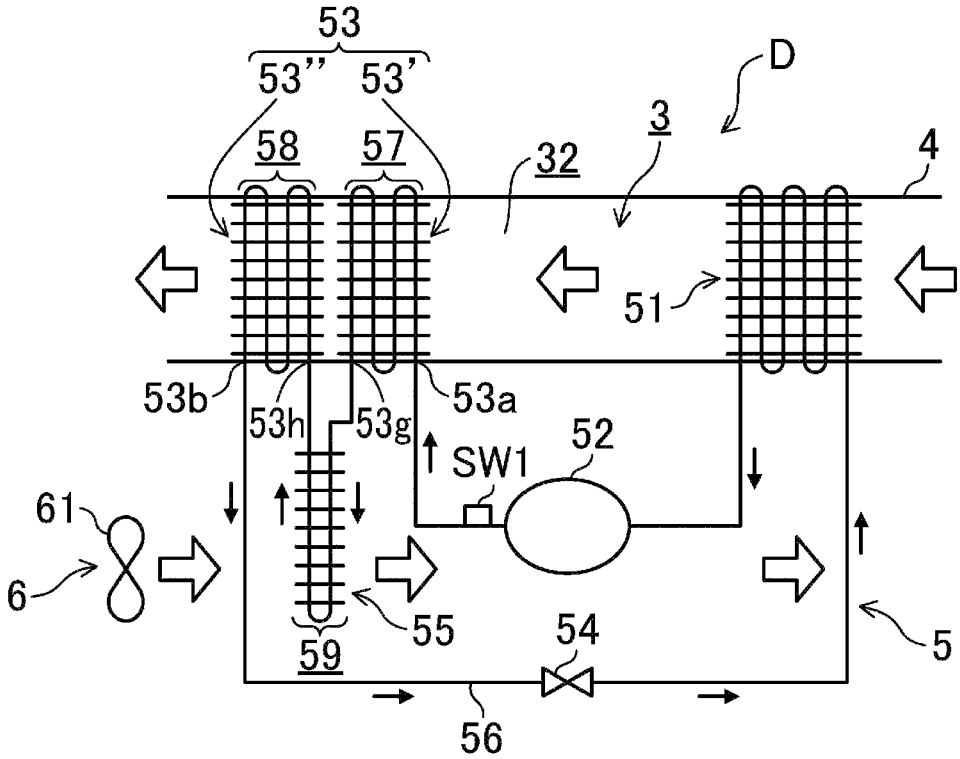
FIG. 4A is a schematic view showing a main portion of a modified example of the heat pump type dryer according to the aspect A.

In the aspect A of the embodiment 1, the condenser 53 is configured with a single heat exchanger, however, the condenser 53 can be configured with two independent heat exchangers or more. For example, as shown in FIG. 4A, the condenser 53 may be configured with a first condenser 53', and a second condenser 53" disposed in the immediately downward side of the first condenser 53'.

In this case, the first flow path 57 and the second flow path 58 formed in the condenser 53 in the aspect A of the embodiment 1 may correspond to flow paths respectively formed in the first condenser 53' and the second condenser 53". In this case, the radiating flow path 59 in the auxiliary heat exchanger 55 may be connected between the first flow path 57 in the first condenser 53' and the second flow path 58 in the second condenser 53", as shown in FIG. 4A, so that the radiating flow path 59 is connected in series to the flow paths in the condenser 53. By connecting the radiating flow path 59 in this way, refrigerant entered the condenser 53 may pass through the flow path 57 in the first condenser 53', the radiating flow path 59, and the flow path in the second condenser 53", sequentially.

Figure 4B:
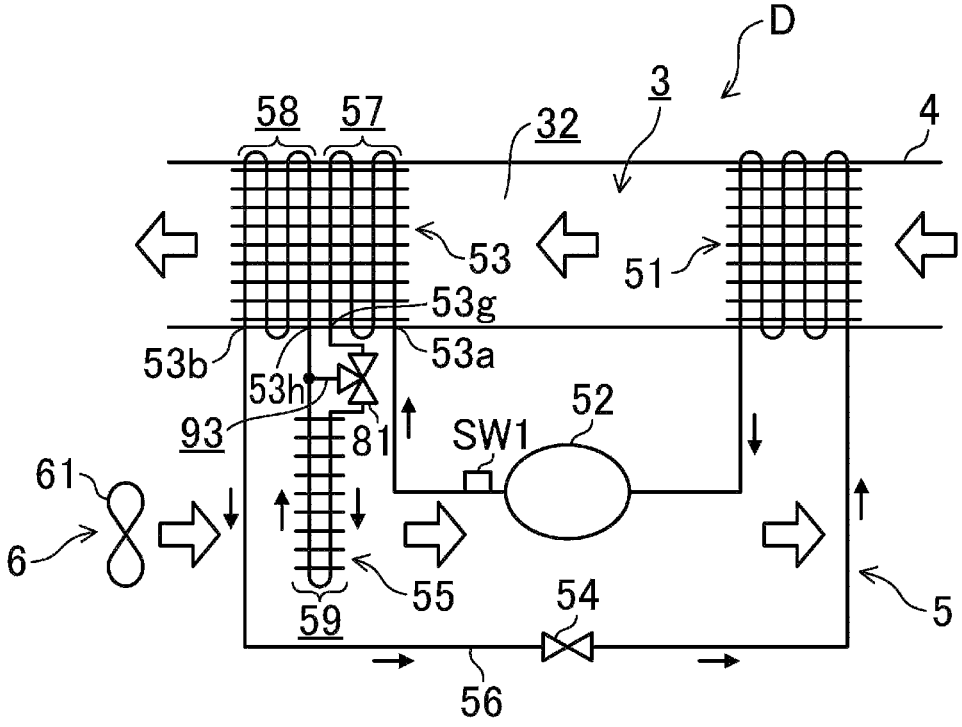
FIG. 4B is a schematic view showing a main portion of another modified example which is different from the modified example shown in FIG. 4A.

Also, as shown in FIG. 4B, a bypass path 93 may be formed to make a flow path extending from the first intermediate end 53*g* diverge, and to make refrigerant passed through the first flow path 57 and discharged from the first intermediate end 53*g* bypass the radiating flow path 59 in the auxiliary heat exchanger 55 to supply the refrigerant to the second intermediate end 53*h* of the second flow path 58, and a flow path selecting device 81 may be disposed at the divergence area.

More specifically, as shown in FIG. 4B, the bypass path 93 may be formed to connect the outward extended pipe sections 91 to the home-ward extended pipe sections 92. The flow path selecting device 81 may be disposed around a connection portion between the bypass path 93 and the homeward extended pipe sections 91.

Figure 8:
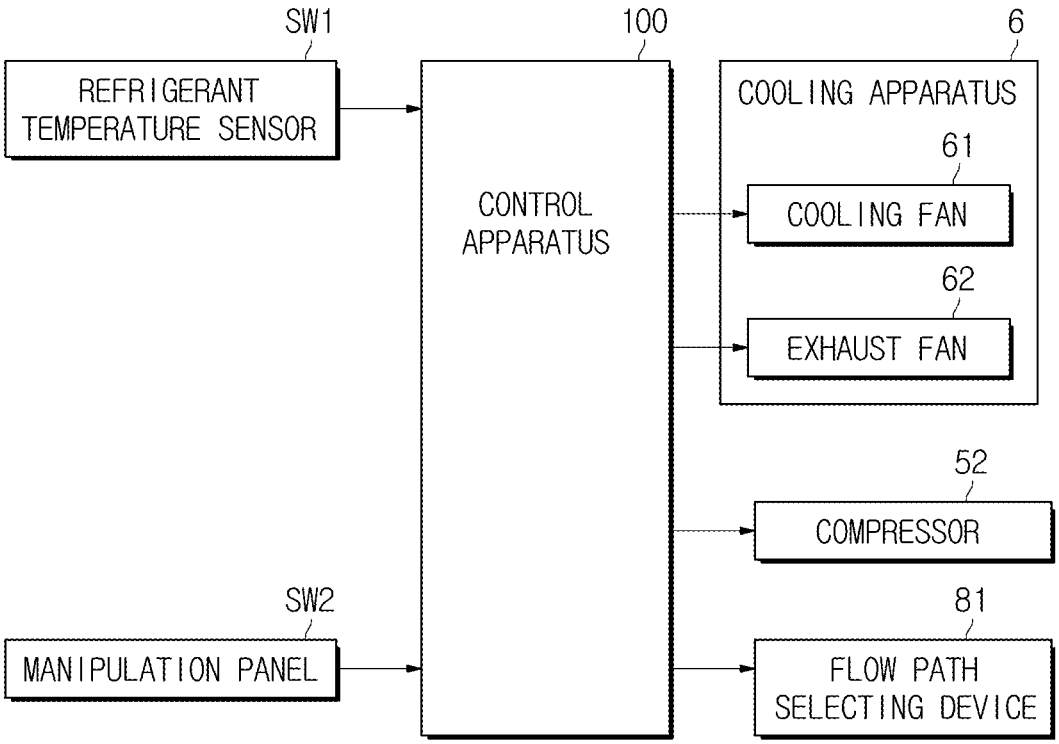
FIG. 8 is a block diagram showing the configuration of a control apparatus for the modified example shown in FIG. 4B.

The flow path selecting device 81 may operate based on a control signal from the control apparatus 100, as shown in FIG. 8, to cause refrigerant passed through the first flow path 57 and discharged from the first intermediate end 53*g* to flow through the radiating flow path 59 or the bypass path 93.

Through the configuration, when radiation by the auxiliary heat exchanger 55 is unnecessary, the flow path selecting device 81 may be controlled to cause refrigerant entered the condenser 53 to bypass the radiating flow path 59, thereby blocking unnecessary radiation by the auxiliary heat exchanger 55. Thereby, it is possible to ensure the amount of heat required for heating air, and also it is possible to reduce the amount of consumption power required for operating the compressor 55, further, the cooling mean 6, by the amount of heat secured by preventing unnecessary radiation.

Also, the shapes of the first flow path 57 and the second flow path 58 formed in the condenser 53 are not limited to the above-described configuration. For example, it is also possible that a flow path in the condenser 53 is divided into three, or two or more auxiliary heat exchangers 55 are disposed.

(Aspect B of the Embodiment 1)

Now, a clothes dryer (heat pump type driver) D according to aspect B of embodiment 1 will be described. Hereinafter, differences with the aspect A of the embodiment 1 and the configuration of the modified example, and effects obtained by the differences will be described.

Figure 5:
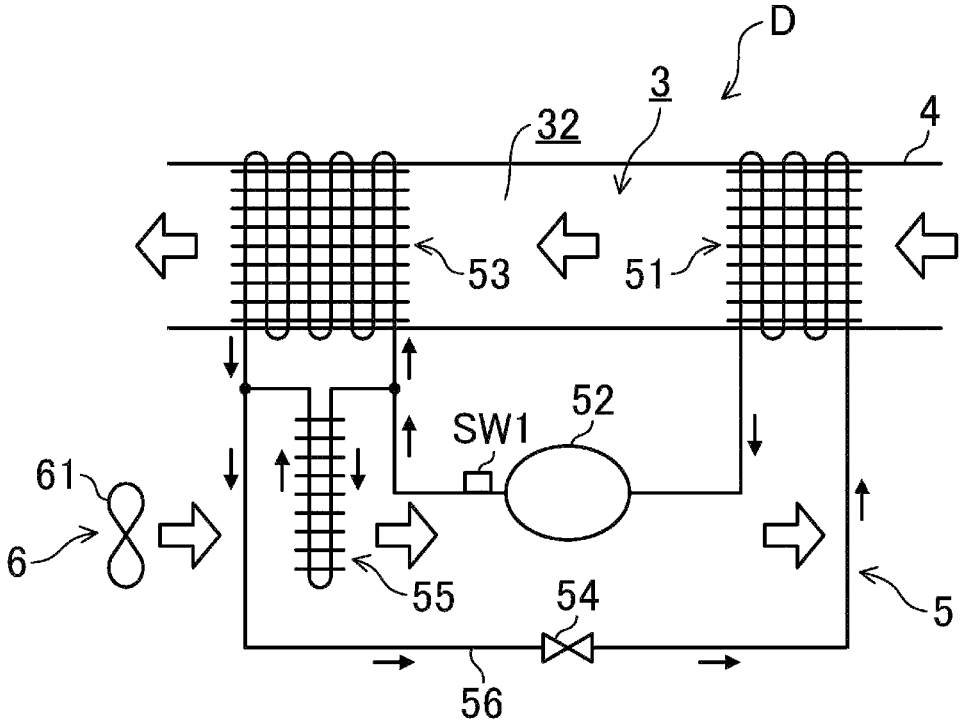
FIG. 5 is a view corresponding to FIG. 4A in a heat pump type dryer according to aspect B of the embodiment 1.

As shown in FIG. 5, the auxiliary heat exchanger 55 according to the aspect B of the embodiment 1 may be connected in parallel to the condenser 53. Accordingly, a flow path extending from the downstream side of the compressor 52 may be divided into a flow path extending to the upstream end 53*a* of the condenser 53, and a flow path extending to one end (one end of the downstream side) of the auxiliary heat exchanger 55, at a connection portion. Meanwhile, a flow path extending from the downstream side of the condenser 53, and a flow path extending from the downstream side of the auxiliary heat exchanger 55 may form a single flow path installed in the immediately upstream side of the throttling device 54, connected to a connection portion, and extending to the upstream side of the throttling device 54 from the connection portion, as shown in FIG. 5.

Accordingly, while the heat pump apparatus 5 according to the aspect B of the embodiment 1 operates, a predetermined quantity of refrigerant discharged from the compressor 52 may continue to flow in the condenser 53, whereas the remaining quantity of the refrigerant discharged from the compressor 52 may continue to flow in the auxiliary heat exchanger 55.

Also, if the controller 100 according to the aspect B of the embodiment 1 determines that the temperature of refrigerant just passed through the compressor 52 is higher than the cooling start temperature, based on the result of detection by the refrigerant temperature sensor SW1, the controller 100 may operate the cooling apparatus 6 (that is, the cooling fan 61 and the exhaust fan 62) in order to prevent the overheating and over-pressure of the refrigerant. The cooling apparatus 6 may cool the auxiliary heat exchanger 55 until the temperature of the refrigerant becomes lower than the cooling stop temperature.

In regard of a quantity of radiation by the auxiliary heat exchanger 55 according to the aspect B of the embodiment 1, the same effects as in the auxiliary heat exchanger 55 according to the aspect A of the embodiment 1 can be obtained. Hereinafter, comparison with the first typical configuration will be performed. In the first typical configuration, more heat than necessary may be radiated by refrigerant before entering the condenser, for the above-described reason. Meanwhile, in the configuration according to the aspect B of the embodiment 1, since a predetermined quantity of refrigerant discharged from the compressor 52 enters the condenser 53 without passing through the auxiliary heat exchanger 55, an amount of heat that is used to heat air can be ensured by the predetermined quantity of refrigerant. Accordingly, a quantity of radiation by refrigerant passing through the auxiliary heat exchanger 55 can be reduced compared to the first typical configuration, although the cooling apparatus 6 operates. As a result, it is possible to prevent a situation that a quantity of radiation becomes excessive so as to hinder heating of air.

Successively, comparison with the second typical configuration will be performed. In the second typical configuration, since heat is radiated by refrigerant passed through the condenser, for the above-described reason, there is probability that a quantity of radiation becomes insufficient. Meanwhile, in the configuration according to the aspect B of the embodiment 1, since a predetermined quantity of refrigerant discharged from the compressor 52 flows through the auxiliary heat exchanger 55 without passing through the condenser 53, an amount of heat that can be radiated by the refrigerant can be obtained by the predetermined quantity of refrigerant. Accordingly, a quantity of radiation by refrigerant flowing through the heat exchanger 55, when the cooling apparatus 6 operates, may increase compared to the second typical configuration. As a result, situations in which a quantity of radiation becomes insufficient, and in which a problem is generated in operation of the compressor 52 can be prevented.

In this way, the clothes dryer D according to the second aspect B of the embodiment 1 can increase a quantity of radiation compared to the configuration (second typical configuration) in which a quantity of radiation may become insufficient, and can decrease a quantity of radiation compared to the configuration (first typical configuration) in which a quantity of radiation may become excessive, like the clothes dryer D according to the aspect A of the embodiment 1. Accordingly, the clothes dryer D according to the aspect B of the embodiment 1 can maintain an appropriate quantity of radiation, in order to prevent the overheating and over-pressure of refrigerant without hindering heating of refrigerant flowing through the ventilation path 32 for heating and drying, like the clothes dryer D according to the aspect A of the embodiment 1.

Also, the configuration according to the aspect B of the embodiment 1 requires no member corresponding to the switching valve, at the connection portion between the condenser 53 and the auxiliary heat exchanger 55. Accordingly, manufacturing cost can be reduced since another member and control system thereof are not needed.

In addition, there is no need to make an air flow rate from the cooling fan 61 and the exhaust fan 62 variable, thereby further reducing manufacturing cost.

Also, since both the cooling fan 61 and the exhaust fan 62 are relatively easily on/off controlled, control system for them can be simplified compared to a configuration of making an air flow rate variable, thereby reducing manufacturing cost.

Also, by connecting the auxiliary heat exchanger 55 in parallel to the condenser 53, the length of a flow path required for refrigerant circulating in the heat pump apparatus 5 to flow through the compressor 52, the condenser 53, the throttling device 54, and the evaporator 51 in one cycle can become shorter, like the configuration according to the aspect A of the embodiment 1. Thereby, a load that is applied to the compressor 52 can be reduced by the shorter flow path. Thereby, consumption power required to operate the clothes dryer D can be reduced. Also, it is possible to configure the heat pump apparatus 5 with low cost.

Also, the effects obtained by the configuration according to the aspect B of the embodiment 1 is particularly effective in maintaining an appropriate quantity of radiation when the cooling apparatus 6 operates to cool the auxiliary heat exchanger. However, the current configuration is advantageous in maintaining an appropriate quantity of radiation, even when heat is naturally radiated by refrigerant flowing in the auxiliary heat exchanger 55 without operating the cooling apparatus 6.

(Modified Example of the Aspect B of the Embodiment 1)

Hereinafter, a modified example of the aspect B of the embodiment 1 will be described.

Figure 6:
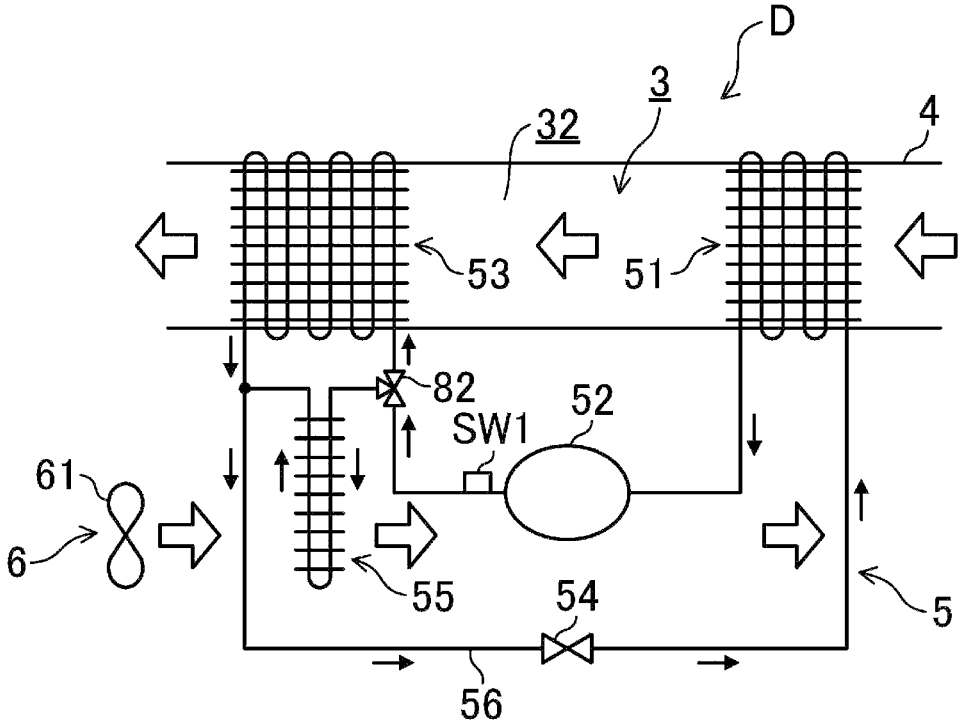
FIG. 6 is a view corresponding to FIG. 4B, showing a modified example of the heat pump type dryer according to the aspect B.

In a modified example of the aspect B of the embodiment 1, a flow path switching device 82 may be installed at a divergence portion (connection portion) of the upstream side, as shown in FIG. 6.

The flow path switching device 82 may alternatively switch between a flow path for causing the total quantity of refrigerant discharged from the compressor 52 to flow through the condenser 53, and a flow path for causing a predetermined quantity of the discharged refrigerant to flow through the auxiliary heat exchanger 55 and the remaining quantity of the refrigerant to flow through the condenser 53, based on a control signal from the control apparatus 100.

According to the current configuration, by causing the total quantity of refrigerant discharged from the compressor 52 to flow to the condenser 53 when radiation by the auxiliary heat exchanger 55 is unnecessary, radiation by the auxiliary heat exchanger 55 can be prevented. Thereby, it is advantageous to heat air, and an amount of consumption power required for operating the compressor 52, further, the cooling apparatus 6 can be reduced by an amount of power ensured by preventing unnecessary radiation.

(Aspect C of the Embodiment 1)

Hereinafter, an aspect C of the embodiment 1 will be described.

In the modified example of the aspect A of the embodiment 1 as shown in FIG. 4B, the configuration in which the bypass path 93 and the flow path selecting device 81 are installed when the auxiliary heat exchanger 55 is connected in series to the flow path in the condenser 53 is disclosed, wherein the flow path selecting device 81 can alternatively switch between the flow path for causing refrigerant passed through the first flow path 57 to bypass the radiating flow path 59 in the auxiliary heat exchanger 55 and the flow path for causing the refrigerant to pass through the radiating flow path 59.

In the aspect C of the embodiment 1, the flow path selecting device 81 may be substituted with a quantity distributing device to adjust a bypass quantity Qb bypassing the auxiliary heat exchanger 55 among refrigerant discharged from the compressor 52 and then passed through the first flow path 57, and a radiation quantity Qc flowing through the auxiliary heat exchanger 55 among the refrigerant.

In the aspect C, the quantity distributing device may be configured as a solenoid valve, and change a ratio Qr (=Qc/Qb) of the radiation quantity Qc with respect to the bypass quantity Qb within a range of 0% to 100%, based on a control signal from the control apparatus 100. For example, when the ratio Qr=0%, the total quantity Qt of refrigerant passed through the first flow path 57 may bypass the auxiliary heat exchanger 55, whereas when the ratio Qr=100%, the total quantity Qt of refrigerant passed through the first flow path 57 may flow through the radiating flow path 59 in the auxiliary heat exchanger 55. Also, the radiation quantity Qc may increase gradually as the ratio Qr increases toward 100% from 0%.

Also, as the radiation quantity Qc increases, radiation by the auxiliary heat exchanger 55 may be facilitated, and as the radiation quantity Qc decreases, radiation by the auxiliary heat exchanger 55 may be suppressed.

In the aspect C, a quantity of refrigerant flowing through the flow paths 57 and 58 in the condenser 53 may be maintained constant, regardless of the ratio Qr.

The control apparatus 100 according to the aspect C may be configured to control the cooling apparatus 6 and the quantity distributing device, based on the result of detection by the refrigerant temperature sensor SW1.

The current configuration may be obtained by substituting the flow path selecting device 81 with the quantity distributing device, as shown in FIGS. 4B and 8.

The control apparatus 100 according to the aspect C may control, when the heat pump apparatus 5 starts operating, the quantity distributing device so that the total quantity Qt of refrigerant discharged from the compressor 52 becomes the bypass quantity Qb.

Also, the control apparatus 100 may determine whether the temperature of refrigerant exceeds a first temperature T1 set to a higher temperature than a predetermined target temperature T0, based on the result of detection by the refrigerant temperature sensor SW1. If the control apparatus 100 determines that the temperature of the refrigerant exceeds the first temperature T1, the control apparatus 100 may control the quantity distributing device to decrease the bypass quantity Qb by a predetermined quantity ΔQ, and increase the radiation quantity Qc passing through the auxiliary heat exchanger 55 by the predetermine quantity ΔQ. In the aspect C, the first temperature T1 may correspond to the cooling start temperature in the aspects A and B.

The control apparatus 100 may operate the cooling apparatus 6 when performing the control. The control apparatus 100 may cool the auxiliary heat exchanger 55 with the cooling apparatus 6, until the temperature of the refrigerant becomes lower than a target temperature T0. In the aspect C, the target temperature T0 may correspond to the cooling stop temperature in the aspects A and B.

Also, the control apparatus 100 may determine whether the temperature of the refrigerant exceeds the second temperature T2 set to a higher temperature than the first temperature T1, based on the result of detection by the refrigerant temperature sensor SW1. If the control apparatus 100 determines that the temperature of the refrigerant exceeds the second temperature T2, the control apparatus 100 may control the quantity distributing device to again decrease the bypass quantity Qb by the predetermined quantity ΔQ, and to further increase the radiation quantity Qc by the predetermine quantity ΔQ.

Meanwhile, the control apparatus 100 may determine whether the temperature of the refrigerant is lower than a third temperature T3 set to a lower temperature than the target temperature T0, based on the result of detection by the refrigerant temperature sensor SW1. If the control apparatus 100 determines that the temperature of the refrigerant is lower than the third temperature T3, the control apparatus 100 may control the quantity distributing device to decrease the radiation quantity Qc by the predetermine quantity ΔQ, and to increase the bypass quantity Qb by the predetermine quantity ΔQ.

Also, the control apparatus 100 according to the aspect C may be configured to increase or decrease the compression capacity of the compressor 52, based on the result of detection by the refrigerant temperature sensor SW1. Also, the control apparatus 100 may control the cooling apparatus 6, the quantity distributing device, and the compressor 52 in combination to thereby maintain the temperature of refrigerant, further, the temperature of air flowing in the ventilation path 3 constant.

Hereinafter, an example of control using the control apparatus 100 configured as described above will be described.

Figure 9A:
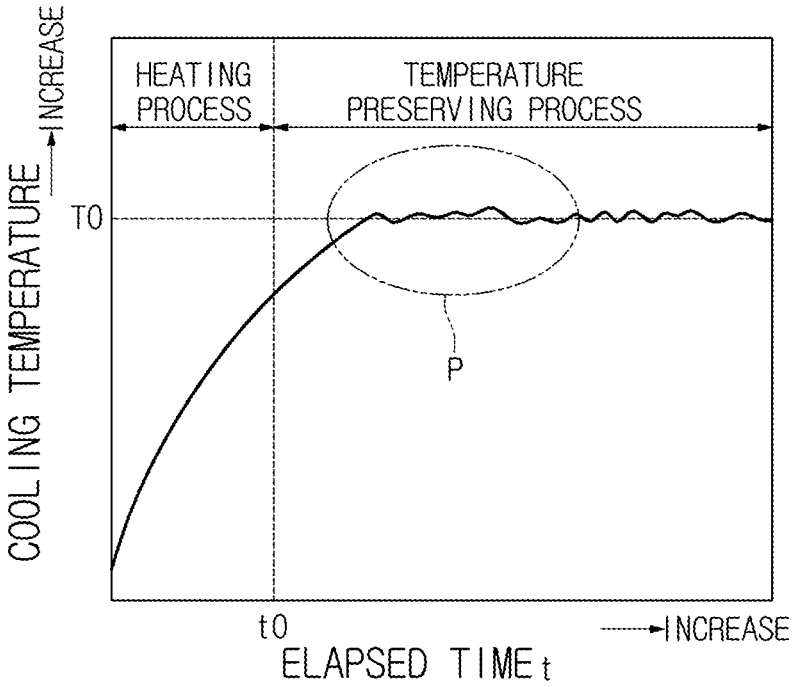
FIG. 9A is a schematic view showing changes of refrigerant temperature over time elapsed after operation starts, in a heat pump type dryer according to aspect C of the embodiment 1.

FIG. 9A is a schematic view showing changes of refrigerant temperature over time elapsed after operation starts, in the clothes dryer D.

If the clothes dryer D starts operating, the control apparatus 100 may perform a heating process for raising the temperature of refrigerant as quickly as possible, and a temperature preserving process for maintaining the temperature of the refrigerant around the predetermined target temperature T0, as a drying process, as shown in FIG. 9A.

The control apparatus 100 may perform the heating process for a predetermined time period t0 ($0 \leq t < t0$).

During the heating process, since the total quantity Qt of refrigerant discharged from the compressor 52 becomes the bypass quantity Qb (Qr=0%), the radiation quantity Qc can be reduced to the maximum. Accordingly, during the heating process, refrigerant can be heated as quickly as possible, so that air flowing through the ventilation path 3 can be heated as quickly as possible.

Also, during the heating process, the compression capacity of the compressor 52 may be set to a relatively great value in order to heat air as quickly as possible.

Also, if the predetermined time period t0 ($t \geq t0$) elapses after the drying process starts, the control apparatus 100 may perform the temperature preserving process, instead of the heating process.

Figure 9B:
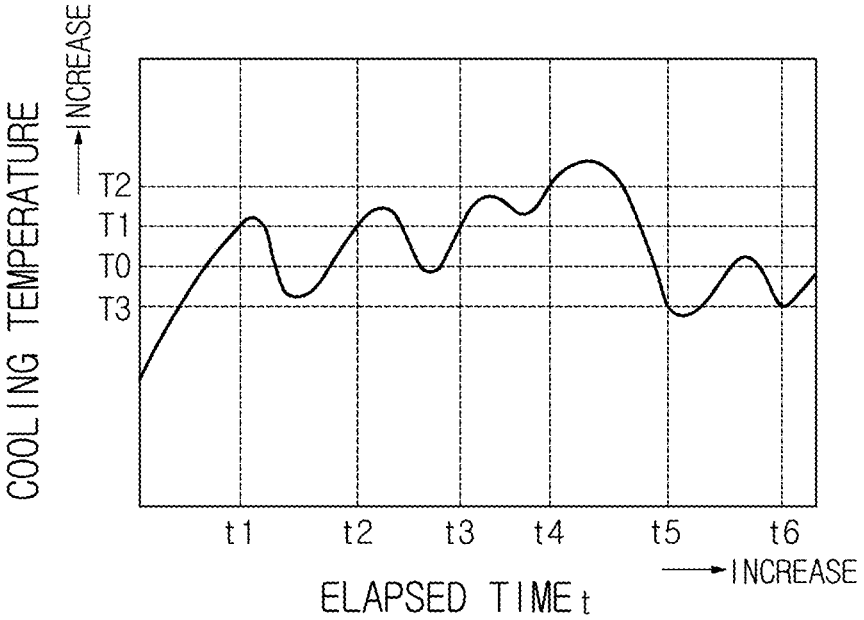
FIG. 9B is an enlarged schematic view of an area P of FIG. 9A.

During the temperature preserving process, if the control apparatus 100 determines that the temperature of the refrigerant exceeds the first temperature T1 (t=t1), as shown in FIG. 9B corresponding to an enlarged view of an area P of FIG. 9A, the control apparatus 100 may decrease the bypass quantity Qb by ΔQ (Qb=Qt−ΔQ), and increase the radiation quantity Qc by ΔQ from zero (Qc=ΔQ). As a result, radiation by the auxiliary heat exchanger 55 may be facilitated, and the temperature rise of the refrigerant may be suppressed. Also, the control apparatus 100 may increase the radiation quantity Qc, and simultaneously cool the auxiliary heat exchanger 55 with the cooling apparatus 6 until the temperature of the refrigerant becomes lower than the target temperature T0.

The control apparatus 100 may increase the radiation quantity Qc by ΔQ, and operate the cooling apparatus 6, whenever the temperature of the refrigerant exceeds the first temperature T1 (t=t2, t3), as shown in FIG. 9B.

However, generally, as the drying process proceeds, the temperature of the refrigerant may easily rise gradually. Accordingly, there may occur a case in which the temperature of the refrigerant does not fall below the first temperature T1, although the radiation quantity is increased by ΔQ and the cooling apparatus 6 operates.

In order to cope with the case, when the control apparatus 100 determines that the temperature of the refrigerant exceeds the second temperature T2 set to a higher temperature than the first temperature T1 (t=t4), the control apparatus 100 may again decrease the bypass quantity Qb by ΔQ, and again increase the radiation quantity Qc by ΔQ.

Meanwhile, if the control apparatus 100 determines that a quantity of radiation by the auxiliary heat exchanger 55 is excessive so that the temperature of the refrigerant becomes lower than the third temperature T3 set to a lower temperature than the target temperature T0 (t=t5), the control apparatus 100 may decrease the radiation quantity Qc by ΔQ, and increase the bypass quantity Qb by ΔQ in order to suppress radiation.

The control apparatus 100 may decrease the ration quantity Qc by ΔQ, whenever the temperature of the refrigerant becomes lower than the third temperature (t=t6), as shown in FIG. 9B.

Also, the control apparatus 100 may be configured to lower the compression capacity of the compressor 52 gradually as the drying process proceeds. Thereby, the temperature rise of refrigerant that is caused as the drying process proceeds can be suppressed as possible. In this example, if the temperature preserving process is divided into two of a first half and a second half, a relatively high level of compression capacity may be set during the heating process and the first half of the temperature preserving process, and a relatively low level of compression capacity may be set during the second half of the temperature preserving process.

Also, if the temperature of the refrigerant is still not lower than the target temperature T0, even when the control apparatus 100 increases the radiation quantity Qc to the maximum (Qr=100%) and operates the cooling apparatus 6, the control apparatus 100 may lower the compression capacity of the compressor 52 to thereby lower the temperature of the refrigerant.

Also, if the temperature of the refrigerant is still not higher than the target temperature T0, even when the control apparatus 100 decreases the radiation quantity Qc to the minimum (Qr=0%), and stops operating the cooling apparatus 6, the control apparatus 100 may raise the compression capacity of the compressor 52 to thereby raise the temperature of the refrigerant.

In this way, the control apparatus 100 according to the aspect C may control the cooling apparatus 6, the quantity distributing device, and the compressor 52 in combination to thereby maintain the temperature of refrigerant around the target temperature T0.

As described above, since the clothes dryer D according to the aspect C is configured to increase or decrease the radiation quantity Qc by controlling the quantity distributing device, the clothes dryer D can maintain an appropriate quantity of radiation by the auxiliary heat exchanger 55.

Also, since the clothes dryer D according to the aspect C is configured so that the total quantity Qt of refrigerant discharged from the compressor 52 becomes the bypass quantity Qb when the heat pump apparatus 5 starts operating, the clothes dryer D can suppress radiation by the auxiliary heat exchanger 55, and raise the temperature of air flowing through the ventilation path 3 as quickly as possible.

Also, since the clothes dryer D according to the aspect C is configured to increase the radiation quantity Qc and simultaneously operate the cooling apparatus 6 when the temperature of refrigerant exceeds the first temperature T1, the clothes dryer D can lower the temperature of the refrigerant, while suppressing the temperature rise of the refrigerant. Accordingly, the clothes dryer D can more stably prevent the overheating and over-pressure of the refrigerant.

Also, since the clothes dryer D according to the aspect C is configured to further increase the radiation quantity Qc when the temperature of refrigerant exceeds the second temperature T2, the clothes dryer D can maintain an appropriate quantity of radiation by the auxiliary heat exchanger 55, and further more stably prevent the overheating and over-pressure of the refrigerant.

Also, since the clothes dryer D according to the aspect C is configured to decrease the radiation quantity Qc when the temperature of refrigerant is lower than the third temperature T3, the clothes dryer D can effectively prevent excessive radiation.

Also, since the clothes dryer D according to the aspect C is configured to lower the compression capacity of the compressor 52 gradually as the drying process proceeds, the clothes dryer D can accurately control a quantity of radiation by the auxiliary heat exchanger to maintain an appropriate quantity of radiation, by controlling the compression capacity of the compressor 52, the quantity distributing device, and operation of the cooling apparatus in combination.

(Aspect D of the Embodiment 1)

Hereinafter, an aspect D of the embodiment 1 will be described.

In the modified example of the aspect B of the embodiment 1 as shown in FIG. 6, the configuration in which the flow path switching device 82 is installed when the auxiliary heat exchanger 55 is connected in parallel to the condenser 53 is shown, wherein the flow path switching device 82 is configured to alternatively switch between the flow path for causing the total quantity of refrigerant discharged from the compressor 52 to flow through the condenser 53, and the flow path for causing a predetermined quantity of the discharged refrigerant to flow through the auxiliary heat exchanger 55 and the remaining quantity of the refrigerant to flow through the condenser 53.

The aspect D of the embodiment 1 can be obtained by substituting the flow path switching device 82 with the quantity distributing device to adjust a condenser-side quantity Qv passing through the condenser 53 and a radiation quantity Qc passing through the auxiliary heat exchanger 55 among refrigerant discharged from the compressor 52.

In the aspect D, the quantity distributing device may be configured as a solenoid valve, like the aspect C, and change a ratio Qr (=Qc/Qv) of the radiation quantity Qc with respect to the condenser-side quantity Qv within a range of 0% to 100%, based on a control signal from the control apparatus 100.

The control apparatus 100 according to the modified example may be configured to control the cooling apparatus 6 and the quantity distributing device, based on the result of detection by the refrigerant temperature sensor SW1.

The current configuration may be obtained by substituting the flow path selecting device 81 with the quantity distributing device, as shown in FIGS. 6 and 8.

In this case, a quantity of refrigerant flowing through the condenser 53 may increase or decrease according to a change of the ratio Qr. For example, as the ratio Qr increases, the condenser-side quantity Qv, further, a quantity flowing through the condenser 53 may decrease gradually.

The control apparatus 100 according to the aspect D of the embodiment 1 may be configured to perform the same control as the control apparatus 100 according to the aspect C of the embodiment 1.

Accordingly, the clothes dryer D according to the aspect D of the embodiment 1 can obtain the same effects as the clothes dryer D according to the aspect D of the embodiment 1.

Hereinafter, effect differences between the clothes dryer D according to the aspect C of the embodiment 1 and the clothes dryer D according to the aspect D of the embodiment 1 will be described.

That is, in the aspect C, a quantity of refrigerant flowing through the radiating flow path 59 in the auxiliary heat exchanger 55 may be adjusted by changing the ratio Qr, and a quantity of refrigerant flowing through the flow paths 57 and 58 in the condenser 53 may be maintained constant regardless of the ratio Qr. Through the configuration, it is possible to suppress influence on heating of air by the condenser 53 when the ratio Qr is adjusted. Accordingly, it is possible to adjust a quantity of radiation and simultaneously heat air.

Accordingly, the clothes dryer D according to the aspect C can easily adjust a quantity of radiation, without hindering drying of clothes C, depending on the compression performance of the compressor 52, the cooling performance of the cooling apparatus 6, and the target performance (considering energy saving or short dry time) of the clothes dryer D, etc.

Meanwhile, in the aspect D, it is possible to relatively easily connect the auxiliary heat exchanger 55, regardless of the structure of the flow paths 57 and 58 in the condenser 53. Accordingly, another kind of heat exchanger than a fin-end-tube type can be used as a condenser.

The other kind of heat exchanger may be a micro-channel type heat exchanger having a micro-scale flow path, or a S-fin type heat exchanger obtained by expanding a refrigerant pipe to tightly make the refrigerant pipe contact a fin and then performing meander bending on the refrigerant pipe. The configuration according to the aspect D can improve the productivity of the clothes dryer D, in that it can be easily applied to a heat exchanger having such a relatively complicated flow path.

Also, the effects can be obtained from the aspect B of the embodiment 1.

(Modified Examples of the Aspects C and D of the Embodiment 1)

Hereinafter, modified examples of the aspects C and D of the embodiment 1 will be described.

In the aspect C of the embodiment 1, like the modified example of the aspect A of the embodiment 1, the condenser 53 may be configured as two or more independent heat exchangers.

Also, in the aspects C and D, if the control apparatus 100 determines that the temperature of refrigerant exceeds the first temperature T1, the control apparatus 100 may increase the radiation quantity Qc flowing through the auxiliary heat exchanger 55, and cool the auxiliary heat exchanger 55 with the cooling apparatus 6. Alternatively, the control apparatus 100 may increase the radiation quantity Qc, without operating the cooling apparatus 6.

Through the configuration, it is possible to more accurately adjust a quantity of radiation by the auxiliary heat exchanger 55. Thereby, it is possible to maintain an appropriate quantity of radiation by the auxiliary heat exchanger 55.

Also, if the control apparatus 100 determines that the temperature of refrigerant exceeds a predetermined fourth temperature (>T0) that is different from the first temperature T1, the control apparatus 100 may operate the cooling apparatus 6.

Also, the control apparatus 100 may operate the cooling apparatus 6, in consideration of all of the result of detection by the refrigerant temperature sensor SW1, the value of the ratio Qr, the progress of the drying process, etc.

Also, the control apparatus 100 may change the predetermined quantity ΔQ used for increasing or decreasing the bypass quantity Qb, the radiation quantity Qc, or the condenser-side quantity Qv, appropriately, based on the result of detection by the refrigerant temperature sensor SW1, the value of the ratio Qr, the progress of the drying process, etc.

If the control apparatus 100 determines that the temperature of refrigerant exceeds the first temperature T1, the control apparatus 100 may determine that it is possible to increase the bypass quantity Qb if the ratio Qr is smaller than a predetermined value (for example, 100%). Accordingly, the control apparatus 100 may control only the quantity distributing device. Meanwhile, if the ratio Qr is greater than or equal to the predetermined value, the control apparatus 100 may determine that it is impossible to increase the bypass quantity Qb, and operate only the cooling apparatus 6.

Since it is possible to suppress operation of the cooling apparatus 6 as possible through the configuration, noise generated by driving of the cooling fan 61 and the exhaust fan 62, and an amount of consumption power required for operating the fans 61 and 62 can also be suppressed.

The modified examples can be used in combination within an allowable range.

The control of the compressor 52 may also be changed within an allowable range.

Other Modified Examples

Hereinafter, other modified examples for the aspects A to D of the embodiment 1 will be described.

The control method by the control apparatus 100 can change within an allowable range.

Also, in the above-described embodiment, the cooling apparatus 6 may operate based on a detection signal from the refrigerant temperature sensor SW1 installed in the refrigerant pipe 56 of the heat pump apparatus 5, however, an air temperature sensor, instead of the refrigerant temperature sensor SW1, may be installed to detect the temperature of air just before entering the accommodating space 21. Thereby, the cooling apparatus 6 may operate based on the temperature of air flowing through the ventilation path 3. Also, by using the refrigerant temperature sensor SW1 and the air temperature sensor in combination, it is possible to more accurately control the temperature of refrigerant when the temperature of the refrigerant rises. In this case, for example, control operation of changing the compression capacity of the compressor 52, and control operation of operating the cooling apparatus 6 may be performed in combination. In the aspects A and B of the embodiment 1, the cooling start temperature and the cooling stop temperature may also change appropriately according to the configuration, etc. of the clothes dryer D.

Also, in the above-described embodiment, when the cooling apparatus 6 operates, the cooling fan 61 and the exhaust fan 62 may operate simultaneously. However, the configuration is not limited to this. For example, any one of the cooling fan 61 and the exhaust fan 62 may operate.

Also, the cooling apparatus 6 may be not limited to the configuration including the cooling fan 61 and the exhaust fan 62. For example, only the exhaust fan 62 may be installed as the cooling apparatus 6. Like the above-described embodiment, by installing the exhaust fan 62 in the rear plate of the housing 1, the exhaust outlet 13 is not seen from the front of the housing 1, thereby improving decorative property. Also, compared to the case in which the exhaust fan 62 is installed in the front plate of the housing 1, noise generated when the exhaust fan 62 is driven, or aerodynamic noise generated when the exhaust fan 62 inhales outside air can be reduced.

Also, as the cooling apparatus 6, a water cooling apparatus, instead of or in addition to the above-described configuration, may be used.

The object to be dried is not limited to clothes. More specifically, the configuration according to the above-described embodiment can be applied to, for example, a dish dryer, other than the clothes dryer D. In this case, the object to be dried may be dishware. Also, the configuration can be applied to a dryer for bathroom.

Also, the configuration can be applied to a washing machine having both a washing function and a drying function.

(Control Method of the Embodiment 1)

Hereinafter, a control method of the dryer according to the embodiment 1 will be described.

Figure 38:
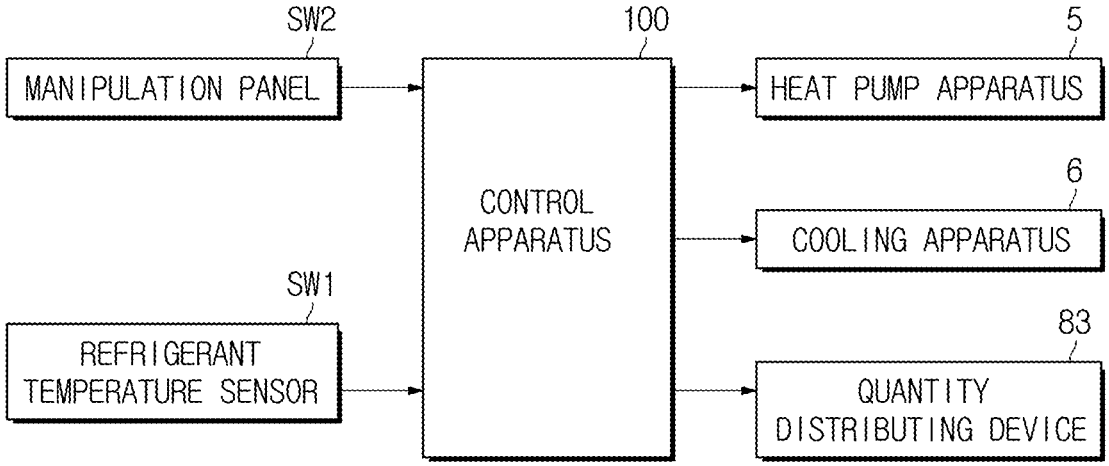
FIG. 38 is a block diagram showing the configuration of a control apparatus in the heat pump type dryer according to the embodiment 1.

As shown in FIG. 38, various signals may be input to the control apparatus 100. The signals may include detection signals from the refrigerant temperature sensor SW1 and input signals input by a user manipulating the manipulation panel SW2.

The control apparatus 100 may perform various operations based on a detection signal from the refrigerant temperature sensor SW1 to detect the temperature of refrigerant just after the temperature and pressure of the refrigerant are raised by the compressor 52. Also, the control apparatus 100 may operate the cooling apparatus 6 based on the detected temperature of refrigerant to cool the auxiliary heat exchanger 55 and to control the quantity distributing device 83.

The quantity distributing device 83 may be configured to adjust a quantity flowing through the auxiliary heat exchanger 55 among refrigerant discharged from the compressor 52.

More specifically, as shown in FIG. 4B, if the auxiliary heat exchanger 55 is connected in series to the flow path in the condenser 53, the flow path selecting device 81 may be used as the quantity distributing device 83 of the current control method. The quantity distributing device 83 may be configured to adjust the bypass quantity Qb bypassing the auxiliary heat exchanger 55 and the radiation quantity Qc flowing through the auxiliary heat exchanger 55, among refrigerant discharged from the compressor 52 and passed through the first flow path 57.

Also, as shown in FIG. 6, if the auxiliary heat exchanger 55 is connected in parallel to the condenser 53, the flow path switching device 82 may be used as the quantity distributing device 83 of the current control method. The quantity distributing device 83 may be configured to adjust the condenser-side quantity Qv flowing through the condenser 53 and the radiation quantity Qc passing through the auxiliary heat exchanger 55, among refrigerant discharged from the compressor 52.

Successively, a control sequence of the clothes dryer D according to the current embodiment will be described with reference to FIG. 39.

If a user inputs a command for operating the clothes dryer D to the manipulation panel SW2, the control apparatus 100 may operate the heat pump apparatus 5, in operation 110.

If the heat pump apparatus 5 starts operating, the control apparatus 100 may control the quantity distributing device so that the total quantity Qt of refrigerant discharged from the compressor 52 becomes the bypass quantity Qb or the condenser-side quantity Qv, in operation 120.

Also, a first detected temperature Ts1 may be detected by the refrigerant temperature sensor SW1, in operation 130.

The control apparatus 100 may determine whether the first detected temperature Ts1 exceeds a first temperature T1 set to a higher temperature than a predetermined target temperature T0, based on the result of the detection by the refrigerant temperature sensor SW1, in operation 140.

If the control apparatus 100 determines that the first detected temperature Ts1 exceeds the first temperature T1, the control apparatus 100 may control the quantity distributing device to decrease the bypass quantity Qb or the condenser-side quantity Qv by a predetermined quantity ΔQ, and to increase the radiation quantity Qc flowing through the auxiliary heat exchanger 55 by the decreased quantity ΔQ, in operation 150. The first temperature T1 may correspond to the cooling start temperature in the aspects A and B of the embodiment 1.

The control apparatus 100 may operate the cooling apparatus 6, when performing the control operation, in operation 160. The control apparatus 100 may cool the auxiliary heat exchanger 55 with the cooling apparatus 6, until the temperature of the refrigerant becomes lower than the target temperature T0. The target temperature T0 may correspond to the cooling stop temperature in the aspects A and B in the embodiment 1.

Also, the control apparatus 100 may detect a second detected temperature Ts2 through the refrigerant temperature sensor SW1, in operation 170.

The control apparatus 100 may determine whether the second detected temperature Ts2 exceeds a second temperature T2 set to a higher temperature than the first temperature T1, based on the result of the detection by the refrigerant temperature sensor SW1, in operation 180. If the control apparatus 100 determines that the second detected temperature Ts2 exceeds the second temperature T2, the control apparatus 100 may control the quantity distributing device to again decrease the bypass quantity Qb or the condenser-side quantity Qv by the predetermined quantity ΔQ, and to further increase the radiation quantity Qc by the decreased quantity ΔQ, in operation 190.

Meanwhile, the control apparatus 100 may determine whether the second detected temperature Ts2 is lower than a third temperature T3 set to a lower temperature than the target temperature T0, based on the result of the detection by the refrigerant temperature sensor SW1, in operation 200. If the control apparatus 100 determines that the second detected temperature Ts2 is lower than the third temperature T3, the control apparatus 100 may control the quantity distributing device to decrease the radiation quantity Qc by the predetermined quantity ΔQ, and to increase the bypass quantity Qb or the condenser-side quantity Qv by the decreased quantity ΔQ, in operation 210.

Although not shown in the drawings, the control apparatus 100 may be configured to increase or decrease the compression capacity of the compressor 52, based on the result of detection by the refrigerant temperature sensor SW1. Also, the control apparatus 100 may control the cooling apparatus 6, the quantity distributing device, and the compressor 52 in combination to thereby maintain the temperature of refrigerant, further, the temperature of air flowing in the ventilation path 3 constant.

Embodiment 2

Successively, embodiment 2 will be described with reference to the drawings.

The current embodiment 2 is shown in FIGS. 10 to 18.

—Configuration of the Clothes Dryer—

Figure 10:
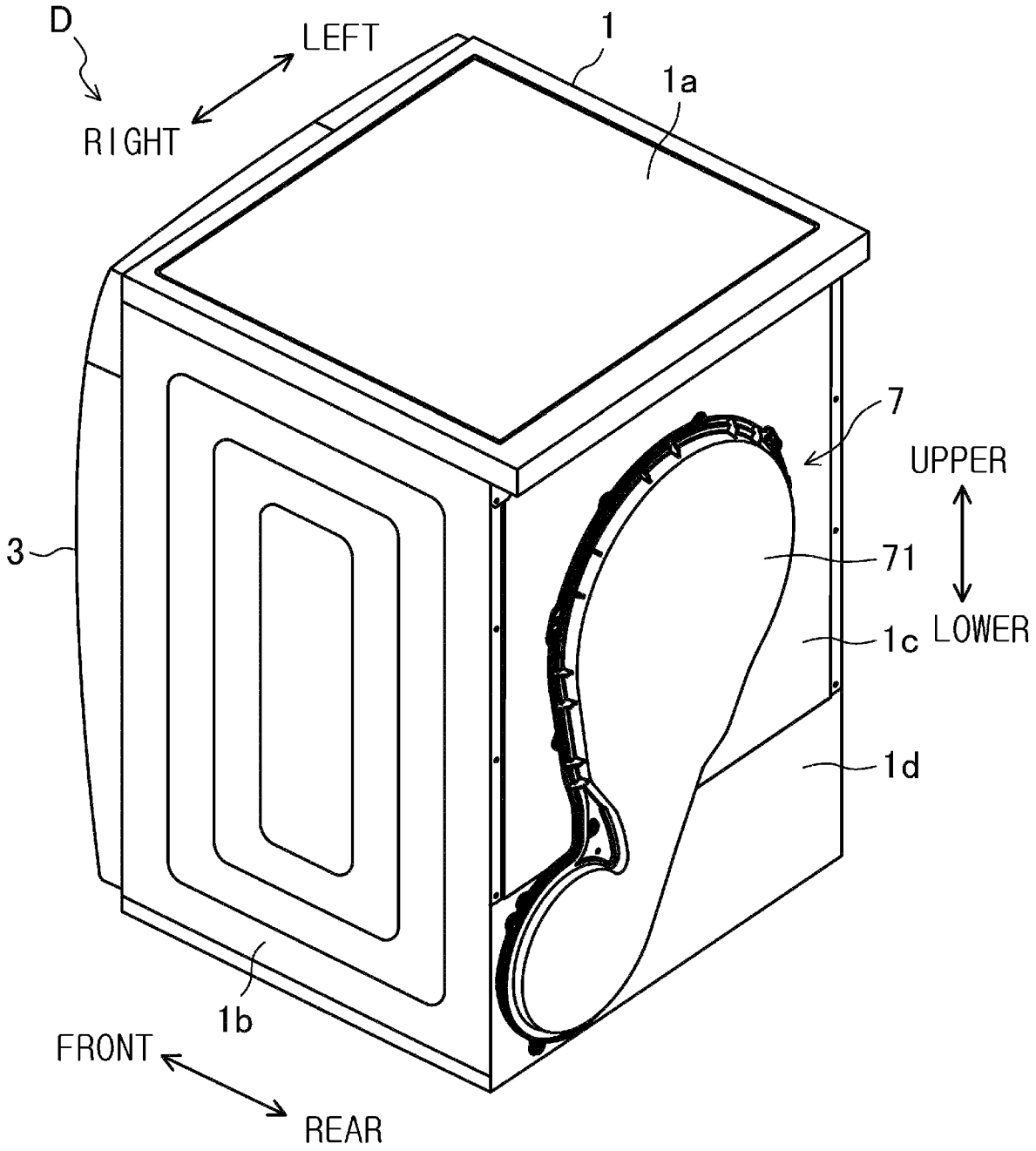
FIG. 10 is a perspective view of a clothes dryer according to embodiment 2, as seen from rear and above.
Figure 11:
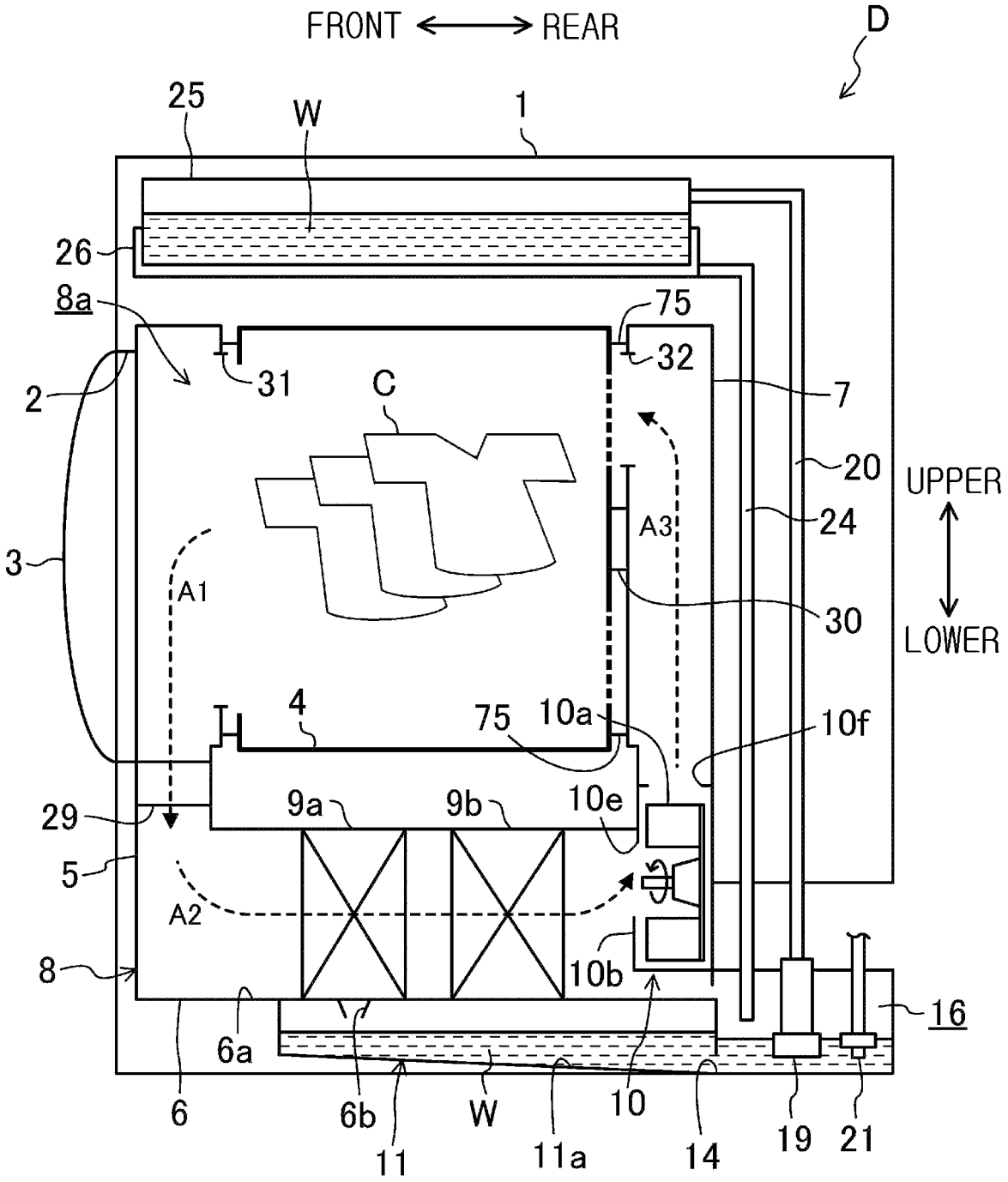
FIG. 11 is a view showing a schematic configuration of the clothes dryer according to the embodiment 2.

A clothes dryer D according to the embodiment 2 may include a housing 1 having the outer appearance of a nearly rectangular parallelepiped shape extending vertically. As shown in FIG. 10, the housing 1 may include side panels 1*b* disposed to face each other and extending vertically, a top panel 1*a* connecting the upper ends of the side panels 1*b* to each other, a base portion 1*d*, and a rear panel 1*c*. The base portion 1*d* may be configured to connect the lower ends of the side panels 1*b* to each other, and to extend upward from the rear lower ends of the side panels 1*b* to connect the rear lower portions of the side panels 1*b* to each other. The rear panel 1*c* may be disposed in the upper part of the rear portion of the housing 1 to connect the rear portions of the side panels 1*b*, the rear portion of the upper panel 1*a*, and the upper part of the base portion 1*d* to each other. Also, as shown in FIG. 11, in the upper area of the front plate of the housing 1, a clothes drop opening 2 may be formed in the shape of a nearly circle as seen from front, and a cover member 3 that is rotatable may open or close the clothes drop opening 2. Also, in the rear panel 1*c* and the base portion 1*d*, a blow duct 7 which will be described later may be installed.

As shown in FIG. 11, in the upper space of the inside of the housing 1, a drum 4 may be rotatably supported to connect to the clothes drop opening 2, and to accommodate clothes C as an object to be dried. Also, when the cover member 3 opens, clothes C may be accommodated in the drum 4 through the clothes drop opening 2.

Figure 13:
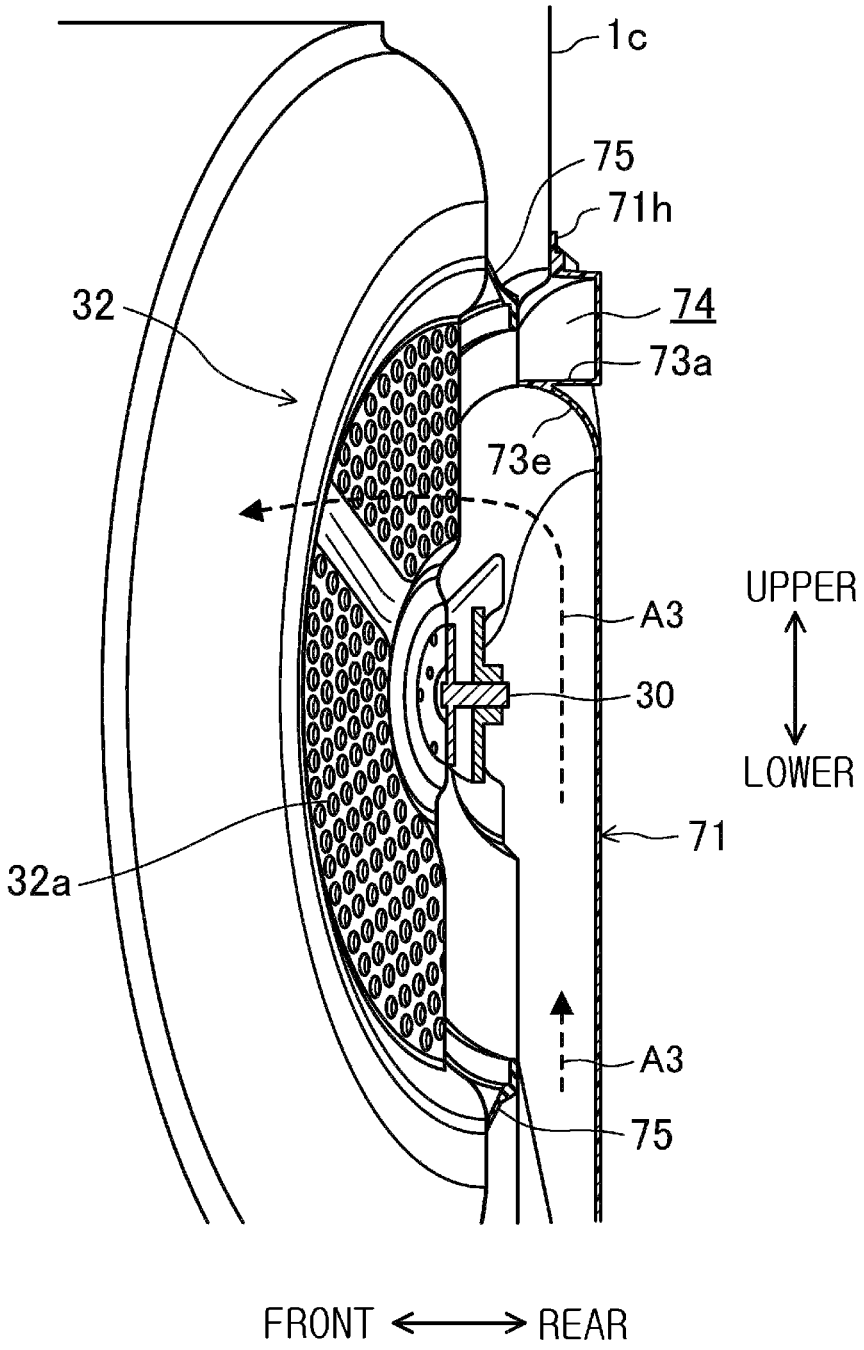
FIG. 13 is a broken sectional perspective view showing a connection portion between the blow duct and an air inlet for circulation.

The drum 4 may be in the shape of a cylinder with a bottom having a rotary shaft center disposed horizontally in the front-rear direction, and when the opening of the drum 4 faces the clothes drop opening 2, the center of the lower portion may be rotatably supported with respect to the side wall portion of the rear panel 1*c*, through a shaft 30, so that the drum 4 rotates with respect to the rotary shaft center (see FIG. 13).

The shaft 30 may be connected to a drum rotating motor (not shown) installed in the housing 1, and when the clothes dryer D operates, the drum rotating motor may be driven to rotate the drum 4 at predetermined speed. Also, the rotating motor may directly rotate the drum 4 through a belt (not shown).

In the drum 4, an air outlet 31 for discharging air for drying used in drying clothes may be connected to an air inlet 32 into which air for drying used to dry clothes C is introduced. A circulation duct 8 for circulating air for drying may be connected to the air outlet 32 and the air inlet 32, and a circulation ventilation path 8*a* may be formed by space in the circulation duct 8 and the drum 4.

The circulation duct 8 may be configured with an outward duct 5 having one end connected to the air outlet 31, a blow duct 7 having one end connected to the air inlet 32, and a duct 6 for heating and drying connecting the other end of the outward duct 5 to the other end of the blow duct 7. Also, a lint filter 29 may be installed between the ducts 5 and 6 to collect lint come out from clothes C, and discharge the collected lint to the outside as necessary.

More specifically, the outward duct 5 may extend vertically along the front side of the housing 1, and the upper end of the outward duct 5 may be sealed with and connected to the air outlet 31. The duct 6 for heating and drying may extend in the front-rear direction in the lower side space of the housing 1, and the front end of the duct 6 for heating and drying may be sealed with and connected to the lower end of the outward duct 5. The blow duct 7 may extend vertically along the rear panel 1*c* of the housing 1, wherein the lower end of the blow duct 7 is sealed with and connected to the lower end of the duct 6 for heating and drying through a fan casing 10*b* which will be described later, and the top end of the blow duct 7 is sealed with and connected to the rear panel 1*c*. As shown in FIG. 13, a round hole portion 32*a* having a plurality of round holes that open in the front-rear direction may be disposed in the air inlet 32, and air for drying may flow into the drum 4 from the blow duct 7 through the round hole portion 32*a* (see arrows A3). The rear panel 1*a* and the outer circumferential portion of the air inlet 32 may be rotatable, and sealed with and connected to each other, by a sealing room 75.

Referring again to FIG. 11, in the circulation ventilation path 8*a*, an evaporator 9*a* configured with a heat exchanger as a cooling apparatus for cooling air to dehumidify the air, and a condenser as a heating apparatus for heating air passed through the cooling apparatus may be installed. The evaporator 9*a* may be disposed in the upstream side (front side) of the circulation ventilation path 8*a*, and a condenser 9*b* may be disposed in the downstream side (rear side) of the evaporator 9*a* and spaced a predetermined distance from the evaporator 9*a*. Also, the clothes dryer D may include a compressor (not shown) and a decompressor (not shown) in the housing 1, and the compressor and the decompressor may be respectively connected to the evaporator 9*a* and the condenser 9*b* through pipes to form a heat pump cycle.

Below the duct 6 for heating and drying, an accommodation dish portion 11 may be installed to collect and store condensed water W produced by the evaporator 9*a*. The accommodation dish portion 11 may open upward, and the opening of the accommodation dish portion 11 may be closed by a cover base 6*a* to partition the accommodation dish portion 11 from the duct 6 for heating and drying.

Since the cover base 6*a* is located immediately below the evaporator 9*a*, the cover base 6*a* may have a drain hole 6*a* as a communication passage opening vertically, and condensed water W produced when the evaporator 9*a* dehumidifies air for drying in the circulation ventilation path 8*a* may be discharged to the accommodation dish portion 11 through the drain hole 6*b*. Herein, since the cover base 6*a* is inclined downward toward the drain hole 6*b* below the evaporator 9*a*, the cover base 6*a* can induce condensed water W falling on the periphery of the drain hole 6*a* to enter the drain hole 6*b*.

The accommodation dish portion 11 may collect condensed water W through the drain hole 6*b*. The lower surface 11*a* of the accommodation dish portion 11 may be inclined downward so that the collected condensed water W can flow toward the rear direction. Also, the rear end of the accommodation dish portion 11 may be connected to a communication water channel 14 such that the communication water channel 14 is integrated into the accommodation dish portion 11. The rear end of the communication water channel 14 may be connected to a pump room 16 to accommodate condensed water W discharged from the communication water channel 14, wherein the communication water channel 14 is integrated into the pump room 16.

In the pump room 16, a pump 19 to deliver condensed water, and a water level sensor 21 to detect a water level in the pump room 16 may be disposed. The outlet of the pump 19 may be connected to one end of an inhale hose 20, and the other end of the inhale hose 20 may be connected to a separate water reserve tank 25. Accordingly, water W drawn from the pump room 16 may be delivered into the water reserve tank 25.

The water reserve tank 25 may be disposed in an accommodation dish portion 26 for water reserve tank formed in the shape of an accommodation dish, and condensed water W flowing over the water reserve tank 25 may be accommodated in the accommodation dish portion 26 for water reserve tank. The lower portion of the accommodation dish portion 26 for water reserve tank may be connected to one end of a water leakage preventing hose 24. The other end of the water leakage preventing hose 24 may be connected to the pump room 16, and condensed water W flowing over the water reserve tank 25 may return to the pump room 16 through the water leakage preventing hose 24.

(Configuration of Fan)

Figure 12:
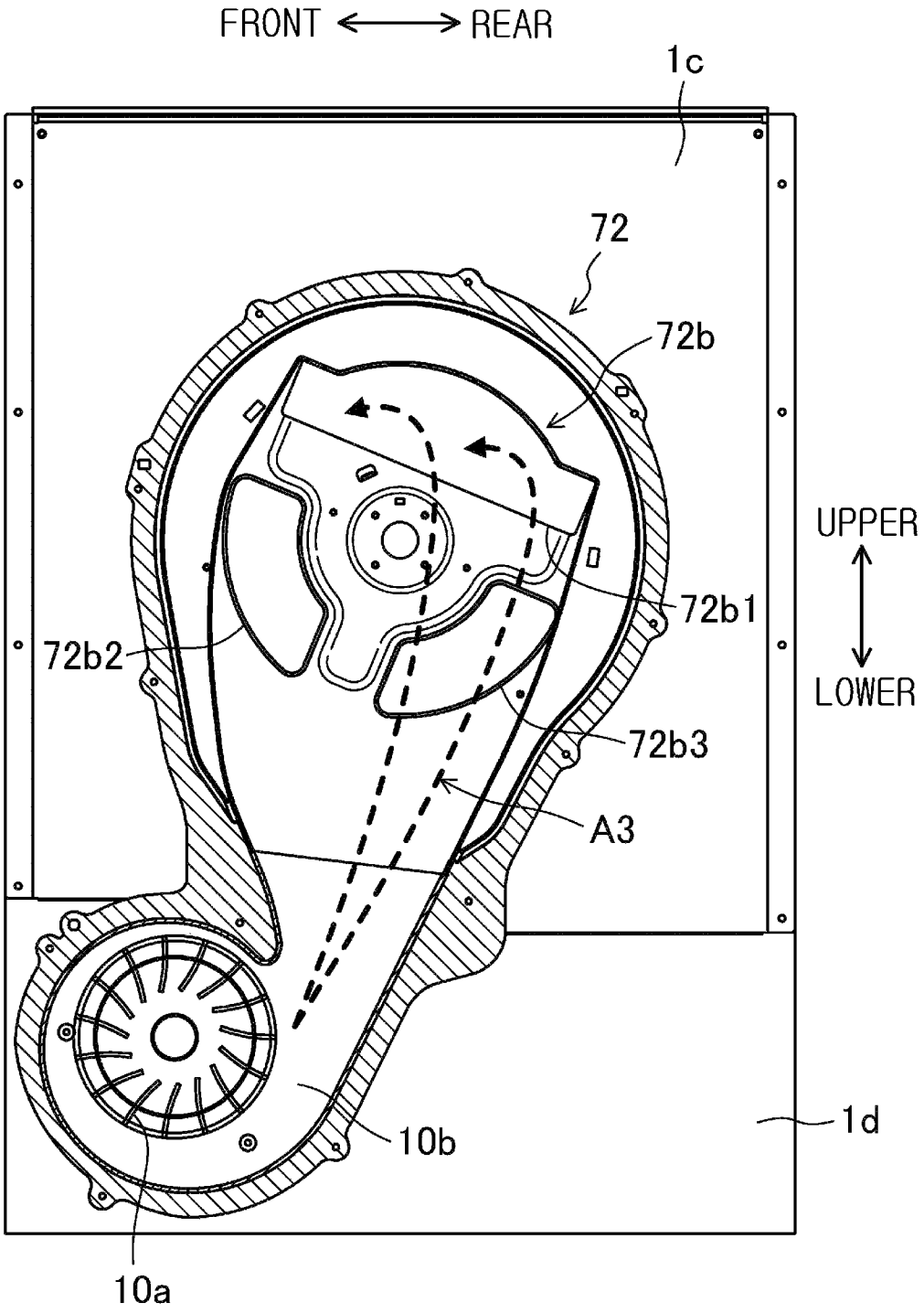
FIG. 12 is a conceptual view for describing the flow of air in a blow duct according to the embodiment 2.

A fan 10 may be installed at a connection portion (the lower rear space of the housing 1) of the duct 6 for heating and drying and the blow duct 7. More specifically, as shown in FIGS. 11 and 12, the fan 10 may include the fan casing 10*b*, and a cylindrical impeller 10*a* rotatably supported on the fan casing 10*b* and having a plurality of blades arranged along the circumference. The fan 10 may be a centrifugal fan including, for example, a forward-curved blade fan (sirocco fan).

Figure 16:
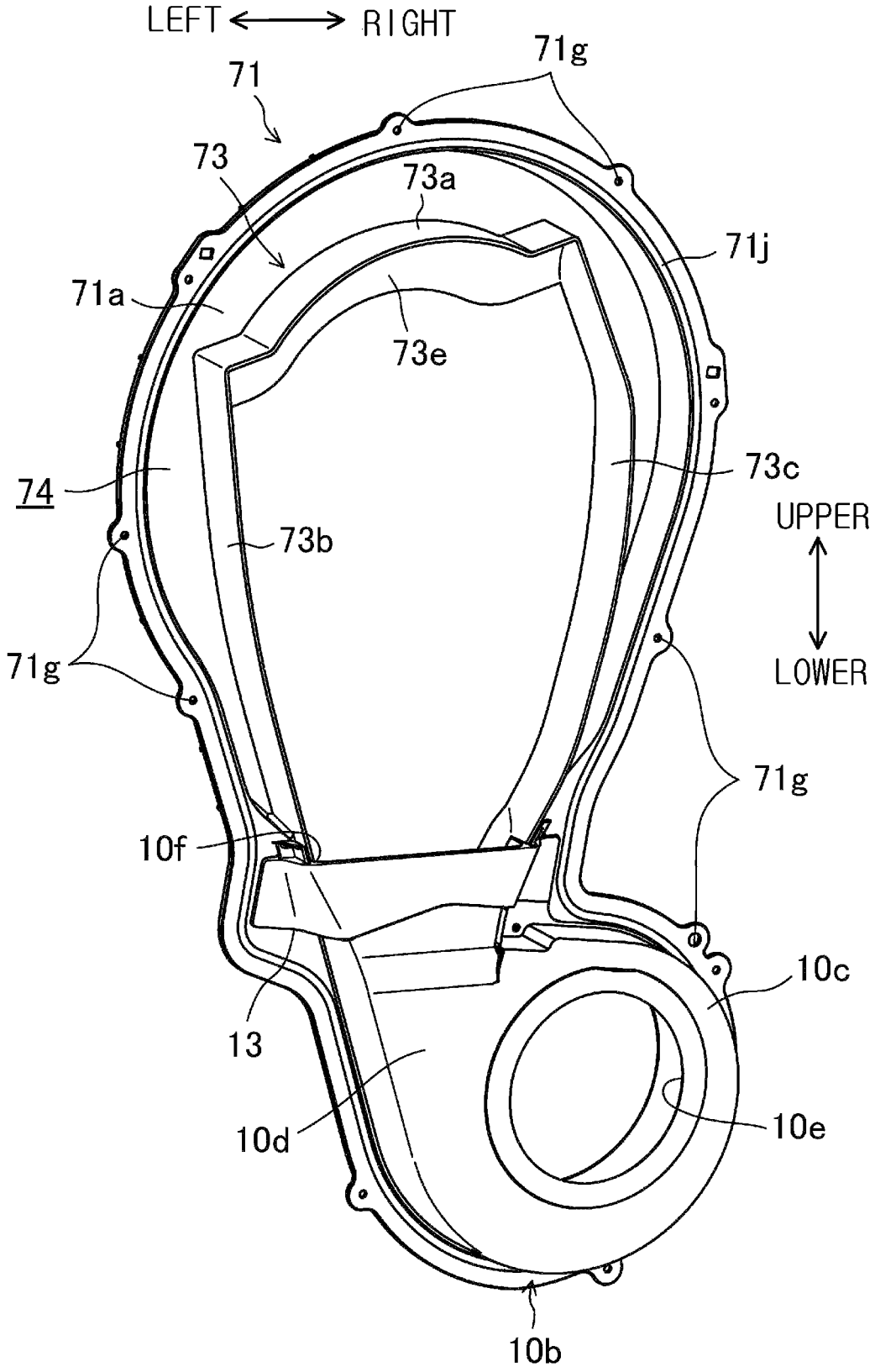
FIG. 16 is a perspective view showing a state in which a fan casing is installed in the outer cover of the blow duct.

As shown in FIG. 16, the fan casing 10*b* may include a base cover portion 10*c* configured to cover the outer portion of the impeller 10*a*, and a connection cover portion 10*d* integrated into the base cover portion 10*c*, and extending upward from the left of the base cover portion 10*c*. The rear portions of the base cover portion 10*c* and the connection cover portion 10*d* may open, and the fan casing 10*b* may be assembled with an outer cover 71 of the blow duct 7 which will be described later. Also, the fan casing 10*b* may be sealed with and connected to the rear panel 1*c* by a sealing room 13, and the connection cover portion 10*d* may be sealed with and connected to the base portion 1*d* by another sealing room (not shown). In this state, an exhaust nozzle 10*f* surrounding the impeller 10*a* by the outer cover 71 and the base cover portion 10*c*, and opening toward a direction that is vertical to the rotation axis of the impeller 10*a* by the outer cover 71 and the connection cover portion 10*d* may be formed.

In the front portion of the base cover portion 10*c*, an inhale opening 10*e* opening toward a direction that is parallel to the rotation axis of the impeller 10*a* may be formed in the shape of a circle, and the inhale opening 10*e* may be sealed with and connected to the rear end of the duct 6 for heating and drying.

Accordingly, air for drying inhaled into the fan 10 from the duct 6 for heating and drying through the inhale opening 10*e* may be delivered to the blow duct 7 through the exhaust nozzle 10*f* that is located vertically to the rotation axis of the impeller 10*a*, by rotation of the impeller 10*a* (see the arrows A3 of FIGS. 11 and 12).

(Configuration of the Blow Duct)

Hereinafter, the configuration of the blow duct 7 will be described in detail.

Figure 17:
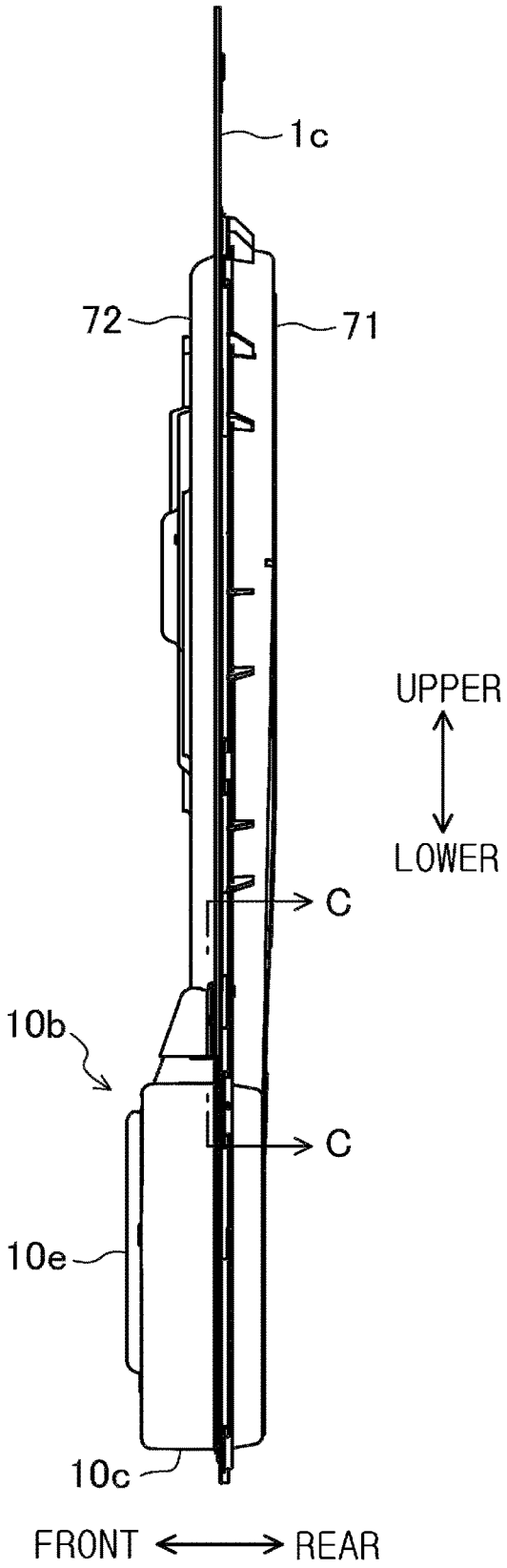
FIG. 17 is a side view showing a state in which a fan casing is installed in the outer cover of the blow duct.

As shown in FIGS. 10 and 17, in the rear panel 1*c*, a concave portion 72 that is concave toward the front direction may be formed, and the blow duct 7 may be configured with the concave portion 72, and the outer cover 71 extending vertically along the rear panel 1*c* on the outer portion of the rear panel 1*c*.

More specifically, as shown in FIG. 17, the lower end of the concave portion 72 of the rear panel 1*c* may be connected to the exhaust nozzle 10*f* of the fan casing 10*b*, and the concave portion 72 may be concave upward along the rear panel 1*c* from the lower end so that air for drying delivered from the exhaust nozzle 10*f* of the fan casing 10*b* enters the air inlet 32 of the drum 32.

Also, in the concave portion 72 of the rear panel 1*c*, as shown in FIG. 12, a ventilation opening 72*a* may be formed along the shape of the air inlet 32 at a connection portion of the concave portion 72 and the air inlet 32. The ventilation opening 72*b* may include a upper ventilation opening 72*b*1 opening along the upper (downstream) edge of the round hole portion 32*a*, a right ventilation opening 72*b*2 opening along the right outer (downstream) edge of the round hole portion 32*a*, and a left ventilation opening 73*b*3 opening along the left outer edge of the round hole portion 32*a*. However, the shape of the ventilation opening 72*b* is not limited to the shape shown in FIG. 12. For example, the ventilation opening 72*b* may have four openings or more.

Figure 14:
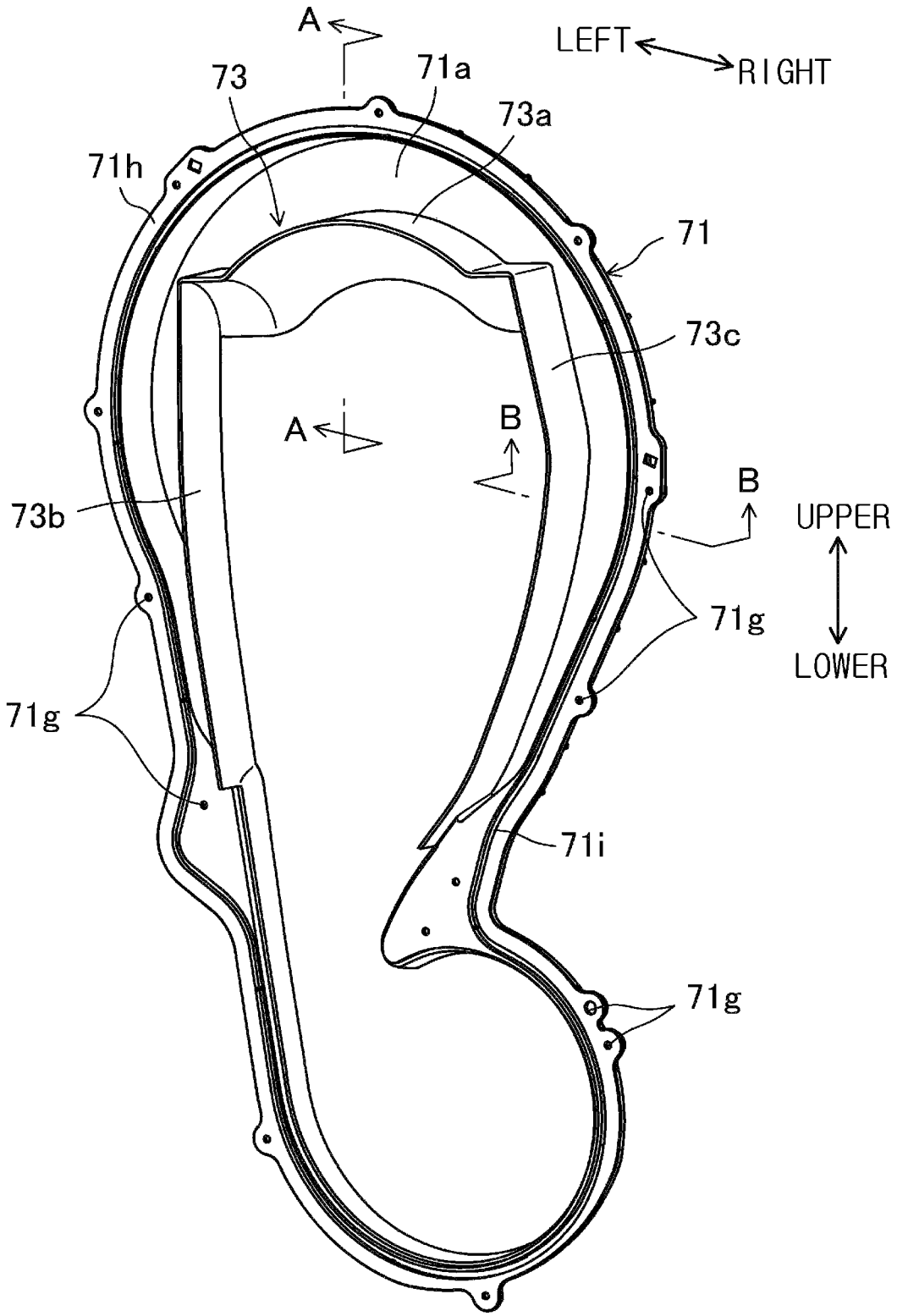
FIG. 14 is a perspective view showing an outer cover of the blow duct.

As shown in FIG. 14, the outer cover 71 may include an outer cover main body 71*a* formed in the shape of a box which is concave toward the rear direction and whose front side opens, and a connection plate portion 71*h* to install the outer cover 71 in the rear panel 1*c* and the base portion 1*d*. The connection plate portion 71*h* may extend outward along the rear panel 1*c* and the base portion 1*d* from the circumferential end of the outer cover main body 71*a*, in such a way to be integrated into the outer cover main body 71*a*, wherein a plurality of installation holes 71*g* opening in the front-rear direction are formed at predetermined intervals along the entire circumference of the connection plate portion 71*h*. Also, in the connection plate portion 71*h*, a groove portion 71*i* may be formed along the entire circumference of the connection plate portion 71*h*, in the inner area from the installation holes 71*g*, and a seal portion 71*j* for sealing between the outer cover 71 and the rear panel 1*c* or the base portion 1*d* may be inserted into the groove portion 71*i* (see FIG. 15).

An air guide 73 for guiding air for drying delivered from the fan 10 to the blow duct 7 to enter the ventilation opening 72*b* formed in the concave portion 72 of the rear panel 1*c* may be integrated with and installed in the outer cover main body 71*a*. For example, the outer cover 71 may be a resin molded product, and the air guide 73 may be formed by integrally molding with the outer cover 71.

(Configuration of the Air Guide)

Hereinafter, the configuration of the air guide 73 will be described in detail. In the following description of "Configuration of the Air Guide", it is assumed that the outer cover 71 is connected to the rear panel 1*c*.

As shown in FIG. 14, the air guide 73 may include a guide portion 73*a*, and induction portions 73*b* and 73*c* integrated with the outer cover main body 71*a* in such a way to protrude forward from the outer cover main body 71.

Figure 15A:
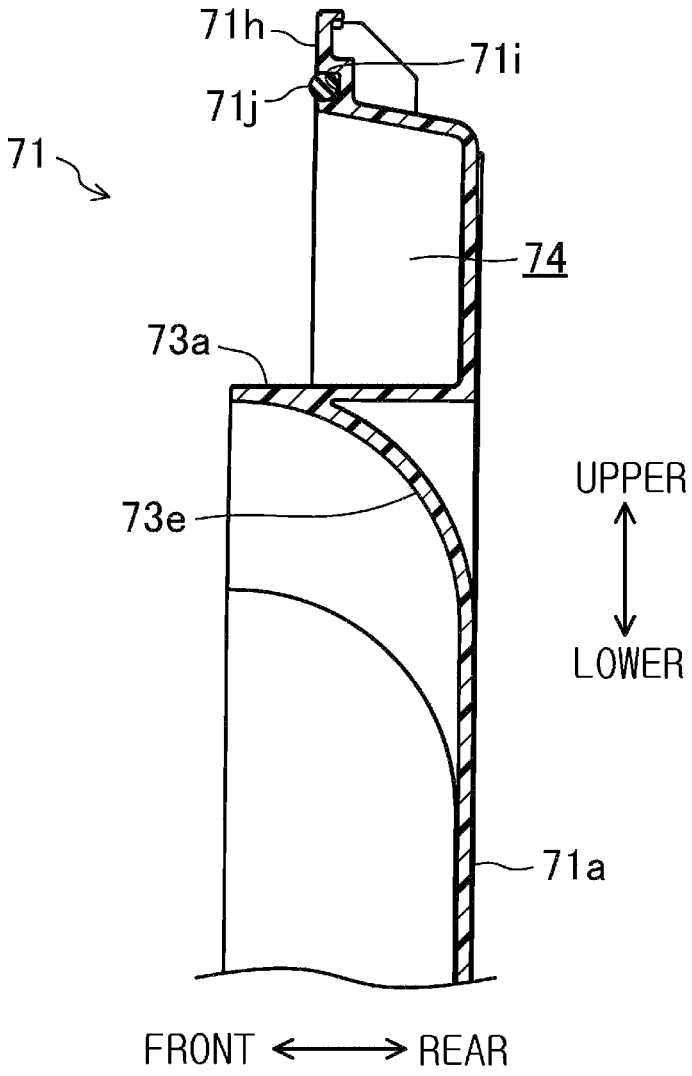
FIG. 15A is a cross-sectional view cut along a line A-A of FIG. 14.

The guide portion 73*a* may be integrated with the outer cover main body 71*a*, and extend along the upper (downstream side) edge of the ventilation opening 72*b* formed in the concave portion 72 of the rear panel 1*c*, that is, along the upper edge of the upper ventilation opening 72*b*1 of the ventilation opening 72*b*. More specifically, as shown in FIGS. 13 and 15A, the guide portion 73*a* may have an inclined surface 73*e* extending in the rear direction (direction spaced away from the upper edge of the upper ventilation opening 72*b*1), and inclined downward (upstream direction). The inclined surface 73*e* may be a curved surface of a circular arc shape which is concave in the rear direction and in the up direction (direction spaced away from the circulation ventilation path 8*a*). However, the inclined surface 73*e* is not limited to a curved surface of a circular arc. For example, the inclined surface 73*e* may be a flat surface inclined downward toward the rear direction.

Figure 15B:
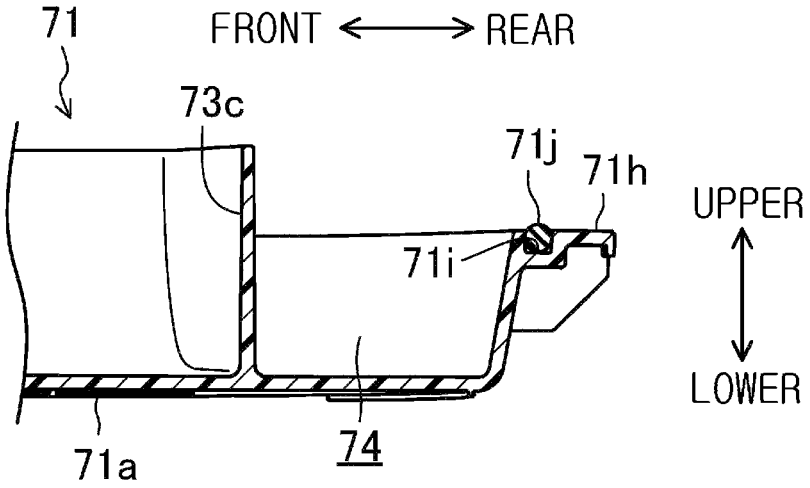
FIG. 15B is a cross-sectional view cut along a line B-B of FIG. 14.

As shown in FIGS. 14 and 15B, the induction portions 73*b* and 73*c* may be integrated into the guide portion 73*a*, in such a way to extend toward the front direction from the surface of the outer cover main body 71*a*, and also to extend to a connection portion with the exhaust nozzle 10*f* of the fan casing 10*b* from both ends of the guide portion 73*a*. Also, space 74 (air gap) may be formed between the induction portions 73*b* and 73*c* and the upper, lower, left, and right side walls of the outer cover main body 71*a*. By forming the space 74, it is possible to prevent noise generated in the blow duct 7 from leaking out through the upper, lower, left, and right side walls of the blow duct 7. Also, since air for drying does not directly contact the upper, lower, left, and right side walls of the outer cover main body 71*a*, heat from the air for drying may not directly contact outside air through the outer wall, thereby acquiring the insulating effect. Also, an insulation soundproofing material (not shown) may be attached on the entire rear surface (rear end surface) of the outer cover main body 71*a*.

Figure 18:
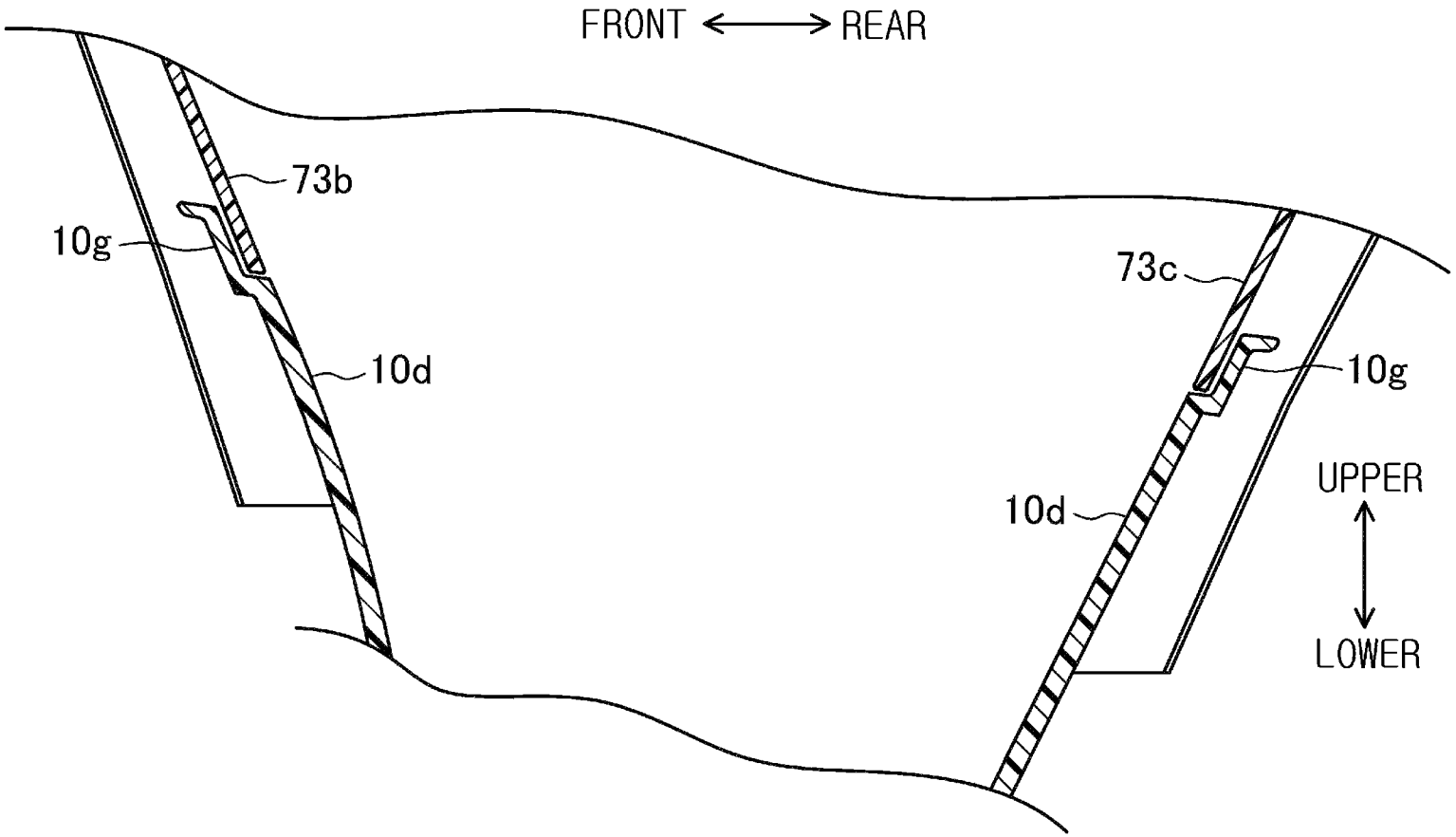
FIG. 18 is a cross-sectional view cut along a line C-C of FIG. 17.

Also, as shown in FIG. 18, the lower ends of the induction portions 73*b* and 73*c* and the upper end 10*g* of the connection cover portion 10*d* of the fan casing 10*d* may have the same height at the inner surfaces (surfaces toward the ventilation path), in the state which the outer cover 71 is connected to the fan casing 10*b*. More specifically, the upper end 10*g* of the connection cover portion 10*d* may be concave outward by the thickness (including a margin) of the induction portions 73*b* and 73*c*, and the lower ends of the induction portions 73*b* and 73*c* may be inserted into and coupled with the concave area of the connection cover portion 10*d*.

By configuring the air guide 73 in this way, air for drying (see the arrow A3 of FIG. 13) delivered from the fan 10 to the blow duct 7 may be induced toward the air inlet 32 by the induction portions 73*b* and 73*c* of the air guide 73, and then flow along the inclined surface 73*e* of the guide portion 73*a* to be induced into the round hole portion 32*a* of the air inlet 32 and the ventilation opening 72*b* formed in the concave portion 72 of the rear panel 1*c*. Accordingly, it is possible to suppress the generation of swirling flow of air for drying in the blow duct 7, thereby efficiently delivering air for drying into the drum. That is, it is possible to reduce pressure loss in the ventilation path (circulation ventilation path 8*a*) in the blow duct 7.

Also, since the inner surfaces (surfaces toward the circulation ventilation path 8*a*) of the lower ends of the induction portions 73*a* and 73*c*, and the inner surface (surface toward the circulation ventilation path 8*a*) of the upper end 10*g* of the connection cover portion 10*d* of the fan casing 10*b* are flat when the outer cover 71 is connected to the fan casing 10*b*, a smooth flow of air may be made at the connection portion of the connection cover portion 10*d* and the induction portions 73*b* and 73*c*, thereby suppressing the generation of noise, while reducing pressure loss.

Accordingly, the clothes dryer D can improve the performance, compared to the typical configurations, in that it can reduce drying time, reduce noise, and save energy with low cost.

—Operation of the Clothes Dryer—

Now, the operation of the clothes dryer D according to the current embodiment 3 will be described.

First, if the clothes dryer D starts operating, the drum rotating motor, the fan 10, and the heat pump system may operate. If the fan 10 operates, the upstream side (between the fan 10 and the condenser 9*b*) of the fan 10 in the circulation ventilation path 8*a* may become negative pressure, and the downstream side (between the fan 10 and the air inlet 32) of the fan 10 may become positive pressure so that a pressure difference is made. For example, the pressure of the upstream side of the fan 10 may become lower than atmospheric pressure by 300 Pa or more. By the pressure difference, air in the drum 4 may circulate in the circulation ventilation path 8*a*.

More specifically, as represented by arrows A1 and A2 of FIG. 11, air for drying in the drum 4 may enter the outward duct 5 through the air outlet 31, and flow downward in the front space of the housing 1 to then enter the duct 6 for heating and drying.

Also, as represented by the arrow A2 of FIG. 11, air entered the duct 6 for heating and drying may flow toward the rear direction along the duct 6 for heating and drying, in the lower space of the housing 1. Since the evaporator 9*a* and the condenser 9*b* of the heat pump system are arranged sequentially toward the downstream side in the duct 6 for heating and drying, air for drying may be cooled and dehumidified by the evaporator 9*a* and then heated by the condenser 9*b* to be adjusted to a condition suitable for drying clothes C, when passing through the duct 6 for heating and drying.

Since the inhale opening 10*e* and the exhaust nozzle 10*f* of the fan 10 face each other in the duct 6 for heating and drying and the blow duct 7, as represented by the arrows A2 and A3 of FIG. 11, the air for drying passed through the duct 6 for heating and drying may pass through the fan 10 and then enter the blow duct 7. Also, as represented by the arrows A3 of FIG. 11, the air for drying entered the blow duct 7 may flow upward along the blow duct 7 in the rear space of the housing 1, and then enter the drum 4 through the air inlet 32. The flow of air in the blow duct 7 has been described above in the "Configuration of the Air Guide", and accordingly, detailed descriptions thereof will be omitted.

By repeating the above-described circulation process, the air for drying may be maintained at a predetermined humidity and a predetermined temperature while the clothes dryer D operates, thereby drying clothes C in the drum 4.

Embodiment 3

Figure 19:
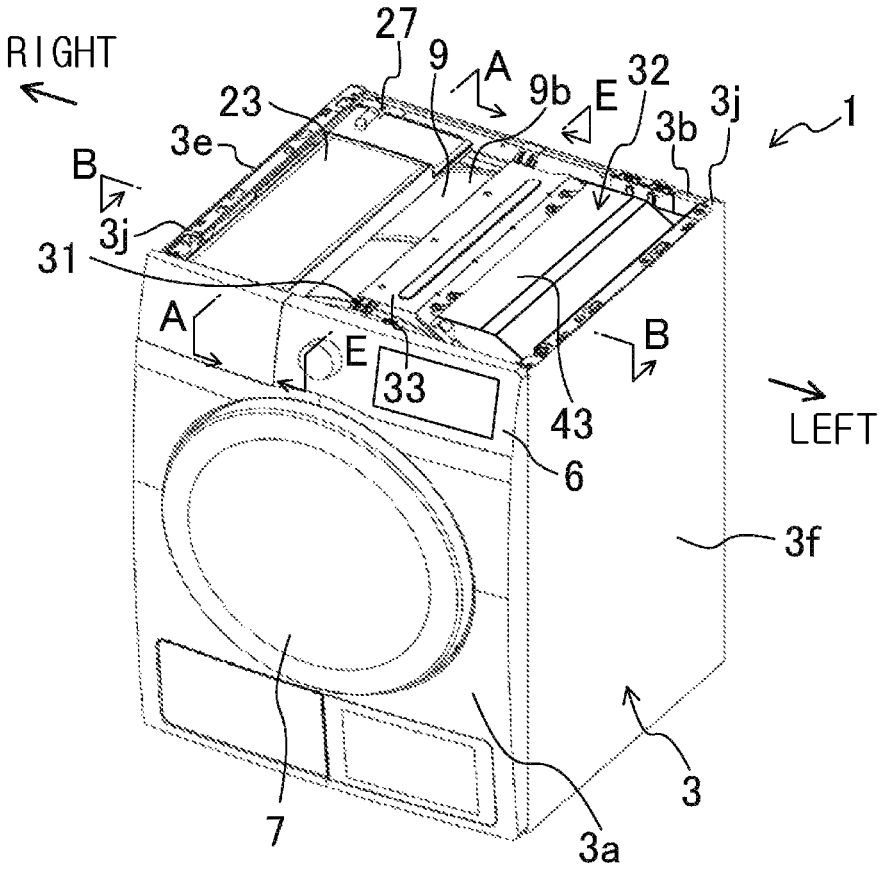
FIG. 19 is a perspective view of a dryer according to aspect A of embodiment 3 of the present disclosure, as seen from front and side, when the top plate of the dryer is removed.
Figure 37:
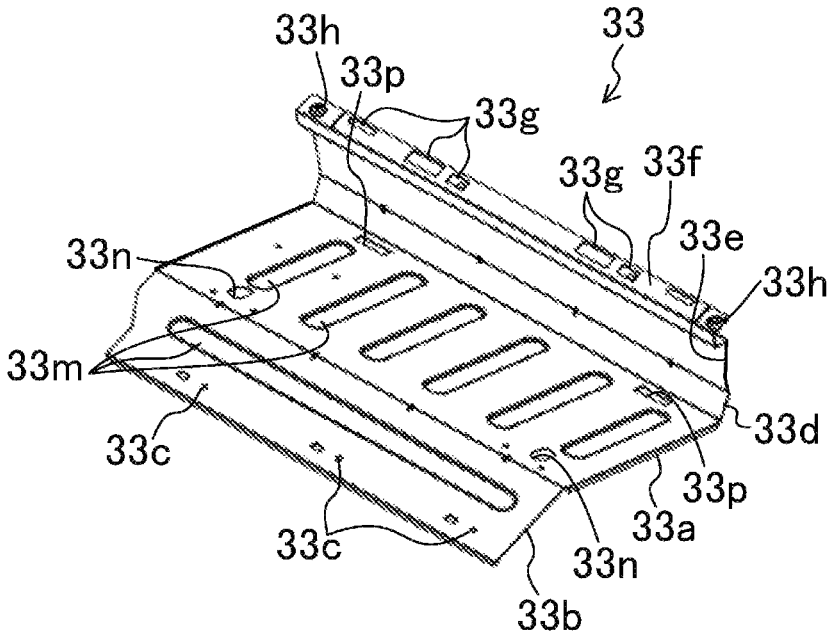
FIG. 37 is a view corresponding to FIG. 28 according to aspect F of the embodiment 3.

Finally, embodiment 3 will be described with reference to drawings, below. The current embodiment 3 is shown in FIGS. 19 and 37.

(Aspect A of Embodiment 3)

Figure 21:
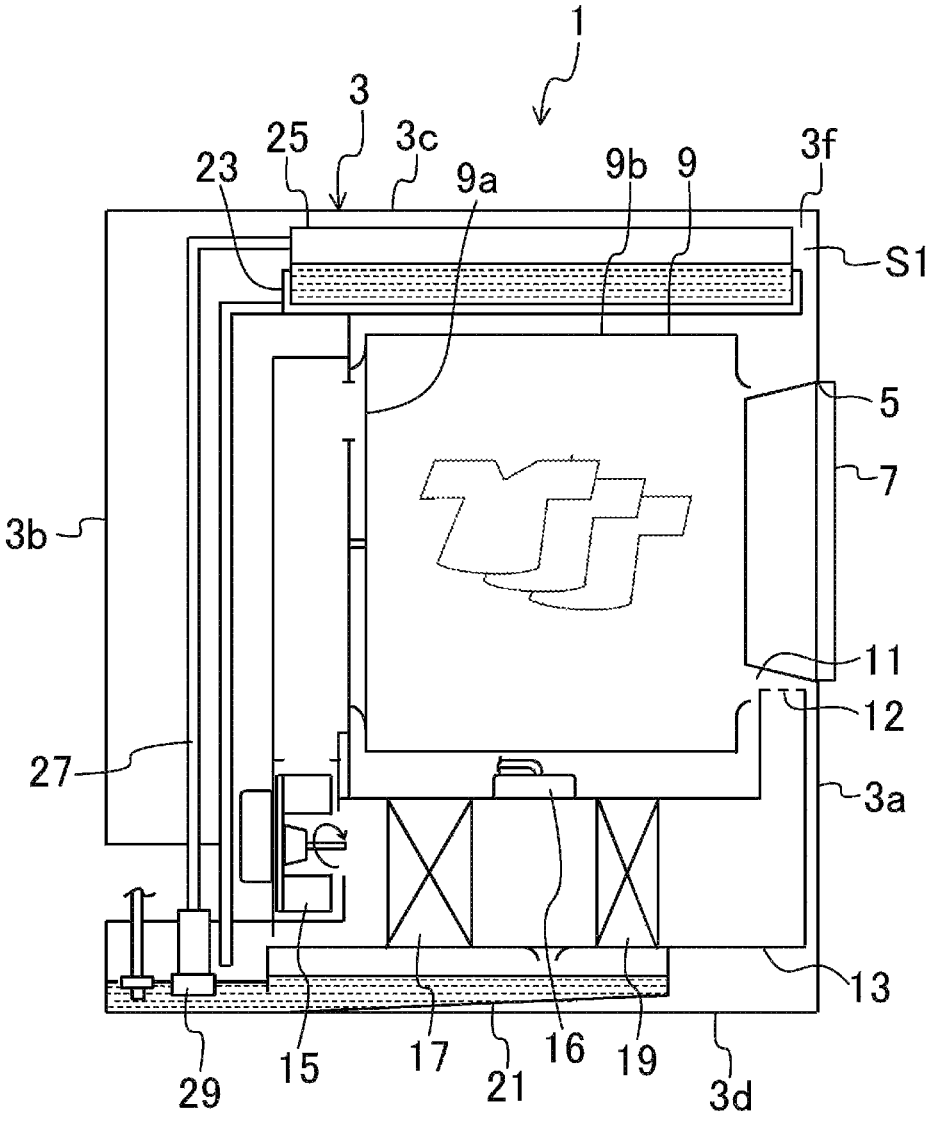
FIG. 21 is a schematic cross-sectional view cut along a line A-A of FIG. 19.
Figure 22:
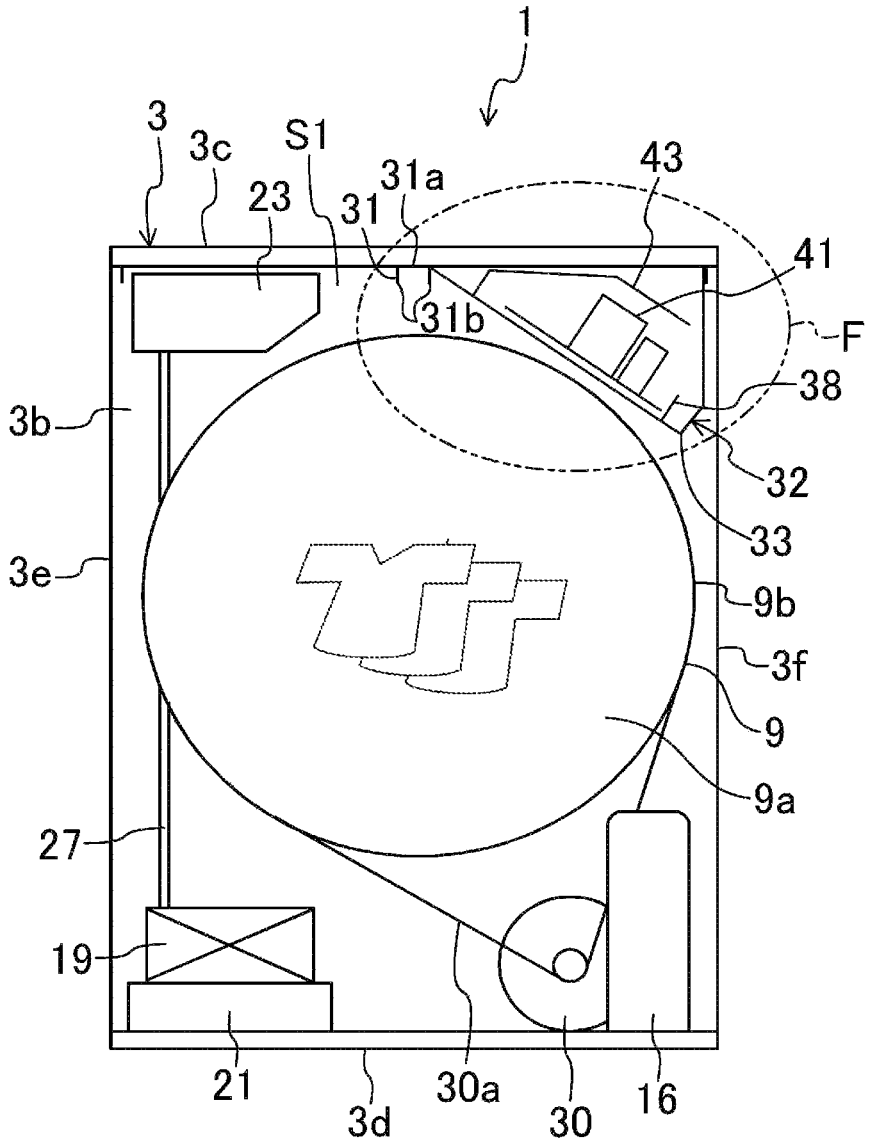
FIG. 22 is a schematic cross-sectional view cut along a line B-B of FIG. 19.
Figure 23:
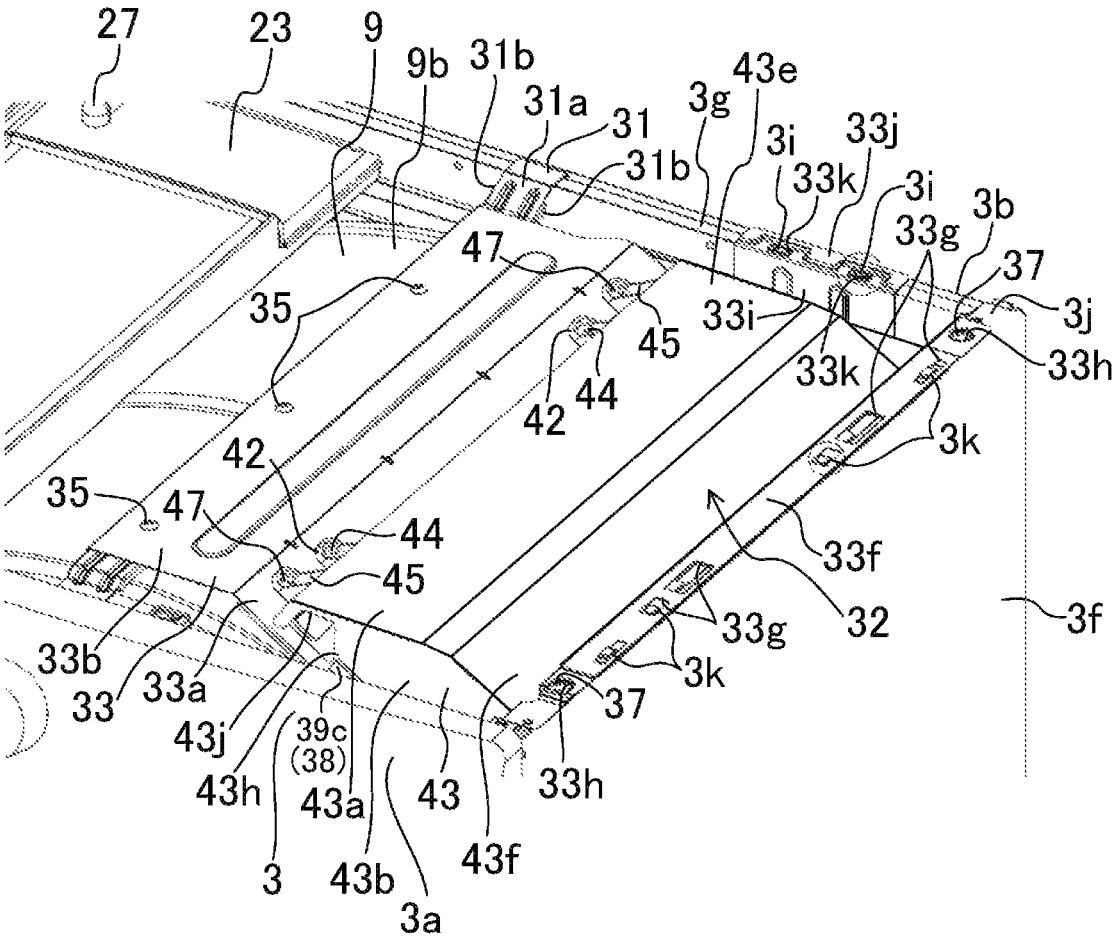
FIG. 23 is an enlarged view of FIG. 19, showing the peripheral portion of the control circuit unit.
Figure 24:
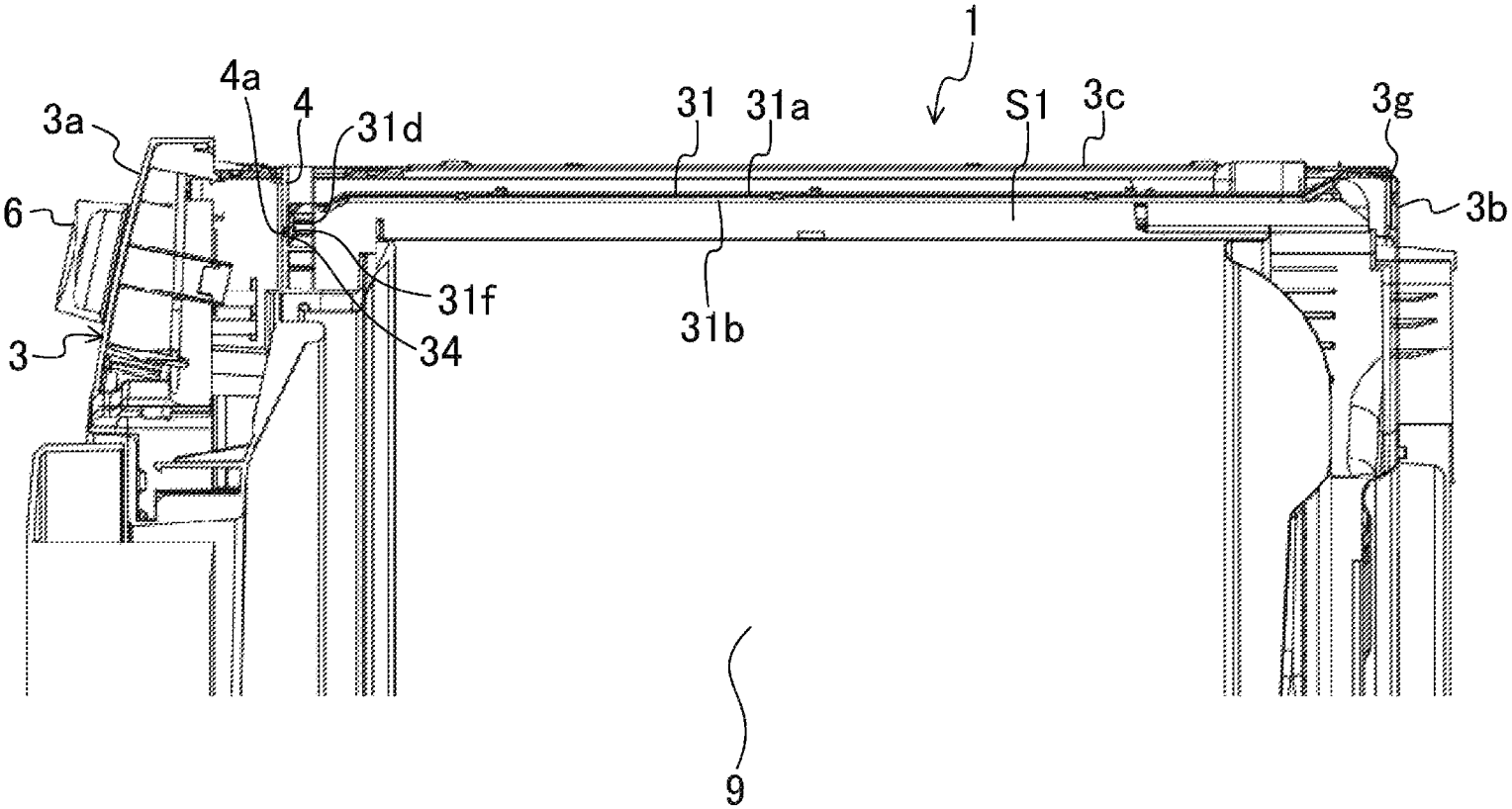
FIG. 24 is a cross-sectional view cut along a line E-E of FIG. 19, showing the upper portion of the dryer.
Figure 25:
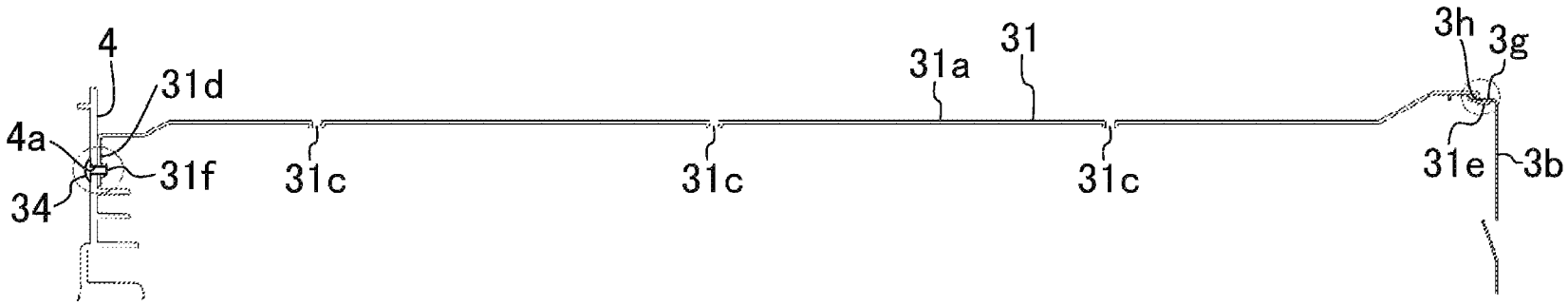
FIG. 25 is an enlarged cross-sectional view corresponding to FIG. 24, showing the peripheral portion of a reinforcing member, when the top plate is removed.
Figure 26:
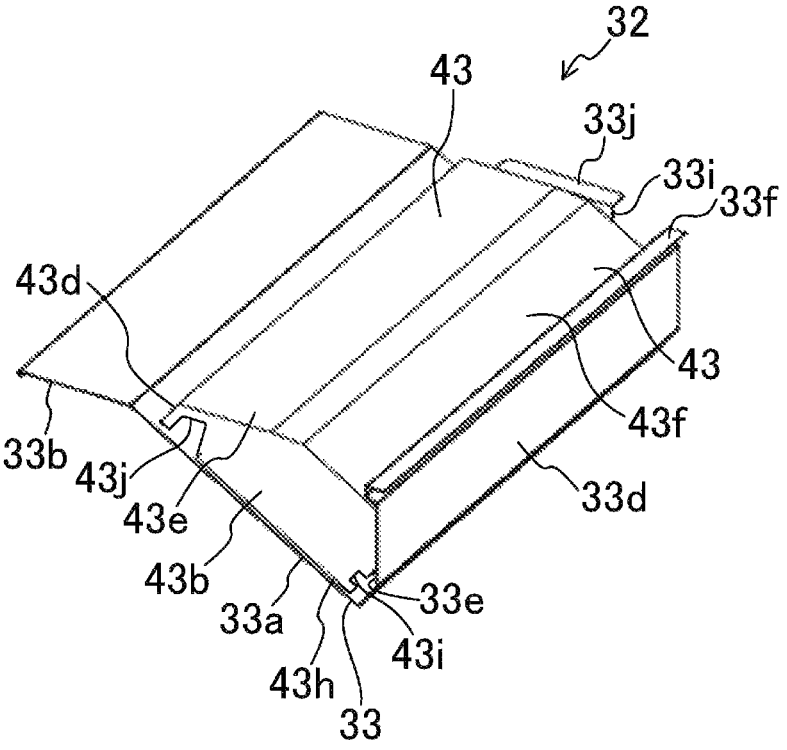
FIG. 26 is a schematic perspective view of a support member and a cover member.
Figure 27:
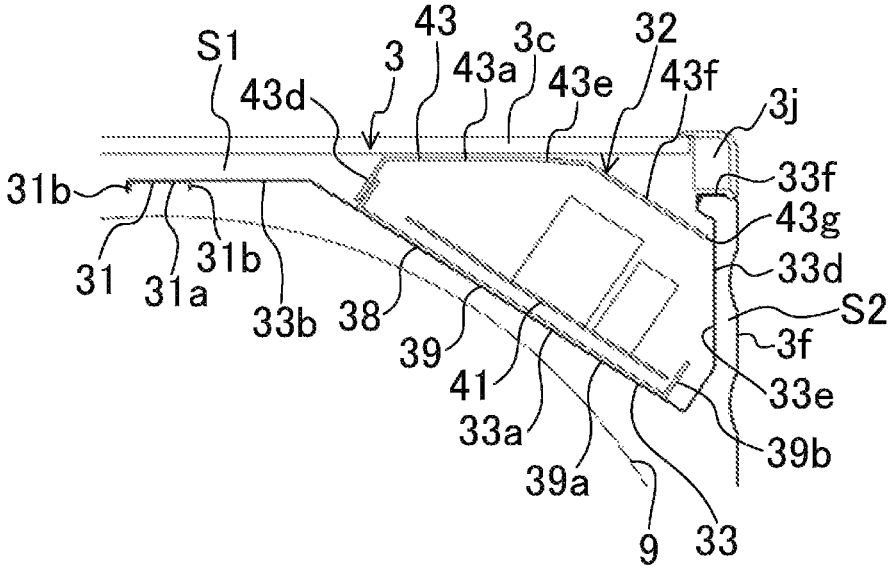
FIG. 27 is an enlarged cross-sectional view showing an area F of FIG. 22.

FIGS. 19 to 22 show a dryer 1 according to aspect A of embodiment 3. The dryer 1 may include a housing 3 composed of a front plate 3*a*, a rear plate 3*b*, a top plate 3*c*, a bottom plate 3*d*, and a pair of side plates 3*e* and 3*f*, and formed in the shape of a nearly rectangular parallelepiped extending vertically. The rear plate 3*b* and the side plates 3*e* and 3*f* may be formed separately, and then assembled to have a section of an inverted "⊏" shape as seen from rear, or may be formed as one body whose section has an inverted "⊏" shape. In the following description, for convenience of description, a right side as seen toward the front plate 3*a* from the rear plate 3*b* will be referred to as a "right side", and a left side as seen toward the front plate 3*a* from the rear plate 3*b* will be referred to as a "left side". Also, the right one of the side plates 3*e* and 3*f* will be referred to as a side plate 3*e*, and the left one will be referred to as a side plate 3*f*. In the front plate 3*a*, a drop opening 5 may open to put and take an object to be dried, such as clothes or blankets, and the drop opening 5 may be opened or closed by the door 7. Above the drop opening 5 of the front plate 3*a*, a manipulation and display portion 6 may be provided. In the housing 3, a drum 9 configured with a lower portion 9*a* and a side portion 9*b* and formed in the shape of a cylinder with a bottom may be rotatably supported, wherein the drum 9 opens toward the drop opening 5. An air supply opening (not shown) for supplying air may be formed in the lower portion 9*a* of the drum 9, and an exhaust opening 11 may be formed in the opening of the drum 9. Also, in the lower plate 3*d* of the housing 3, a reinforcing plate 4 may stand vertically in front of the drum 9 such that the surface of the reinforcing plate 4 faces the front direction, as shown in FIGS. 24 and 25, and a coupling hole 4*a* may be formed around the upper end of the nearly center portion of the reinforcing plate 4. Also, in the upper end of the rear plate 3*b*, a plate-shaped protrusion wall portion 3*g* may protrude toward the front direction, and in the center portion of the protrusion wall portion 3*g*, a coupling hole 3*h* may be formed. Also, as shown in FIG. 23, in the left area of the protrusion wall portion 3*g*, a plurality of catching pieces 3 may protrude. Also, as shown in FIG. 27, in the upper ends of the side plates 3*e* and 3*f*, protrusions 3*j* may protrude inward on the entire upper ends of the side plates 3*e* and 3*f*, and in the upper surfaces (the end surfaces of the side plates 3*e* and 3*f*) of the protrusions 3*j*, a plurality of catching portions 3*k* and a plurality of screw holes (not shown) may be formed.

Outside the drum 9, a blow duct 13 having one end connected to the air supply opening of the lower portion 9*a* of the drum 9 and the other end connected to the exhaust opening 11 of the drum 9 through a lint filter 12 may be disposed to pass through the lower portion of the drum 9. The lint filter 12 may collect lint, such as clothes or sheets, come out from an object to be dried during drying operation to prevent the lint from being attached on the object to be dried. Below the drum 9, as shown in FIGS. 21 and 22, a blow apparatus 15 to cause air in the blow duct 13 to blow toward the air supply opening of the drum 9, a compressor 16 to compress refrigerant, a condenser 17 functioning as a heating apparatus to heat air in the blow duct 13 using heat emitted from the refrigerant compressed by the compressor 16, an evaporator 19 to cool and dehumidify the air heated by the condenser 17 to remove moisture contained in the air, and a motor 30 to rotatably drive the drum 9 through a drum belt 30*a* may be installed. Below the evaporator 19, a condensed water drain 21 may be installed to store condensed water generated when the evaporator 19 removes moisture from the air heated by the condenser 17.

In space S1 between the drum 9 and the top plate 3*c* of the housing 3, a water reserve tank case 23 may be disposed at the corner of the right side plate 3*e* of the drum 9, and a water reserve tank 25 may be removably installed in the water reserve tank case 23. The water reserve tank 25 may be connected to the condensed water drain 21 through a transfer pipe 27, and a pump 29 may be disposed around the lower end of the transfer pipe 27. If condensed water stored in the condensed water drain 21 reaches a predetermined level, the pump 29 may be driven to transfer the condensed water stored in the condensed water drain 21 to the water reserve tank 25 through the transfer pipe 27. Since the water reserve tank 25 is removably installed in the water reserve tank case 23, a user may remove the water reserve tank 25 from the water reserve tank case 23, and then drain water stored in the water reserve tank 25, when the water stored in the water reserve tank 25 reaches a full level.

Figure 20:
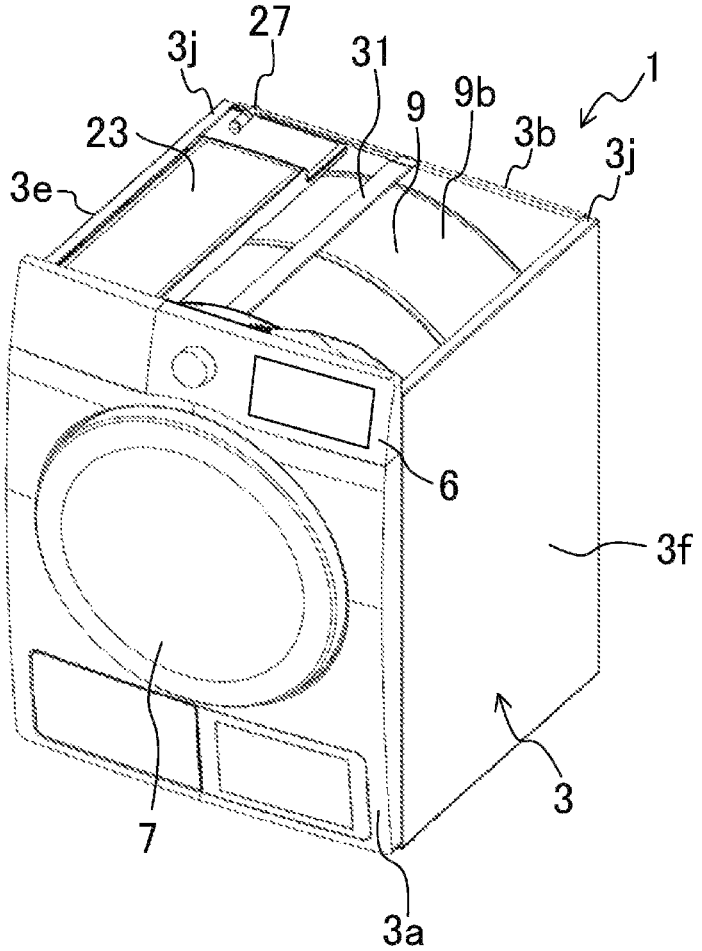
FIG. 20 is a view corresponding to FIG. 19 when a control circuit unit is removed.

The reinforcing plate 4 of the housing 3 and the upper end of the nearly center of the rear plate 3*b* may be bridged by a reinforcing member 31 extending in the front-rear direction, as shown in FIGS. 23 to 25. Also, the reinforcing member 31 is schematically shown in FIG. 20. The reinforcing member 31 may be made of a sheet metal, such as galvanized sheet steel (SGCC) or a steel plate. A portion of the reinforcing member 31 except for both ends in the longitudinal direction may include a main plate portion 31*a* formed in the shape of a long plate extending in the front-rear direction, and side plate portions 31*b* protruding downward from both left and right sides of the main plate portion 31*a* to face each other, so that the section of the reinforcing member 31 has an inverted "⊏" shape. In the main portion 31*a*, as shown in FIG. 25, three screw holes 31*c* may be formed at intervals in the longitudinal direction (the front-rear direction). Both ends of the reinforcing member 31 in the longitudinal direction may be configured with only the main plate portion 31*a*, the front end of the main plate portion 31*a* in the longitudinal direction may configure a contact portion 31*d* protruding downward at a nearly right angle, and the rear end of the main plate portion 31*a* in the longitudinal direction may configure a coupling portion 31*e* protruding in a nearly "L" shape. In the contact portion 31*d*, a coupling hole 31*f* may be formed. By inserting a screw 34 into the coupling hole 31*f* of the contact portion 31*d* and the coupling hole 4*a* of the reinforcing plate 4 after making the contact portion 31*d* contact the reinforcing plate 4 to couple the coupling portion 31*d* of the reinforcing member 31 with the reinforcing plate 4, and simultaneously coupling the coupling portion 31*e* with the coupling hole 3*h* of the protrusion wall portion 3*g* of the rear plate 3*b*, the reinforcing member 31 may be fixed at the reinforcing plate 4 and the rear plate 3*b*.

Figure 28:
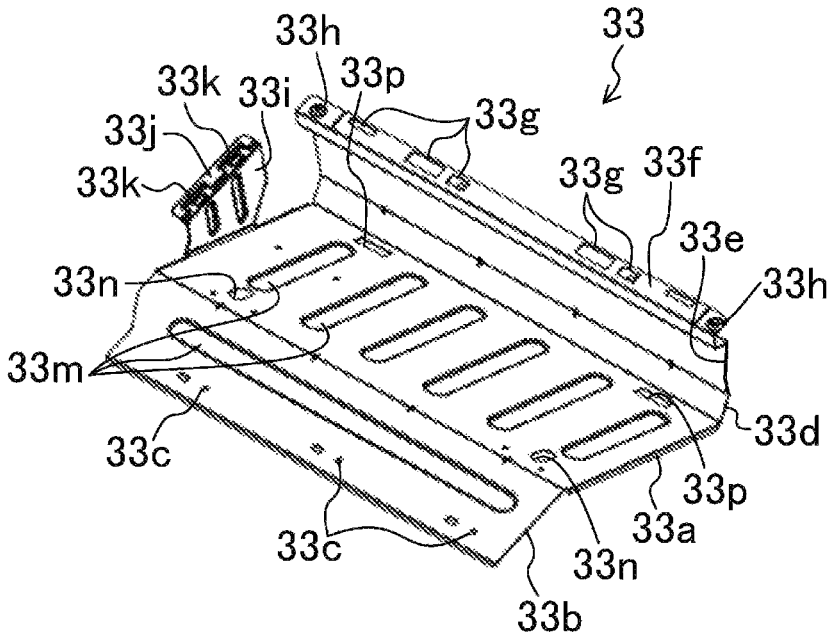
FIG. 28 is a perspective view of the support member.
Figure 31A:
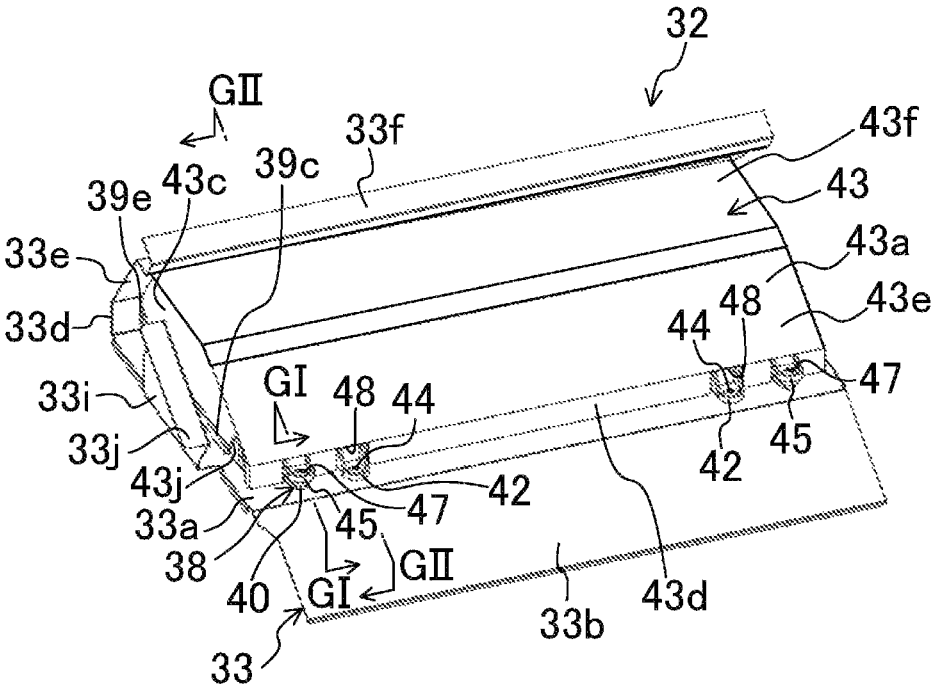
FIG. 31A is a perspective view of the control circuit unit, as seen from rear and right.
Figure 31B:
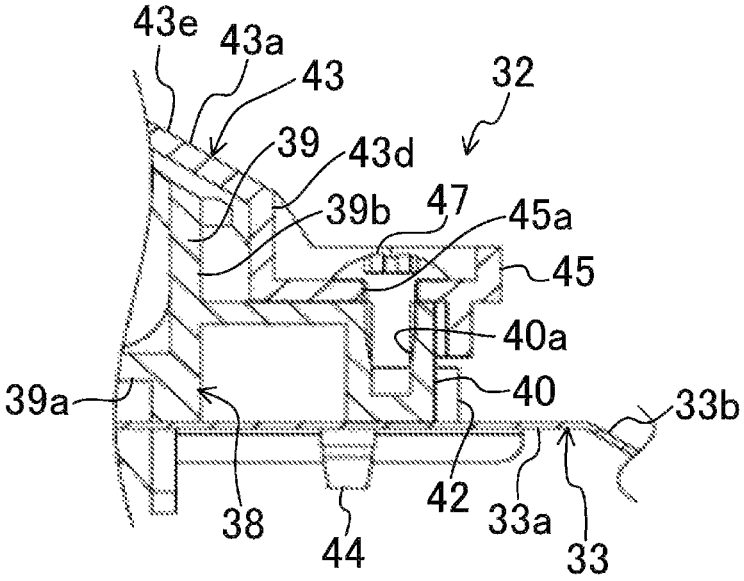
FIG. 31B is a cross-sectional view cut along a line GI-GI of FIG. 31A.
Figure 32:
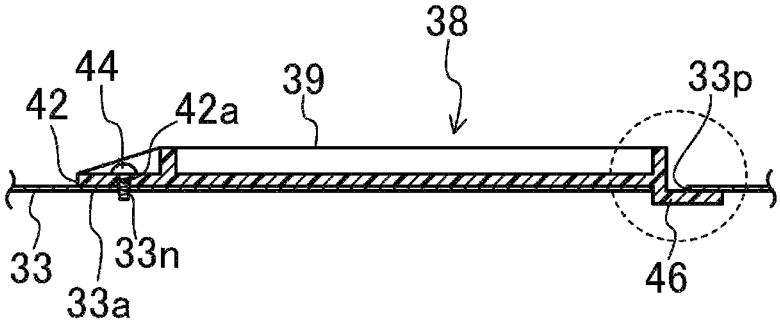
FIG. 32 is a cross-sectional view of the support member 33 and the circuit case 38, cut along a line GII-GII of FIG. 31A.

In the space S1 between the drum 9 and the top plate 3*c*, a control circuit unit 32 for controlling the blow apparatus 15, the compressor 16, and the motor 30 may be disposed at the corner of the left (one) side plate 3*f*, as shown in FIGS. 26, and 28 to 31. The control circuit unit 32 may include a support member 33 having an inclined plate portion 33*a* of a nearly rectangular plate shape. The support member 33 may be disposed at the corner of the left (one) side plate 3*f* in the space S1 between the drum 9 and the top plate 3*c*, and also, in the state in which the inclined plate portion 33*a* is inclined downward toward the left side plate 3*f* (left side), the support member 33 may be fixed at the housing 3 and the reinforcing member 31. The support member 33 may be made of a resin or a sheet metal such as galvanized sheet steel (SGCC). If the support member 33 is made of a sheet metal, high strength and heat tolerance can be obtained. At the right (inner) end edge of the inclined plate portion 33*a*, a coupling plate portion 33*b* of a nearly rectangular plate shape may extend from the inclined plate portion 33*a* nearly horizontally toward the right direction. In the coupling plate portion 33*b*, three screw holes 33*c* may be formed at locations corresponding to the screw holes 31*c* of the reinforcing member 31. By corresponding the screw holes 33*c* to the screw holes 31*c* of the reinforcing member 31, and inserting a screw 35 into the screw holes 33*c* and the screw holes 31*c*, the coupling plate portion 33*b* of the support member 33 may be fixed at the reinforcing member 31. In the left (outer) end edge of the inclined plate portion 33*a*, a first vertical plate portion 33*d* may extend upward from the inclined plate portion 33*a*, and in the first vertical plate portion 33*d*, a curved concave portion 33*e* may be formed in such a way to be concavely curved toward the left side plate 3*f*, as shown in FIG. 27. The curved concave portion 33*e* may be located in space S2 below the protrusions 3*j* of the side plate 3*f*. In the top edge of the first vertical plate portion 33*d*, a plate-shaped catching plate portion 33*f* may extend from the first vertical plate portion 33*d* nearly horizontally toward the left direction, and in the catching plate portion 33*f*, a plurality of catching portions 33*g* and a plurality of screw holes 33*h* may be formed to correspond to the catching portions 3*k* and the screw holes of the protrusions 3*j* of the side plate 3*f*. By coupling the catching portions 33*g* with the catching portions 3*k* of the side plate 3*f* to support the catching portions 33*g*, and inserting screws 37 into the screw holes 33*h* of the catching plate portion 33*f* and the screw holes of the side plate 3*f*, a catching plate portion 33*f* of the support member 33 may be fixed on the side plate 3*f* of the housing 3. Also, in the rear end edge of the inclined plate portion 33*a* of the support member 33, a second vertical plate portion 33*i* may protrude upward, and a plate-shaped installation plate portion 33*j* may extend in the rear direction nearly horizontally from the top edge of the second vertical plate portion 33*i*. In the installation plate portion 33*j*, a plurality of catching holes 33*k* may be formed to correspond to a plurality of catching pieces 3*i* of the rear plate 3*b*. By inserting the catching pieces 3*i* of the rear plate 3*b* into the catching holes 33*k* to support the catching pieces 3*i* on the catching holes 33*k*, the installation plate portion 33*j* of the support member 33 may be fixed on the rear plate 3*b* of the housing 3. Also, as shown in FIG. 28, a plurality of evagination portions 33*m* may be formed in the support member 33. By the evagination portions 33*m*, the strength of the support member 33 may increase so as to prevent deformation. The evagination portions 33*m* are not shown in FIGS. 26, 27, and 31. Also, as shown in FIG. 32, two coupling holes 33*n* may be formed at intervals in the front-rear direction, around the right end edge of the inclined plate portion 33*a* of the support member 33, and two rectangular catching holes 33*p* may be formed at intervals in the front-rear direction, around the left end edge of the inclined plate portion 33*a*.

Figure 29:
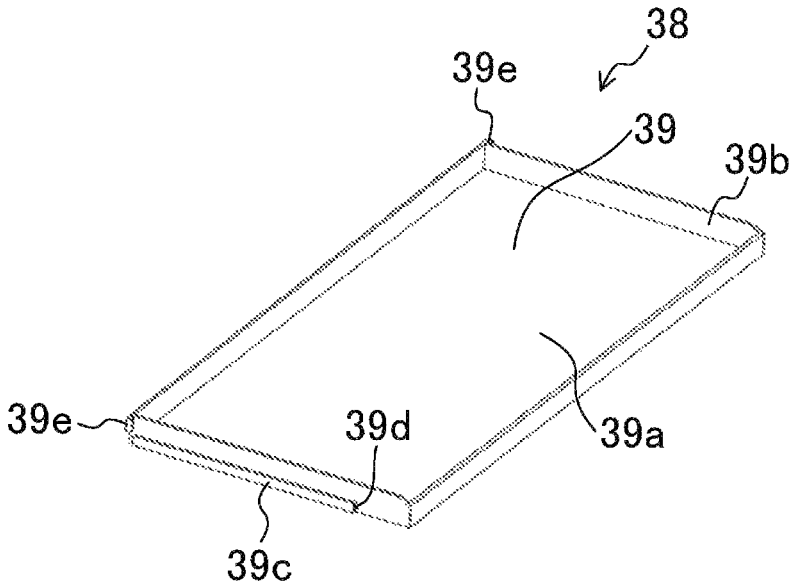
FIG. 29 is a perspective view of a circuit case, as seen from rear and right.
Figure 30:
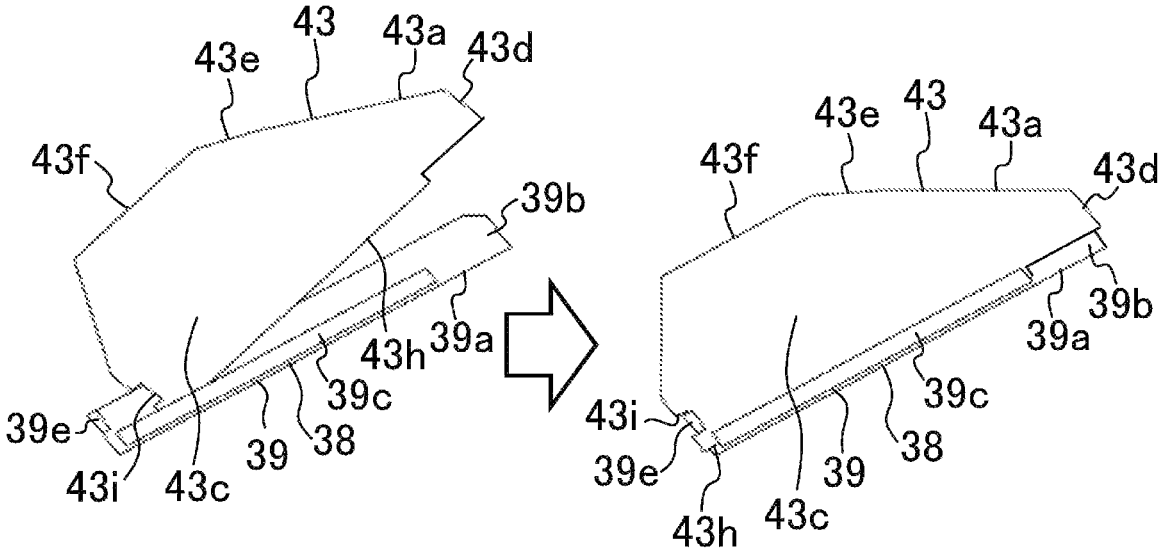
FIG. 30 is a view for describing an order in which the cover member is fixed at the circuit case, wherein the left part of FIG. 30 is a rear view for describing a process of fixing the cover member at the circuit case, and the right part of FIG. 30 is a rear view showing a state in which the cover member is fixed at the circuit case.

On one surface of the inclined plate portion 33*a* of the support member 33, the other surface of the inclined plate portion 33*a* facing the drum 9, as shown in FIG. 29, a circuit case 38 made of a resin may be installed, and the circuit case 38 may have a case main body 39 formed in the shape of a nearly shallow dish with a lower wall portion 39*a* of a rectangular plate shape, and a circumferential wall portion 39*b* of a ring shape protruding from the entire edge of the lower wall portion 39*a*, wherein the opening side of the case main body 39 may face in a direction that is opposite to the inclined plate portion 33, and the longer side of the case main body 39 may be aligned in the front-rear direction. In the front and rear surfaces of the circumferential wall portion 39*b*, guide portions 39*c* having a section of a nearly "L" shape, and extending toward the left direction to be inclined downward may protrude such that a concave groove 39*d* that is concave in a direction that is opposite to the protruding direction of the circumferential wall portion 39*b* is formed in each guide portion 39*c*. Accordingly, the concave groove 39*d* may also extend toward the left direction to be inclined downward. Also, at the left (outer) ends of the circumferential wall portion 39*b*, coupling portions 39*e* may protrude in the front-rear direction. Also, around the front and rear ends of the right surface of the circumferential wall portion 39*b*, as shown in FIGS. 31A and 31B, outer coupling portions 40 having screw holes 40*a* may protrude. In the inner portion of the circumferential wall portion 39*b* in the front-rear direction than the outer coupling portions 40, inner coupling portions 42 having screw holes 42*a* may protrude. Also, in the left end of the lower wall portion 39*a* of the case main body 39, two catching hooks 46 protruding in the left direction may be formed at intervals in the front-rear direction. By inserting the catching hooks 46 into the catching holes 33*p* of the support member 33 to support the catching hooks 46 on the catching holes 33*p*, and then inserting screws 44 into screw holes 42*a* of the inner coupling portions 42 and the coupling holes 33*n* of the support member 33, the circuit case 38 may be installed in the support member 33. The outer coupling portions 40 and the inner coupling portions 42 are not shown in FIGS. 29 and 30.

In the circuit case 38, a control board 41 for controlling the blow apparatus 15, the compressor 16, the pump 29, and the motor 30 may be accommodated. The control board 41 may control the loads of individual components in order to achieve a desired dry state based on the result of temperature detection. By coupling the control board 41 with the hooks of the lower wall portion 39*a* of the circuit case 38, and then introducing a urethane resin of a molten state into the circuit case 38 to solidify the urethane resin, the control board 41 may be fixed in the circuit case 38. In this state, the control board 41 may be surrounded by the circumferential wall portion 39*b* of the circuit case 38.

In the circuit case 38, a cover member 43 made of a resin to cover the control board 41 in a direction that is opposite to the inclined plate portion 33*a* may be fixed in such a way to be spaced from the control board 41. The cover member 43 may have a concave shape that is concave in a direction that is opposite to the lower wall portion 39*a*, and the left end of the cover member 43 may be located in the space S2 below the protrusions 3*j* of the side plate 3*f*. The cover member 43 may include a upper wall portion 43*a* to cover the control board 41 in the direction that is opposite to the lower wall portion 39*a*, a front side-wall portion 43*b* and a rear side-wall portion 43*c* protruding downward from the front end edge and the rear end edge of the upper wall portion 43*a* to cover the control board 41 in the front direction and in the rear direction, and an inner side-wall portion 43*d* protruding downward from the right (inner) end edge of the upper wall portion 43*a* to cover the control board 41 in the right (inner) direction. The upper wall portion 43*a* may include a horizontal wall portion 43*e* extending nearly horizontally with a small distance from the top plate 3*c*, and an inclined wall portion 43*f* inclined downward toward the left direction in nearly parallel to the lower wall portion 39*a* from the left (outer) end edge of the horizontal wall portion 43*e*. In the lower ends of the front side-wall portion 43*b* and the rear side-wall portion 43*c*, plate-shaped coupling pieces 43*h* may protrude downward, and the coupling pieces 43*h* may be coupled with the concave groove 39*d* of the circuit case 38. In the upper wall portion 43*a*, an opening portion 43*g* opening in the left direction may be formed to pass the control board 41 therethrough when the cover member 43 slides along the concave groove 39*d* to put or take the cover member 43 into or from the space S2 below the protrusions 3*j*, in the state in which the coupling pieces 43*h* are coupled with the concave groove 39*d* of the circuit case 38. Also, in the outer (left) end edges of the front side-wall portion 43*b* and the rear side-wall portion 43*c*, coupling concave portions 43*i* each having a nearly rectangular shape that is concave in the inner (right) direction may be formed, and the coupling portions 39*e* of the circuit case 38 may be coupled with the coupling concave portions 43*i* to limit movement of the cover member 43 in the direction that is opposite to the support member 43 and in the left direction. Also, around the inner (right) ends of the front side-wall portion 43*b* and the rear side-wall portion 43*c*, insertion holes 43*j* for passing wires therethrough may be formed. The insertion holes 43*j* are not shown in FIG. 30.

By forming coupling portions 45 having screw holes 45*a* in the inner side-wall portion 43*d* such that the coupling portions 45 protrude in the inner (right) direction, corresponding the coupling portions 45 to the outer coupling portions 40 of the circuit case 38, and inserting screws 47 into the screw holes 40*a* and 45*a*, the cover member 43 may be fixed in the circuit case 38. In the inner side-wall portion 43*d* of the coupling portion 45, a cutting portion 48 having a nearly inverted "⊏" shape that is concave upward may be formed to correspond to the inner coupling portions 42 of the circuit case 38. The coupling portion 45 is not shown in FIGS. 26 and 30.

In order to install the control circuit unit 32 configured as described above in the housing 3, the catching portions 33*g* of the catching plate portion 33*f* of the support member 33 may be caught by the catching portions 3*k* of the left side plate 3*f*, the catching plate portion 33*f* of the support member 33 may be coupled with the protrusions 3*j* of the side plate 3*f* through the screws 37, and the coupling plate portion 33*b* of the support member 33 may be coupled with the reinforcing portion 31 through the screws 35. The ends of wires around the control board 41, connecting the blow apparatus 15, the compressor 16, the pump 29, and the motor 30 to the control board 41, may be withdrawn on the support member 33 from a gap between the support member 33 and the front plate 3*a*. Then, by inserting and supporting the catching hooks 46 of the circuit case 38 in which the control board 41 is fixed into the catching holes of the support member 33 so that the catching hooks 46 are supported at the catching holes 33*p*, and then inserting the screws 44 into the screw holes 42*a* of the inner coupling portion 42 of the circuit case 38 and the screw holes 33*n* of the support member 33, the circuit case 38 may be installed on the inclined plate portion 33*a* of the support member 33, and the wires withdrawn on the support member 33 from the gap between the support member 33 and the front plate 3*a* and the ends of wires connecting the manipulation and display portion 6 to the control board 41 may be connected to the control board 41. Since the circuit case 38 is supported from below by the support member 33, the support member 33 will be not deformed, and the circuit case 38 and the control board 41 will not be easily broken, although a force is applied onto the circuit case 38 in the direction that is opposite to the support member 33 during wiring. Then, by arranging wires at locations corresponding to the insertion holes 43*j* of the cover member 43, spacing the side end of the inner side-wall portion 43*d* from the circuit case 38, as shown in the left part of FIG. 30, and coupling the side ends of the coupling concave portions 43*j* of the coupling pieces 43*h* of the cover member 43 with the concave groove 39*d* of the circuit case 38, the side end of the inner side-wall portion 43*d* of the cover member 43 may approach the circuit case 38, while causing the cover member 43 to slide to the outside. When the cover member 43 slides to the outer side, the control board 41 may pass through the opening portion 43*g* of the cover member 43 so as not to interfere with the cover member 43. Accordingly, as shown in the right part of FIG. 30, wires may be inserted into the insertion holes 43*j* of the cover member 43, the coupling pieces 43*h* of the cover member 43 may be coupled with the concave groove 39*d* of the circuit case 38, and the coupling portions 39*e* of the circuit case 38 may be coupled with the coupling concave portions 43*i* of the cover member 43. In this state, by coupling the coupling portions 45 of the cover member 43 with the outer coupling portion 40 of the circuit case 38 through the screws 47, the cover member 45 may be fixed on the circuit case 38. As such, in the space S2 below the protrusions 3*j*, the coupling portions 39*e* of the circuit case 38 may limit movement of the cover member 43 in the direction that is opposite to the support member 33 and in the left direction, without having to perform work of coupling the left end of the cover member 43 with the circuit case 38. Accordingly, work of fixing the cover member 43 at the circuit case 38 can be facilitated, and the number of components can be reduced since no coupling component such as a screw for coupling the left end of the cover member 43 with the circuit case 38 is used.

The cover member 43 fixed as described above may be withdrawn from the space S2 below the protrusions 3*j* and thus removed from the circuit case 38, by removing the screws 47, and guiding the cover member 43 to the right in the state which the coupling pieces 43*h* of the cover member 43 are coupled with the concave groove 39*d* of the circuit case 38.

Accordingly, in the aspect A of the embodiment 3, since the circuit case 38 is supported from below by the support member 33, the circuit case 38 and the control board 41 therein can be prevented from being damaged, although a force is applied onto the circuit case in the direction that is opposite to the support member during assembling such as wiring from above, maintenance work, or transportation. Accordingly, assembling, maintenance work, and transportation can be facilitated. Also, since the support member 33 is interposed between the circuit case 38 and the drum 9, the circuit case 38 and the control board 41 therein can be prevented from being broken due to contact to the rotating drum 9.

Accordingly, the dryer 1 can improve reliability compared to the typical configuration, in that the circuit case 38 and the control board 41 therein can be prevented from being damaged.

Also, since the support member 33 is disposed at the corner of the side plate 3*f*, the support member 33 can be disposed at the lower position than in the case in which the support member 33 is disposed at the narrow center area between the side plates 3*e* and 3*f* in space between the drum 9 and the top plate 3*c*. Accordingly, it is possible to increase the dimension of the control board 41 installed over one surface of the inclined plate portion 33*a*, the other surface of the inclined plate portion 33*a* facing the drum 9, thereby increasing degrees of freedom for the dimension and layout of the control board 41. In some cases, even when a large-scale control board 41 is used, it is unnecessary to divide a control circuit and install the divided control circuits outside the circuit case 38, thereby simplifying wiring and minimizing the influence of noise.

Accordingly, the dryer 1 can improve productivity compared to the typical configuration, in that it can increase degrees of freedom for the dimension and layout of the control board 41.

Also, since the inclined plate portion 33*a* of the support member 33 is inclined downward toward the side plate 3*f*, the inclined plate portion 33*a* can be disposed at the lower position around the side plate 3*f*, than in the case in which the inclined plate portion 33*a* of the support member 33 is disposed horizontally. Accordingly, it is possible to increase the dimension of the control board 41 installed over one surface of the inclined plate portion 33*a*, the other surface of the inclined plate portion 33 facing the drum 9, around the side plate 3*f* of the inclined plate portion 33*a*, thereby increasing degrees of freedom for the dimension and layout of the control board 41.

Also, since wires around the edges of the control board 41 are withdrawn on the support member 33, the wires may be prevented from being damaged due to contact to the rotating drum 9.

Also, since the support member 33 is supported in three directions by the side plate 3*f*, the rear plate 3*b*, and the reinforcing member 31 of the housing 3, the support member 33 may be stably prevented from dropping due to vibration, etc. Also, since the support member 33 is supported with high strength at locations where it is fixed at the side plate 3*f*, the rear plate 3*b*, and the reinforcing member 31, the support member 33 can be more reliably prevented from being deformed due to vibration, etc. occurring upon transportation or operation, and can support a heavier weight of components, to thereby increase degrees of freedom of control components installed in the housing 3.

Also, even when water enters the housing 3 through a gap between the side plate 3*f* and the top plate 3*c*, the cover member 43 may block the water from entering the control board 41, thereby preventing corrosion of the control board 41 or shorted circuits. Also, the cover member 43 may block lint come out from an object to be dried, such as clothes or sheets, from being attached on the control board 41, thereby preventing a failure of the control board 41 due to lint attached on the control board 41.

Also, since the cover member 43 is fixed at the circuit case 38, the cover member 43 can be prevented from being separated due to vibration, etc.

Also, since heat from the control board 41 can be radiated through the opening portion 43*g* of the cover member 43, it is possible to prevent the temperature of the control board 41 from rising excessively.

Also, since the cover member 43 and the circuit case 38 are disposed in the space S2 below the protrusions 3*j* of the side plate 3*f*, it is possible to increase the sizes of the cover member 43 and the control board 41, resulting in high degrees of freedom for the dimension and layout of the control board 41.

Since the cover member 43 has a shape that is concave in the direction that is opposite to the lower wall portion 39*a* so that space is formed in the inside of the cover member 43, it is possible to increase degrees of freedom for the dimension in height and layout of the control board 41, and to mitigate a temperature rise when the control board 41 emits heat.

Also, in the aspect A of the embodiment 3, the cover member 43 is installed in the circuit case 38 after the circuit case 38 is installed in the support member 33, however, it is also possible that the circuit case 38 is installed in the support member 33 after the cover member 43 is fixed on the circuit case 38. In this case, since work of installing the circuit case 38 and the support member 33 can be performed after the control board 41 is protected by the cover member 43, it is possible to prevent breakage of the control board 41 due to contacts or collision with tools, etc. or a failure of the control board 41 due to foreign materials such as screws, during the installation work.

(Aspect B of the Embodiment 3)

Figure 33A:
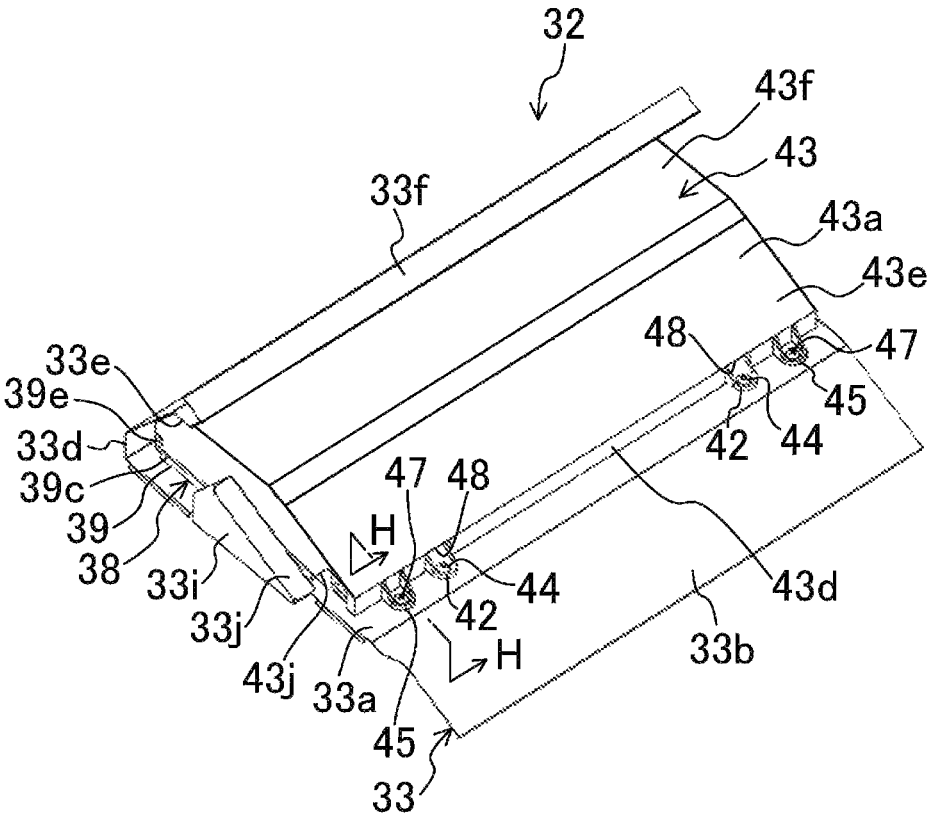
FIG. 33A is a view corresponding to FIG. 31A of the aspect B of the embodiment 3.
Figure 33B:
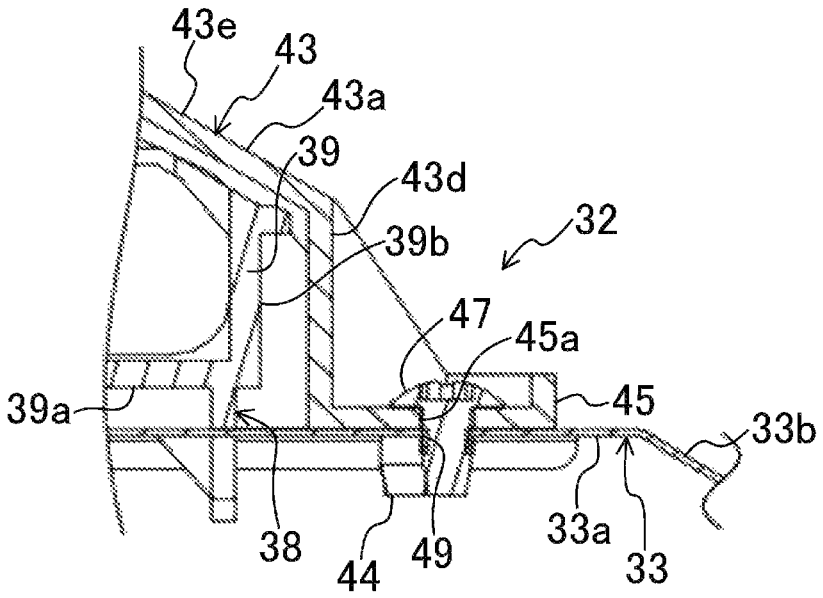
FIG. 33B is a cross-sectional view cut along a line H-H of FIG. 33A.

FIGS. 33A and 33B show the control circuit unit 32 of the dryer 1 according to the aspect B of the embodiment 3. In the aspect B of the embodiment 3, by forming screw holes 49 in the inclined plate portion 33*a* of the support member 33, and corresponding the screw holes 49 to the screw holes 45*a* of the cover member 43 to insert the screws 47 into the screw holes 49 and the screw holes 45*a*, the cover member 43 may be fixed on the support member 33. Meanwhile, no outer coupling portion 40 may be installed in the circuit case 38.

Since the other components are the same as the corresponding ones of the aspect A of the embodiment 3, the components are assigned the same reference numerals, and detailed descriptions thereof will be omitted.

In the aspect B of the embodiment 3, since no outer coupling portion 40 for fixing the cover member 43 on the circuit case 38 is needed, it is possible to enlarge the case main body 39 to widen the accommodation space of the control board 41.

(Aspect C of the Embodiment 3)

Figure 34A:
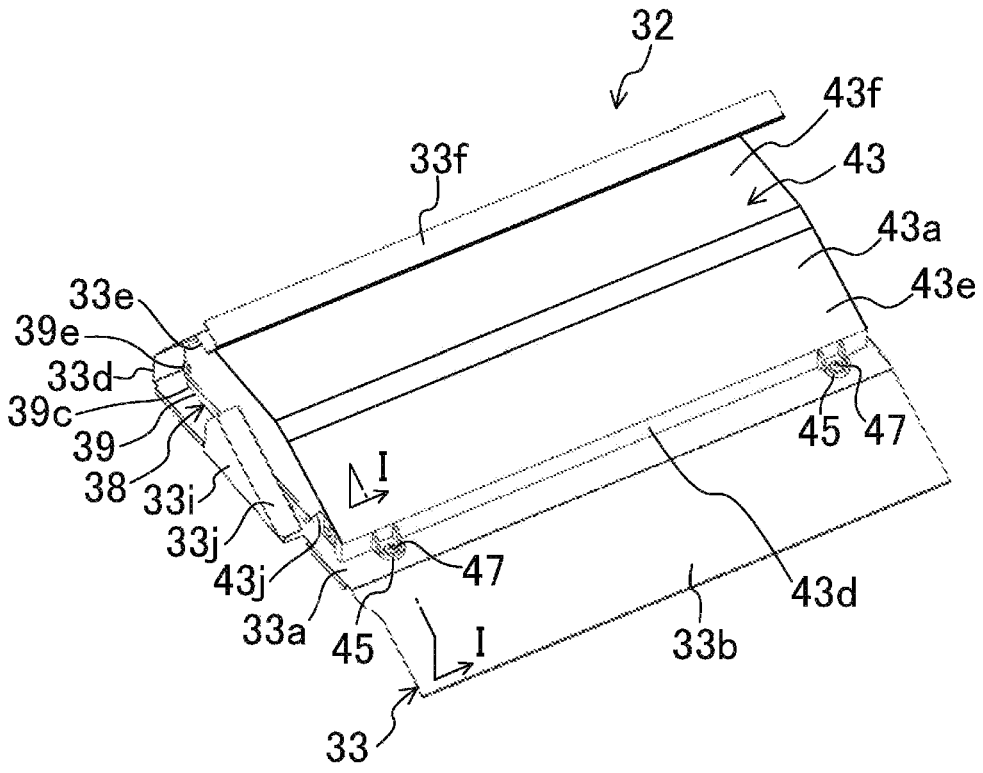
FIG. 34A is a view corresponding to FIG. 31A according to aspect C of the embodiment 3.
Figure 34B:
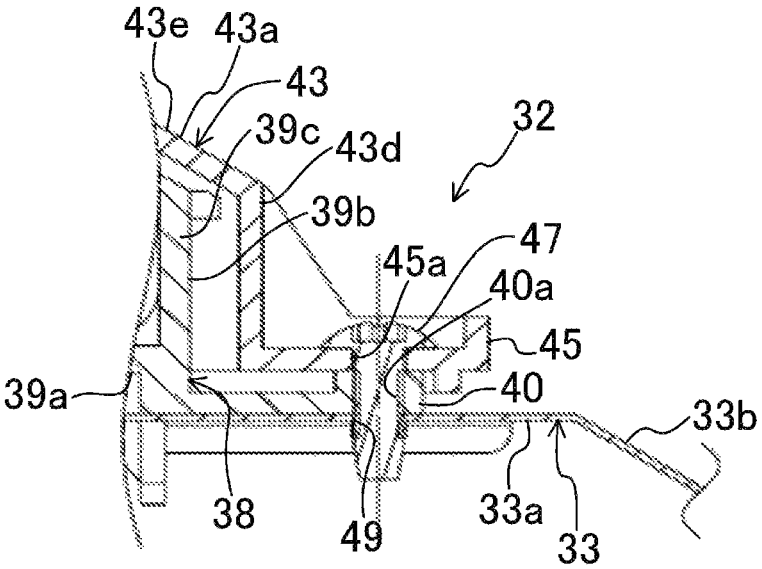
FIG. 34B is a cross-sectional view cut along a line I-I of FIG. 34A.

FIGS. 34A and 34B show the control circuit unit 32 of the dryer 1 according to aspect C of the embodiment 3. In the aspect C of the embodiment 3, by forming the screw holes 49 in the inclined plate portion 33*a* of the support member 33, and inserting screws 47 into the screw holes 49, the screw holes 45*a* of the cover member 43, and the screw holes 40*a* of the circuit case 38, the cover member 43 may be fixed on both the circuit case 38 and the support member 33. Also, the inner coupling portion 42 of the circuit case 38 and the cutting portion 48 of the cover member 43 may be not installed.

Since the other components are the same as the corresponding ones of the aspect A of the embodiment 3, the components are assigned the same reference numerals, and detailed descriptions thereof will be omitted.

In the aspect C of the embodiment 3, the cover member 43 can be stably prevented from being separated due to vibration, etc., compared to the case in which the cover member 43 is fixed at any one of the circuit case 38 and the support member 33.

(Aspect D of the Embodiment 3)

Figure 35:
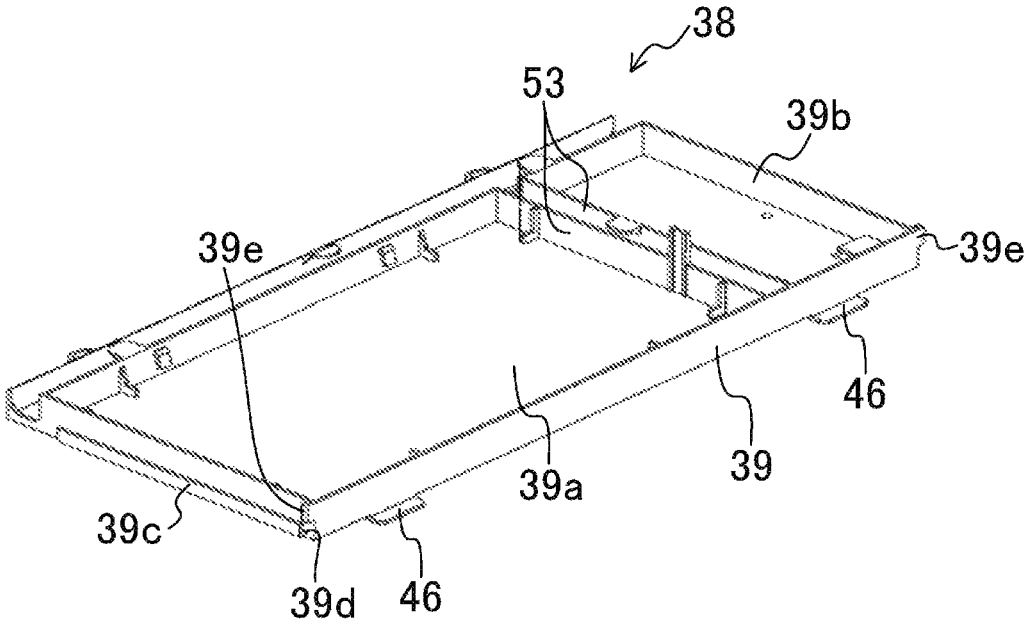
FIG. 35 is a perspective view of a circuit case according to aspect D of the embodiment 3, as seen from front and left.

FIG. 35 shows the circuit case 38 of the dryer 1 according to the aspect D of the embodiment 3. In the aspect D of the embodiment 3, the circuit case 38 may accommodate control components (not shown) such as a reactor connected to the control board 41 through wires behind the control board 41. Space between the control components and the control board 41 may be partitioned by a dual plate-shaped partitioning portion 53 protruding from the lower wall portion 39*a* in the front-rear direction. The control components may be covered by the cover member 43 in a direction that is opposite to the inclined plate portion 33*a*.

Since the other components are the same as the corresponding ones of the aspect A of the embodiment 3, the components are assigned the same reference numerals, and detailed descriptions thereof will be omitted.

In the aspect D of the embodiment 3, since it is unnecessary to withdraw wires connecting the control components to the control board 41 to the outside of the circuit case 38, wiring can be facilitated. Also, even when water enters the housing 3 through the gap between the side plates 3*e* and 3*f* and the top plate 3*c*, the cover member 43 may block the water from entering the control components, thereby preventing a failure of the control components due to water.

Also, since the plate-shaped partitioning portion 53 prevents the urethane resin used for moisture proofing (or fixing) of the control board 41 from entering the control components, the control components not requiring moisture proofing can be easily attached or detached, and simultaneously, a required amount of the urethane resin can be reduced, thereby suppressing cost.

(Aspect E of the Embodiment 3)

Figure 36:
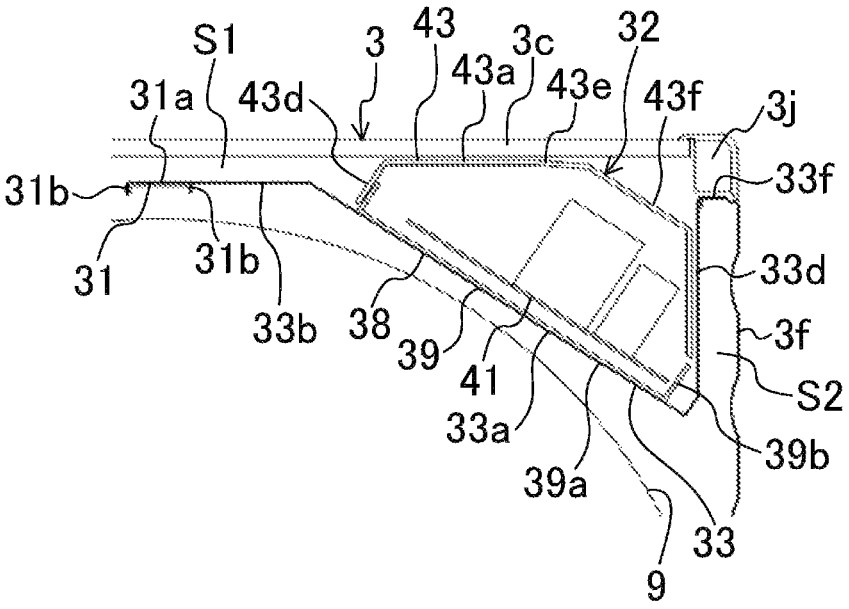
FIG. 36 is a view corresponding to FIG. 27 according to aspect E of the embodiment 3.

FIG. 36 shows the control circuit unit 32 of the dryer 1 according to aspect E of the embodiment 3. In the aspect E of the embodiment 3, no curved concave portion 33*e* may be formed in the support member 33, and the entire of the cover member 43 may be located to the right rather than the space S2 below the protrusions 3*j*. Also, no opening portion 43*g* may be formed in the cover member 43.

Since the other components are the same as the corresponding ones of the aspect A of the embodiment 3, the components are assigned the same reference numerals, and detailed descriptions thereof will be omitted.

In the aspect E of the embodiment 3, the cover member 43 can be disposed at a fixed location from above, without performing operation of making the cover member 43 slide to the outside as in the aspects A to D of the embodiment 3.

(Aspect F of the Embodiment 3)

FIG. 37 shows the support member 33 of the dryer 1 according to aspect F of the embodiment 3. In the aspect F of the embodiment 3, the support member 33 may include neither the second vertical plate portion 33*i* nor the installation plate portion 33*j*, and may be fixed by only the reinforcing member 31 and the side plate 3*f* of the housing 3*f*.

Since the other components are the same as the corresponding ones of the aspect A of the embodiment 3, the components are assigned the same reference numerals, and detailed descriptions thereof will be omitted.

Also, in the aspects A to F of the embodiment 3, the present invention is applied to the circulation dryer 1, however, the present invention can be applied to an exhaust type dryer. The blowing apparatus 15 may be any apparatus capable of causing air heated by the condenser 17 to blow through the drum 9, for example, capable of blowing to discharge air from the drum 9, in addition to causing air in the blow duct 13 to blow toward the air supply opening of the drum 9.

The invention claimed is:

1. A dryer comprising:

a housing;

accommodation space formed in the housing, and configured to accommodate an object to be dried;

a circulation ventilation path configured to pass through the accommodation space;

a heat pump apparatus having a compressor, a throttling device, an evaporator, and a condenser, the evaporator and the condenser installed in the circulation ventilation path, the condenser configured to circulate refrigerant;

an auxiliary heat exchanger installed outside the circulation ventilation path and connected to the condenser, so that the refrigerant flows between the condenser and the auxiliary heat exchanger; and a cooling apparatus configured to cool the auxiliary heat exchanger, wherein the condenser has a first flow path configured to circulate the refrigerant, whose upstream end is connected to a discharge side of the compressor, and a second flow path configured to circulate the refrigerant, whose downstream end is connected to the throttling device, a downstream end of the first flow path is connected to an upstream end of a radiating flow path in the auxiliary heat exchanger, and an upstream end of the second flow path is connected to a downstream end of the radiating flow path, and the auxiliary heat exchanger is separate and spaced apart from the condenser.

2. The dryer according to claim 1, wherein the cooling apparatus comprises a cooling fan configured to cause air outside the housing to blow toward the auxiliary heat exchanger.

3. The dryer according to claim 1, wherein the cooling apparatus comprises an exhaust fan disposed in the housing, and configured to discharge outside air to the outside of the housing after cooling the auxiliary heat exchanger.

4. The dryer according to claim 1, wherein the compressor has a compression capacity which is variable to increase or decrease a temperature of refrigerant that is discharged from the compressor.

5. The dryer according to claim 1, wherein a refrigerant temperature sensor configured to detect a temperature of refrigerant discharged from the compressor, is installed in a refrigerant pipe connecting the compressor to the condenser, and the cooling apparatus cools the auxiliary heat exchanger based on the result of detection by the temperature sensor.

6. The dryer according to claim 1, wherein the condenser is configured as a fin-end-tube type heat exchanger having a plurality of straight pipe sections, and a plurality of connecting pipe sections connecting one ends of the straight pipe sections to each other such that the straight pipe sections communicate with each other.

7. The dryer according to claim 1, further comprising:

a bypass path configured to supply refrigerant discharged from the downstream end of the first flow path to the upstream end of the second flow path by bypassing the radiating flow path; and a flow path selecting device configured to divert the refrigerant discharged from the downstream end of the first flow path so that the refrigerant flows to the radiating flow path or the bypass path.

* * * * *